US006474769B1

(12) United States Patent
Imanaka et al.

(10) Patent No.: US 6,474,769 B1
(45) Date of Patent: Nov. 5, 2002

(54) LIQUID DISCHARGE HEAD, LIQUID DISCHARGE APPARATUS AND METHOD FOR MANUFACTURING LIQUID DISCHARGE HEAD

(75) Inventors: Yoshiyuki Imanaka; Akihiro Yamanaka, both of Kawasaki; Teruo Ozaki, Yokohama; Masahiko Kubota, Tokyo; Shinji Watanabe, Kawasaki; Yoichi Taneya, Yokohama; Hiroyuki Sugiyama, Sagamihara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/587,053

(22) Filed: Jun. 2, 2000

(30) Foreign Application Priority Data

| | | |
|---|---|---|
| Jun. 4, 1999 | (JP) | 11-157737 |
| Jun. 4, 1999 | (JP) | 11-157777 |
| Jun. 4, 1999 | (JP) | 11-158359 |
| Jun. 4, 1999 | (JP) | 11-158366 |
| Jun. 4, 1999 | (JP) | 11-158648 |

(51) Int. Cl.[7] ..... B41J 29/393
(52) U.S. Cl. ..... 347/19; 347/65
(58) Field of Search ..... 347/14, 17, 19, 347/65

(56) References Cited

U.S. PATENT DOCUMENTS

| | | | | |
|---|---|---|---|---|
| 4,125,845 A | * | 11/1978 | Stevenson, Jr. | 347/17 |
| 5,191,360 A | | 3/1993 | Pohlig | 346/140 |
| 5,831,643 A | * | 11/1998 | Chung | 347/17 |
| 6,252,616 B1 | * | 6/2001 | Okazaki et al. | 347/65 |

FOREIGN PATENT DOCUMENTS

| | | |
|---|---|---|
| EP | 0 819 531 | 1/1998 |
| GB | 2 267 254 | 12/1993 |
| JP | 7-52387 | 2/1995 |
| JP | 7-178924 | 7/1995 |
| JP | 10-29321 | 2/1998 |

OTHER PUBLICATIONS

Patent Abstracts of Japan, vol. 1998, No. 06, Apr. 30, 1998, JP 10–029321 A (Feb. 3, 1998).
Patent Abstracts of Japan, vol. 1995, No. 10, Nov. 30, 1995, JP 07–178924 A (Jul. 18, 1995).
Patent Abstracts of Japan, vol. 1995, No. 05, Jun. 30, 1995, JP 07–052387 A (Feb. 28, 1995).

* cited by examiner

*Primary Examiner*—John Barlow
*Assistant Examiner*—Julian D. Huffman
(74) *Attorney, Agent, or Firm*—Fitzpatrick, Cella, Harper & Scinto

(57) ABSTRACT

The present invention provides a liquid discharge head comprising a plurality of discharge ports for discharging liquid, first and second substrates for defining a plurality of liquid flow paths communicated with the discharge ports, and a plurality of energy converting elements disposed in the liquid flow paths and adapted to convert electrical energy into discharge energy for liquids in the liquid flow paths, wherein sensors for detecting behavior of the liquid are provided in the respective liquid flow paths as solid structure portions protruded from walls of the liquid flow paths.

38 Claims, 42 Drawing Sheets

LIQUID DISCHARGE HEAD, LIQUID DISCHARGE APPARATUS AND METHOD FOR MANUFACTURING LIQUID DISCHARGE HEAD

BACKGROUND OF THE INVENTION

1. Field of the Invention

The present invention relates to a liquid discharge head for discharging a desired liquid by generating a bubble created by acting thermal energy to the liquid, a method for manufacturing such a liquid discharge head, and a liquid discharge apparatus.

2. Related Background Art

An ink jet recording method, i.e., a so-called bubble jet recording method in which a condition change including abrupt volume change (generation of bubbles) is generated and ink is discharge from a discharge port by an action force based on the condition change and the discharged ink is attached to a recording medium to form an image on the recording medium is well known. As disclosed in U.S. Pat. No. 4,723,129, in a recording apparatus utilizing such a bubble jet recording method generally includes discharge ports for discharging the ink, ink flow paths communicated with the discharge ports, electrical/thermal converters (as energy generating means) disposed in the ink flow paths and adapted to generate energy for discharging the ink.

According to such a recording method, since a high quality image can be recorded at a high speed with low noise and the discharge ports can be arranged with high density in a recording head carrying out the recording method, there are provided many excellent advantages that an image having high resolving power and even a color image can easily be recorded by a compact apparatus. Thus, recently, the bubble jet recording method has been applied to various office equipments such as printers, copying machines and facsimiles and has also been utilized in industrial systems such as a printing apparatus.

By the way, the electrical/thermal converter for generating energy for discharging the ink can be manufactured by using a semiconductor manufacturing process. Thus, a conventional head utilizing a bubble jet technique is constituted by forming the electrical/thermal converters on an element substrate composed of a silicon substrate and by forming grooves defining the ink flow paths above the converters and by bonding a top plate made of a resin such as polysulfone, glass or the like thereto.

Further, there has been proposed a technique in which, by utilizing the fact that the element substrate is composed of the silicon substrate, not only the electrical/thermal converters are formed on the element substrate but also drivers for driving the electrical/thermal converters and temperature sensors used for controlling the electrical/thermal converters in accordance with a temperature of a head and their associated drive control portion are provided on the element substrate (for example, refer to Japanese Patent Application Laid-Open No. 7-52387). The head in which the drivers and the temperature sensors and the associated drive control portion are provided on the element substrate has already been put on practical use, thereby contributing to improvement of reliability of the recording head and compactness of the apparatus.

In the conventional liquid discharge head in which the temperature sensors are provided on the element substrate, the temperature sensor was mainly used for measuring the temperature of the element substrate. However, recently, as high density recording has been progressed, an amount of ink discharged by one discharging has been made smaller more and more, with the result that, rather than the temperature of the substrate, condition and kind of the ink such as temperature and density of the ink itself have affected an influence upon the recording. That is to say, as the ink discharging amount is decreased, the difference in discharge amount due to the condition of ink which did not arise serious problem conventionally has been highlighted as dispersion in discharge amount.

In such a circumstance, in the arrangement of the temperature sensors in the conventional liquid discharge head, it was difficult to detect more correct ink condition. The reason is that, although the temperature sensors in the conventional liquid discharge head are flatly formed on the surface of the element substrate together with the electrical/thermal converters and the drive control portion by using the semiconductor wafer process, in the vicinity of the surface of the element substrate, flow of ink is apt to be stagnated and great temperature gradation is created by the influence of heat from the electrical/thermal converters.

SUMMARY OF THE INVENTION

An object of the present invention is to provide a liquid discharge head, a substrate for use in such a liquid discharge head and a method for manufacturing such head and substrate, in which stable discharging is permitted by detecting a condition of liquid to be discharged with high accuracy.

To achieve the above object, according to the present invention, there is provided a liquid discharge head comprising a plurality of discharge ports for discharging liquid, first and second substrates for defining a plurality of liquid flow paths communicated with the discharge ports, and a plurality of energy converting elements each disposed in each of the liquid flow paths and adapted to convert electrical energy into discharge energy for liquids in the liquid flow paths, wherein sensors for detecting behavior of the liquid are provided in the respective liquid flow paths as solid structure portions protruded from walls of the liquid flow paths.

According to another aspect of the present invention, there is provided a liquid discharge head comprising a first liquid flow path communicated with a discharge port, a second liquid flow path having therein a heat generating body for generating a bubble in liquid by applying heat to the liquid, and a movable member disposed between the first and second liquid flow paths and having a free end at a downstream side thereof along a liquid flowing direction and adapted to transmit a pressure caused by generating of the bubble in the second liquid flow path to the first liquid flow path by displacing the free end toward the first liquid flow path on the basis of such pressure, wherein a sensor for detecting a condition of the liquid located on a wall of the first liquid flow path at least between the discharge port and the free end of the movable member is provided, and wherein first liquid supplied to the first liquid flow path and second liquid supplied to the second liquid flow path are both discharged from the discharge port by the generation of the bubble in the second liquid.

According to a further aspect of the present invention, there is provided a liquid discharge apparatus comprising the above-mentioned liquid discharge head, wherein recording is effected by discharging liquid onto a recording medium by driving the energy generating element while adjusting the energy generating element on the basis of output voltage obtained in a circuit portion.

According to a still further aspect of the present invention, there is provided a method for manufacturing a liquid discharge head substrate used in a liquid discharge head for discharging liquid by applying discharge energy to the liquid and having a semiconductor substrate on which an energy converting element for converting electrical energy into the discharge energy is formed, comprising the steps of forming a substrate layer including a semiconductor material on the semiconductor substrate in a predetermined pattern, forming a detecting portion having electrical property changed in accordance with behavior of the liquid to be detected and a wiring for electrically connecting the detecting portion to an electric circuit formed on the semiconductor substrate on the substrate layer, and forming a protection layer including a semiconductor material for protecting the wiring on the substrate layer on which the detecting portion and the wiring were formed.

According to a further aspect of the present invention, there is provided a method for manufacturing a liquid discharge head including a plurality of discharge ports for discharging liquid, first and second substrates for defining a plurality of liquid flow paths communicated with the discharge ports, and a plurality of energy converting elements disposed in the liquid flow paths and adapted to convert electrical energy into discharge energy for liquids in the liquid flow paths, comprising the steps of forming a detecting portion having electrical property changed in accordance with behavior of the liquid to be detected and a wiring electrically connected to the detecting portion on at least one of the first and second substrates, and forming a protection layer including a semiconductor material for protecting the wiring on the substrate layer on which the detecting portion and the wiring were formed.

Incidentally, in the specification, terms "upstream" and "downstream" are used in connection with a liquid flowing direction from a liquid supply source toward a discharge port through a bubble generating area (or a movable member), or a constructural direction of this constitution.

BRIEF DESCRIPTION OF THE DRAWINGS

FIG. 23A is a plan view of the element substrate constituting a heater board, and FIG. 23B is a plan view of the element substrate constituting a top plate;

FIG. 29A is a plan view of the element substrate, and FIG. 29B is a plan view of a top plate;

FIG. 34A is a plan view of an element substrate, and FIG. 34B is a plan view of a top plate;

FIG. 41A is a plan view of an element substrate, and FIG. 41B is a plan view of a top plate;

DESCRIPTION OF THE PREFERRED EMBODIMENTS (First Embodiment)

Now, as a first embodiment of the present invention, an explanation will be made regarding a liquid discharge head comprising a plurality of discharge ports for discharging liquid, first and second substrates for forming a plurality of liquid flow paths communicated with the respective discharge ports by joining these substrates together, a plurality of energy converting elements disposed within the respective liquid flow paths to convert electrical energy into discharge energy for liquids in the liquid flow paths, and a plurality of elements or electric circuit having different function and adapted to control driving conditions of the energy converting elements, and wherein the elements or the electric circuits are shared into the first and second substrates in accordance with their functions.

Figure 1:
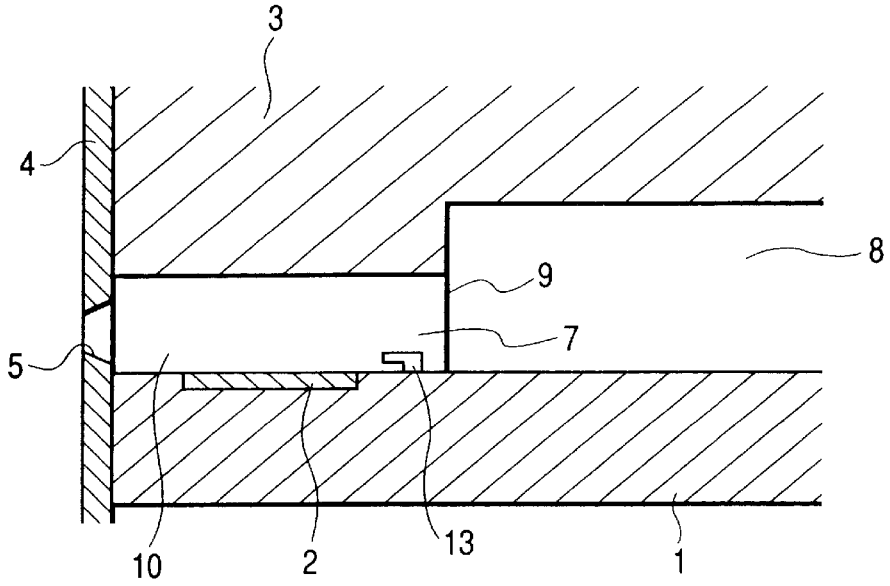
FIG. 1 is a sectional view of a liquid discharge head according to an embodiment of the present invention, along a liquid flow path direction thereof.

FIG. 1 is a sectional view of a liquid discharge head according to the first embodiment of the present invention, taken along a direction of a liquid flow path thereof.

As shown in FIG. 1, the liquid discharge head comprises an element substrate 1 on which a plurality of heat generating bodies 2 (only one of which is shown in FIG. 1) for providing thermal energy for generating bubbles in the liquid are arranged in parallel, a top plate 3 joined to the element substrate 1, and an orifice plate 4 joined to front end faces of the element substrate 1 and the top plate 3. The top plate 3 has grooves formed at positions corresponding to the heat generating bodies 2, so that, when the element substrate 1 and the top plate 3 are joined together, liquid flow paths 7 corresponding to the heat generating bodies 2 are formed.

The element substrate 1 is constituted by forming silicon oxide film or silicon nitride film for insulation and heat regeneration onto a silicon substrate and by patterning electrical resistive layers and wirings constituting the heat generating bodies 2 on the substrate. By applying electric current to the electrical resistive layers from the wirings, the heat generating bodies 2 emit heat.

The top plate 3 defines the plurality of liquid flow paths 7 corresponding to the heat generating bodies 2 and a common liquid chamber 8 for supplying the liquid to the liquid flow paths 7. To this end, liquid path side walls 9 extending from a ceiling portion to portions between the heat generating bodies 2 are integrally formed with the top plate. The top plate 3 is formed from silicon material, and patterns of the liquid flow paths 7 and the common liquid chamber 8 may be formed by etching or, after material constituting the liquid path side walls 9 such as silicon nitride or silicon oxide is deposited on the silicon substrate by a known film forming method such as CVD, portions corresponding to the liquid flow paths 7 may be formed by etching.

The orifice plate 4 is provided with a plurality of discharge ports 5 corresponding to the liquid flow paths and communicated with the common liquid chamber 9 through the liquid flow paths 7. The orifice plate 4 is also formed from silicon material and may be formed, for example, by cutting a silicon substrate with the discharge ports 5 formed therein into a plate having a thickness of about 10 to 150 $\mu$m. Incidentally, the orifice plate 4 is not inevitable for the present invention. Thus, in place of the orifice plate 4, a wall having a thickness corresponding to that of the orifice plate 4 may be left at a front end face of the top plate 3 when the liquid flow paths 7 are formed in the top plate 3 and the discharge ports 5 may be formed in such a wall, thereby providing a top plate with discharge ports.

In the above-mentioned arrangement, when the heat generating body 2 is heated, heat acts on the liquid in a bubble generating area 10 (opposed to the heat generating body 2) within the liquid flow path 7, with the result that a bubble is created by a film boiling phenomenon on the heat generating body 2 and is grown. Pressure due to generation of the bubble and growth of the bubble itself are transferred to the discharge port 5, thereby discharging the liquid from the discharge port 5.

On the other hand, when the bubble starts to be distinguished, in order to compensate for reduction of volume due to contraction of the bubble in the bubble generating area 10 and in order to compensate for volume corresponding to the discharged liquid, the liquid flows into this area from the upstream common liquid chamber 8, thereby re-filling the liquid in the liquid flow path 7.

Further, the liquid discharge head according to the illustrated embodiment includes circuits and elements for controlling the driving of the heat generating bodies 2. These circuits and elements are shared into the element substrate 1 and the top plate 3 in accordance with their functions. Further, since the element substrate 1 and the top plate 3 are formed from silicon material, the circuits and the elements can be formed easily and finely by using a semiconductor wafer process.

Now, a structure of the element substrate 1 formed by using the semiconductor wafer process will be explained.

Figure 2:
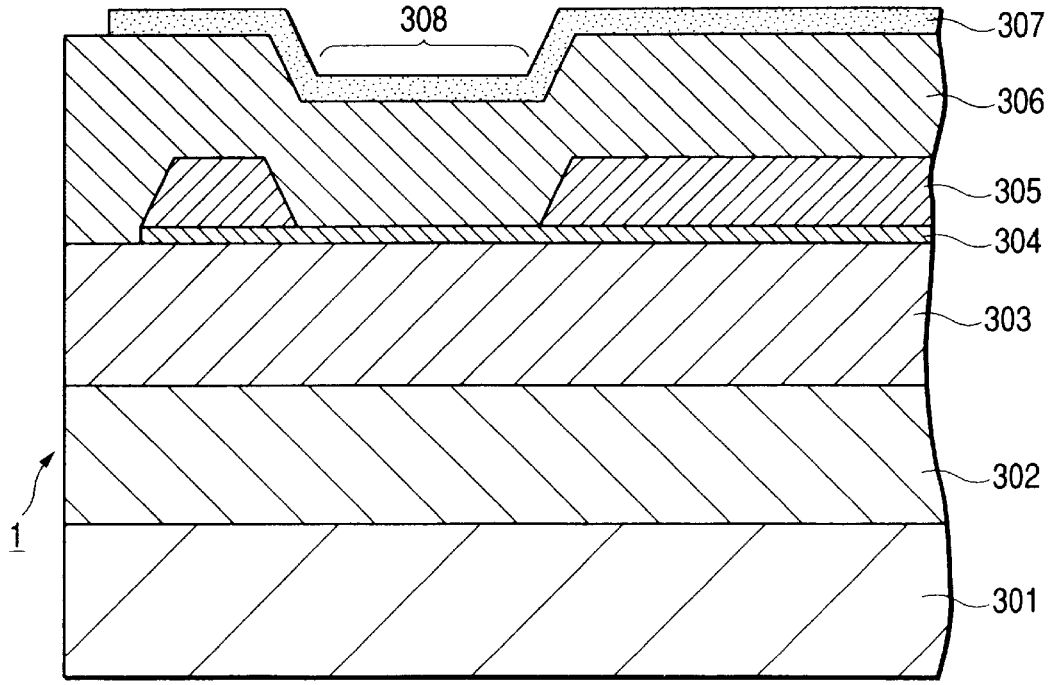
FIG. 2 is a sectional view showing a main part of an element substrate used in the liquid discharge head shown in FIG. 1.

FIG. 2 is a sectional view showing a main part of the element substrate used in the liquid discharge head shown in FIG. 1. As shown in FIG. 2, in the element substrate 1 used in the liquid discharge head according to the illustrated embodiment, a thermal oxidation film 302 as a heat regeneration (heat storage) layer and a layer-to-layer film 303 also acting as the heat regeneration layer are stacked in order on a surface of a silicon substrate 301. $SiO_2$ film or $Si_3N_4$ film is used as the layer-to-layer film 303. A resistive layer 304 is partially formed on the surface of the layer-to-layer film 303 and wiring 305 is partially formed on the surface of the resistive layer 304. Al wiring or Al alloy (such as Al—Si or Al—Cu) wiring is used as the wiring 305. A protection layer 306 comprised of $SiO_2$ film or $Si_3N_4$ film is formed on the surfaces of the wiring 305, resistive layer 304 and layer-to-layer film 303. On a portion of the surface of the protection layer 306 corresponding to the resistive layer 304 and therearound, an anti-cavitation film 307 for protecting the protection layer 306 from chemical and physical shocks due to heat generation on the resistive layer 304 is formed. An area of the surface of the resistive layer 304 on which the wiring 305 is not formed acts as a heat acting portion 308 on which the heat of the resistive layer 304 acts.

The films on the element substrate 1 are successively formed on the surface of the silicon substrate 301 by the semiconductor manufacturing technique, thereby providing the heat acting portions 308 on the silicon substrate 301.

Figure 3:
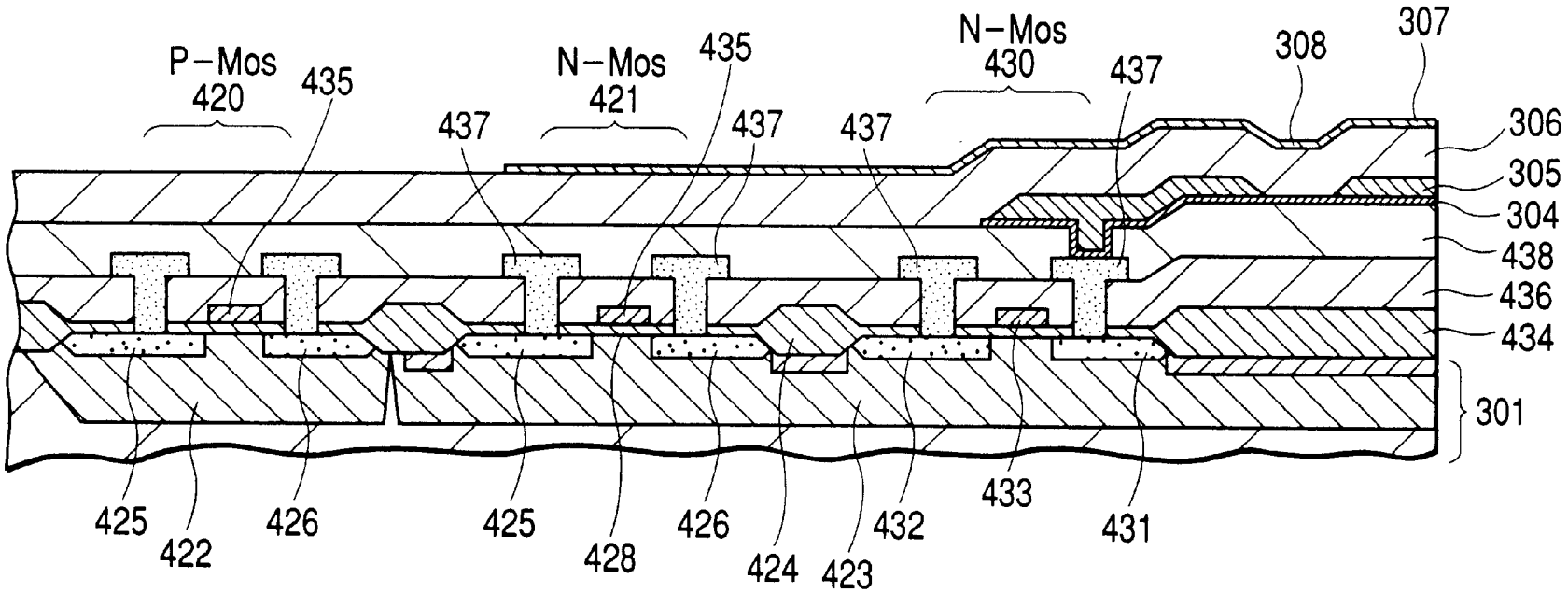
FIG. 3 is a schematic sectional view of the element substrate of FIG. 2, taken along the line passing through a main element of the element substrate.

FIG. 3 is a schematic sectional view of the element substrate 1, taken along a longitudinal direction of a main part of the element substrate 1 shown in FIG. 2.

As shown in FIG. 3, an N-type well area 422 and a P-type well area 423 are partially provided on the surface of the silicon substrate 301 which is P-conductor. And, P-Mos 420 is provided on the N-type well area 422 and N-Mos 421 is provided on the P-type well area 423 by impurity introduction and diffusion Such as ion platation by using a general Mos process. The P-Mos 420 is constituted by a source area 425 and a drain area 426 obtained by partial introduction of N-type or P-type impurity onto the surface of the N-type well area 422, and a gate wiring 435 deposited via a gate insulation film 428 having a thickness of several hundreds Å on the surface of a portion of the N-type well area 422 except for the source area 425 and a drain area 426. Further, the N-Mos 421 is constituted by a source area 425 and a drain area 426 obtained by partial introduction of N-type or P-type impurity onto the surface of the P-type well area 423, and a gate wiring 435 deposited via a gate insulation film 428 having a thickness of several hundreds Å on the surface of a portion of the P-type well area 423 except for the source area 425 and drain area 426. The gate wiring 435 is formed from polysilicon having a thickness of 4000 to 5000 Å deposited by the CVD method. C-Mos logic is constituted by the P-Mos 420 and the N-Mos 421.

A portion of the P-type well area 423 different from the N-Mos 421 is provided with N-Mos transistor 430 for driving the electrical/thermal converting elements. Also the N-Mos transistor 430 is constituted by a source area 432 and a drain area 431 partially formed on the surface of the P-type well area 423 by impurity introduction and diffusion, and a gate wiring 433 deposited via a gate insulation film 428 on the surface of a portion of the P-type well area 423 except for the source area 425 and drain area 426.

In the illustrated embodiment, while an example that the N-Mos transistors are used as the transistors for driving the electrical/thermal converting elements was explained, the transistors are not limited to the N-Mos transistors so long as any transistors have ability for driving the electrical/thermal converting elements independently and can provide the above-mentioned minute arrangement.

Between the P-Mos 420 and the N-Mos 421 and between the N-Mos 421 and the N-Mos transistor 430, there are provided oxide film separation areas 424 having a thickness of 5000 to 10000 Å and formed by field oxidation, and the respective elements are separated by the oxide film separation areas 424. A portion of each oxide film separation area 424 corresponding to the heat acting portion 308 acts as a first layer regeneration (heat storage) layer 434 when looked at from the silicon substrate 301 side.

A layer-to-layer insulation film 436 comprised of PSG film or BPSG film and having a thickness of about 7000 Å is formed on the surfaces of the elements such as the P-Mos 420, N-Mos 421 and N-Mos transistor 430 by the CVD method. After the layer-to-layer insulation film 436 is flattened by heat treatment, wiring is effected by an Al electrode (first wiring layer) 437 via a contact hole passing through the layer-to-layer insulation film 436 and the gate insulation film 428. A layer-to-layer insulation film 438 comprised of $SiO_2$ film and having a thickness of 10000 to 15000 Å is formed on the surfaces of the layer-to-layer insulation film 436 and the Al electrode 437 by the plasma CVD method. A resistive layer 304 comprised of TaN (0.8 hex) film and having a thickness of about 1000 Å is formed on portions of the surface of the layer-to-layer insulation film 438 corresponding to the heat acting portions 308 and the N-Mos transistors 430 by a DC spattering method. The resistive layer 304 is electrically connected to the Al electrode 437 in the vicinity of the drain area 431 via a through hole formed in the layer-to-layer insulation film 438. An Al wiring (second wiring layer) 305 to the electrical/thermal converting elements is formed on the resistive layer 304.

The projection layer 306 on the surfaces of the wiring 305, resistive layer 304 and layer-to-layer insulation film 438 is constituted by $Si_3N_4$ film having a thickness of 10000 Å and formed by the plasma CVD method, the anti-cavitation film 307 formed on the surface of the projection layer 306 is constituted by Ta film having a thickness of about 2500 Å.

Next, the sharing of the circuits and elements into the element substrate 1 and the top plate 3 will be explained.

Figure 4A:
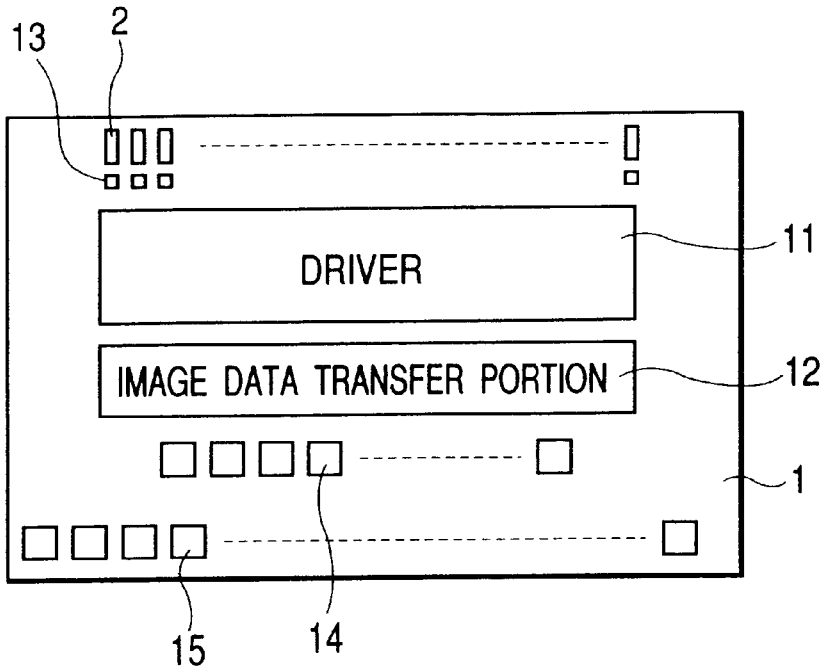
FIG. 4A is a plan view of the element substrate and FIG. 4B is a plan view of a top plate, for explaining a circuit arrangement of the liquid discharge head shown in FIG. 1.
Figure 4B:
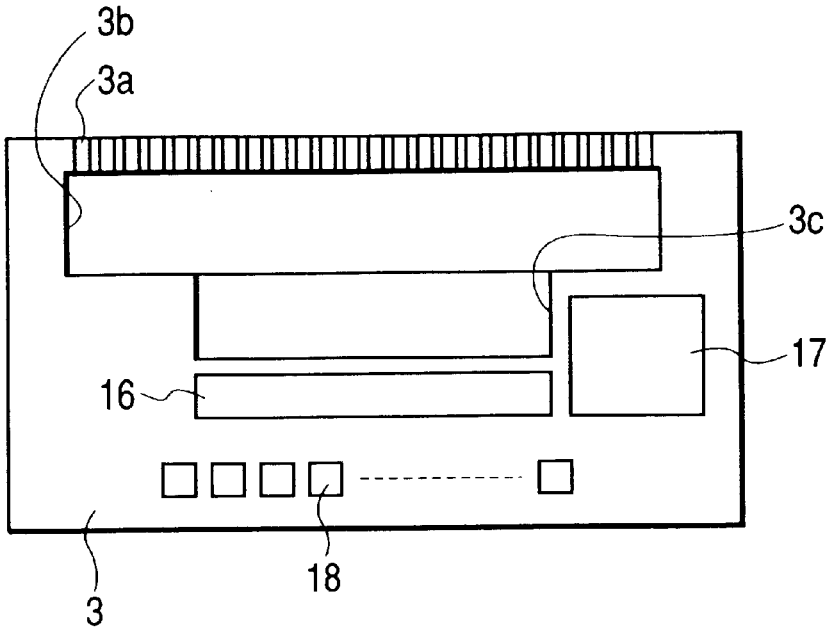

FIGS. 4A and 4B are views for explaining a circuit arrangement of the liquid discharge head shown in FIG. 1, where FIG. 4A is a plan view of the element substrate and FIG. 4B is a plan view of the top plate. Incidentally, FIGS. 4A and 4B illustrate opposite surfaces.

As shown in FIG. 4A, the element substrate 1 includes the plurality of heat generating bodies 2 arranged in parallel, a driver 11 for driving the heat generating bodies 2 in accordance with image data, an image data transfer portion 12 for outputting the inputted image data to the driver 11, and sensors 13 for detecting condition or property of the liquid required for controlling the driving conditions of the heat generating bodies 2. In the illustrated embodiment, the sensors 13 are provided in association with the respective liquid flow paths 7 corresponding to the heat generating bodies 2 in order to detect the conditions or properties of the liquids in the liquid flow paths 7.

The image data transfer portion 12 includes a shift register for outputting the image data inputted in serial to the drivers 11 in parallel, and a latch circuit for temporarily storing the data outputted from the shift register. Incidentally, the image data transfer portion 12 may be designed to output the image data in correspondence to the respective heat generating bodies 2 or may be designed to output the image data to each block when the heat generating bodies 2 are divided into a plurality of blocks. Particularly, by providing a plurality of shift registers in a single head so that data transferred from a recording apparatus is shared into the plurality of shift registers, a printing speed can easily be increased.

As each sensor 13, a sensor which can detect change in temperature of the liquid, pressure of the liquid, components included in the liquid or hydrogen ion concentration index (pH) in the liquid as the condition or property of the liquid may be used, which will be fully described later.

On the other hand, as shown in FIG. 4B, in the top plate 3, in addition to the fact that grooves 3*a,* 3*b* defining the liquid flow paths and the common liquid chamber are formed as mentioned above, there are provided a sensor driving portion 17 for driving the sensors 13 provided on the element substrate 1, and a heat generating body control portion 16 for controlling the driving conditions of the heat generating bodies 2 on the basis of the detection results from the sensors driven by the sensor driving portion 17. Incidentally, the top plate 3 is provided with a supply port 3*c* through which liquid is supplied to the common liquid chamber from an external source.

Further, connection contact pads 14, 18 for electrically connecting circuits formed in the element substrate 1 to circuits formed in the top plate 3 are formed on corresponding portions of the interface between the element substrate 1 and the top plate 3. Further, the element substrate 1 is provided with external contact pads 15 as input terminals for external electric signal. The dimension of the element substrate 1 is greater than that of the top plate 3, and the external contact pads 15 are exposed from the top plate 3 when the element substrate 1 is joined to the top plate 3.

When the element substrate 1 and the top plate 3 constructed as mentioned above are aligned and joined, the heat generating bodies 2 are positioned in correspondence to the respective liquid flow paths and the circuits formed on the element substrate and the top plate 3 are electrically interconnected via the connection pads 14, 18. Although such electrical connection can be realized by providing gold bumps on the connection pads 14, 18, any other method can be used. In this way, by electrically connecting the element substrate 1 to the top plate 3 via the connection contact pads 14, 18, at the same time when the element substrate 1 is joined to the top plate 3, the above-mentioned circuits can be interconnected electrically. After the element substrate 1 is joined to the top plate 3, the orifice plate 4 is joined to the front ends of the liquid flow paths 7, thereby completing the liquid discharge head.

Figure 5:
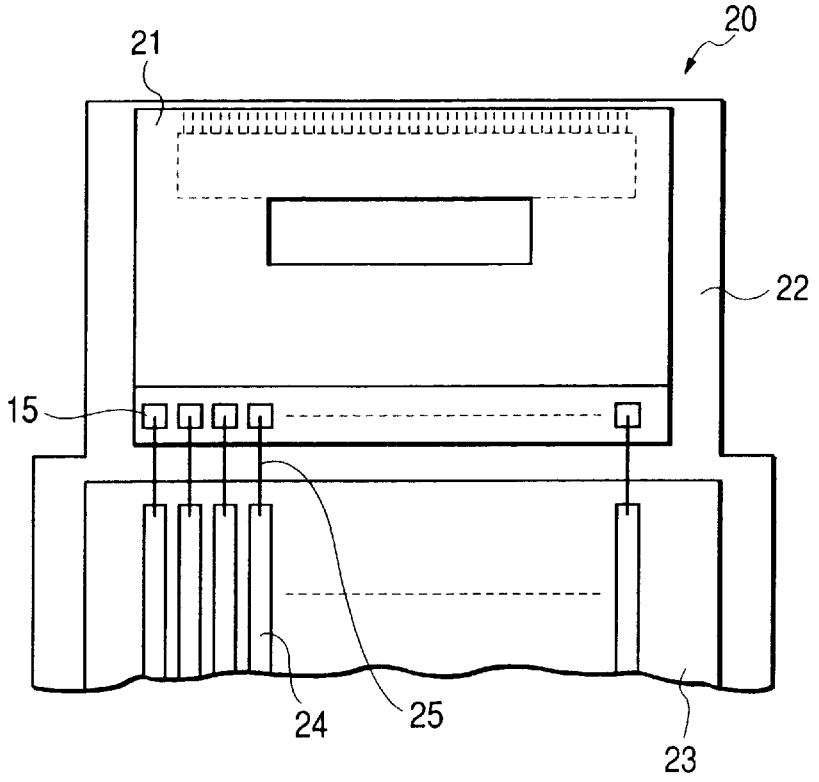
FIG. 5 is a plan view of a liquid discharge head unit on which the liquid discharge head shown in FIG. 1 is mounted.

When the liquid discharge head obtained in this way is mounted on a head cartridge or a liquid discharge apparatus, as shown in FIG. 5, print wiring substrate 23 is secured to base substrate 22 mounted, thereby obtaining a liquid discharge head unit 20. In FIG. 5, the print wiring substrate 23 is provided with a plurality of wiring patterns 24 electrically connected to a head control portion of the liquid discharge apparatus, and these wiring patterns 24 are electrically connected to external contact pads 15 via bonding wires 25. Since the external contact pads 15 are provided on only the element substrate 1, electrical connection between the liquid discharge head 21 and the external element ca be effected in a same manner as that of the conventional liquid discharge head. Here, while an example that the external contact pads 15 are provided on only the element substrate 1 was explained, the external contact pads may be provided on only the top plate 3, rather than the element substrate 1.

As mentioned above, by sharing various circuits for the driving and the controlling of the heat generating bodies 2 into the element substrate 1 and the top plate 3 in consideration of the condition of the interface between them, since these circuits are not concentrated on the single substrate, the liquid discharge head can be made more compact. Further, since the electrical connection between the circuits of the element substrate 1 and the circuits of the top plate 3 is effected via the connection contact pads 14, 18, the number of electrical connection portions for the external elements from the head is decreased, thereby improving reliability, reducing the number of parts and making the head more compact.

Further, by sharing the circuits into the element substrate 1 and the top plate 3, yield of the element substrate 1 can be improved, with the result that the manufacturing cost of the liquid discharge head can be reduced. In addition, since the element substrate 1 and the top plate 3 are formed from the material based on the same material such as silicon material, coefficient of thermal expansion of the element substrate 1 becomes the same as that of the top plate 3. As a result, even when the element substrate 1 and the top plate 3 are thermally expanded due to the driving of the heat generating bodies 2, there is no deviation between them, thereby maintaining good positional accuracy between the heat generating bodies 2 and the liquid flow paths 7.

Now, information regarding the sensor 13 and application examples of the present invention will be fully described.

(1) Type of Sensor

Although briefly shown in FIG. 1, the sensor 13 is located at a position produced from the surface of the element substrate 1. Typical types of the sensor used in the present invention are of unitary detecting portion type and of reference electrode pair type. The unitary detecting portion type includes a detecting portion having electrical resistance or voltage changed in accordance with the condition or behavior of the liquid to be detected. As the sensor of unitary detecting portion type, there are a temperature sensor and a pressure sensor. The reference electrode pair type includes an electrode as a reference not sensitive to the condition of the liquid to be detected, in addition to the above-mentioned detecting portion. As the sensor of reference electrode pair type, there are a sensor for detecting pH in ink and a sensor for detecting ink components.

(1a) Sensor of unitary detecting portion type

Figure 6A:
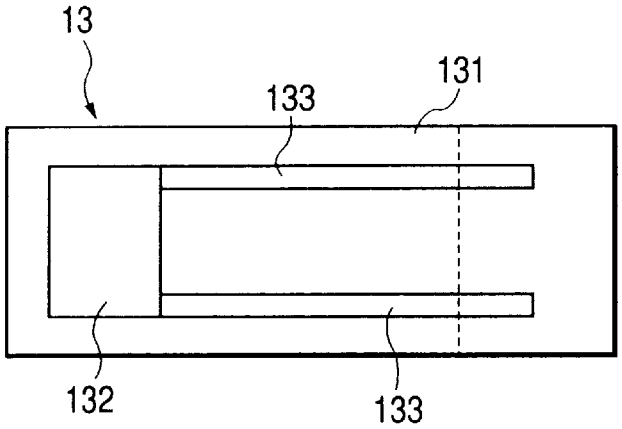
FIGS. 6A and 6B are schematic enlarged views showing an example of a sensor of unitary detecting portion type applicable to the present invention.
Figure 6B:
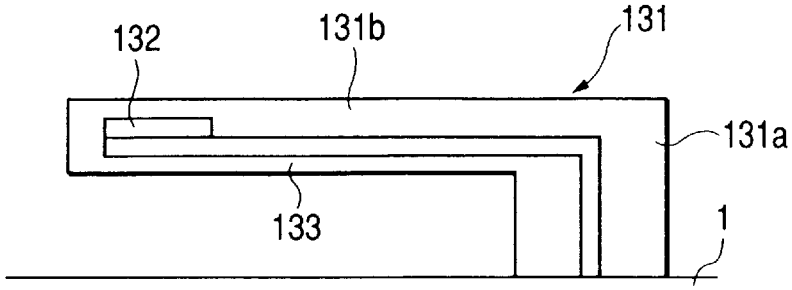

FIGS. 6A and 6B are schematic enlarged views showing an example of the sensor of unitary detecting portion type applicable t the present invention.

As shown in FIGS. 6A and 6B, the sensor 13 has a solid structure portion 131 protruded from the element substrate 1 into the liquid flow path 7, a detecting portion 132 provided on the solid structure portion 131, and wirings 133 for connecting the detecting portion 132 to wirings (not shown) of the element substrate 1. After the circuits are formed on the element substrate 1 as mentioned above, the solid structure portion 131, detecting portion 132 and wirings 133 are formed on the element substrate 1 by a semiconductor manufacturing process lithography technique.

The solid structure portion 131 is constituted by a post 131*a* protruded from the element substrate 1, and a beam 131*b* supported on an upper end of the post in a cantilever fashion to extend along the upper surface of the element substrate 1. The detecting portion 132 is formed from material having electrical property or condition changed in accordance with the condition of the liquid to be detected and is disposed in the beam 131*b* of the solid structure portion 131. With this arrangement, the position of the detecting portion 132 is spaced apart from the surface of the element substrate 1. Further, a portion in which the detecting portion 132 is provided is almost surrounded by the liquid so that the detecting portion is contacted with the liquid from plural directions (not from one direction), and, thus, is contacted with the liquid with greater area than that in a case where the detecting portion is directly provided on the element substrate 1.

Next, an example of a method for forming the sensor on the element substrate 1 will be explained with reference to FIGS. 7A to 7E, in connection with an example that a temperature sensor using a temperature measuring resistance body having an electrical resistance value changed in accordance with the temperature is formed.

Figure 7A:
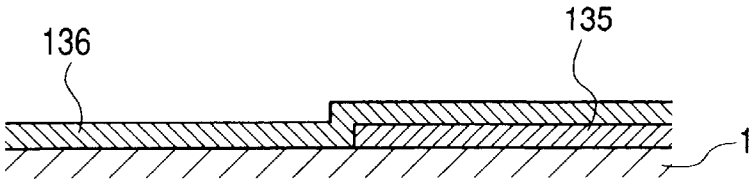
FIGS. 7A, 7B, 7C, 7D and 7E are views for explaining a manufacturing process for manufacturing the sensor shown in FIGS. 6A and 6B.

First of all, as shown in FIG. 7A, after an Al film having a thickness of about 1 $\mu$m is formed, by a spattering method, on the element substrate 1 on which function elements and circuits were formed, predetermined configuration patterning is effected by the photo-lithography method and dry etching, thereby forming an electrode 135. Further, a SiN film having a thickness of about 1 $\mu$m as an electrode protection layer 136 is formed, by CVD method, on the element substrate 1 on which the electrode 135 was formed. Incidentally, although only one electrode 135 is shown in the drawings, two electrodes 135 are formed for each sensor in parallel along a left-and-right direction. Further, although not shown, it is desirable that a Ta film as an anti-cavitation film be formed on the electrode protection layer 136.

Figure 7B:
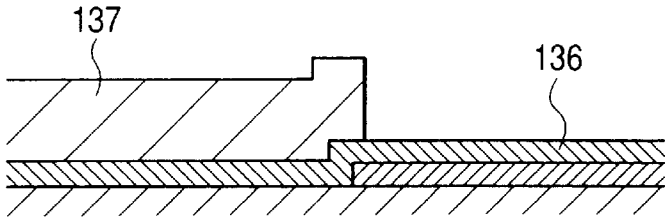

Thus, in order to form a gap between the element substrate 1 and the beam 131*b* shown in FIGS. 6A and 6B, as shown in FIG. 7B, an Al film having several $\mu$m or several tens of $\mu$m is formed by the spattering method, predetermined configuration patterning is effected by the photo-lithography method and dry etching, thereby forming a gap forming member 137 as a sacrifice layer.

As will be described later, the gap forming member 137 acts as an etching stop layer when the solid structure portion 131 is formed by the dry etching. Since the Ta film as the anti-cavitation film and the electrode protection layer 136 in the element substrate 1 may be etched by etching gas used for forming the liquid flow paths 7, the gap forming member 137 is formed on the element substrate 1 in order to prevent the etching of the layer and the film. In this way, the damage of the function elements of the element substrate 1 due to the dry etching (described later) can be prevented.

Figure 7C:
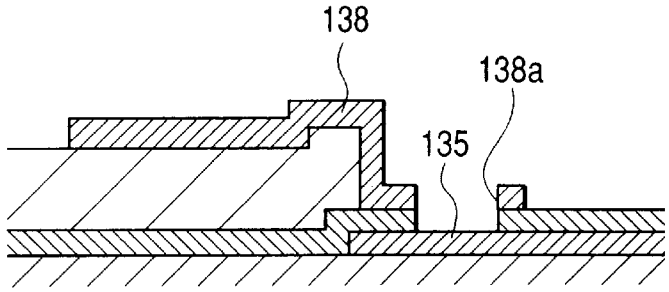

As shown in FIG. 7C, an SiN film 138 as a substrate layer of the solid structure portion 131 (FIG. 6A) is formed to cover the electrode protection layer 136 and the gap forming member 137, and this film is patterned in a planar configuration of the solid structure portion 131 at a position straddling between a portion where the gap forming member 137 is formed and a portion where the gap forming member 137 is not formed. Further, at a position of the SiN film 138 corresponding to the post 131*a* (FIG. 6A) of the solid structure portion 131, a through hole 138*a* corresponding to the electrode 135 is formed, thereby exposing the electrode 135.

Figure 7D:
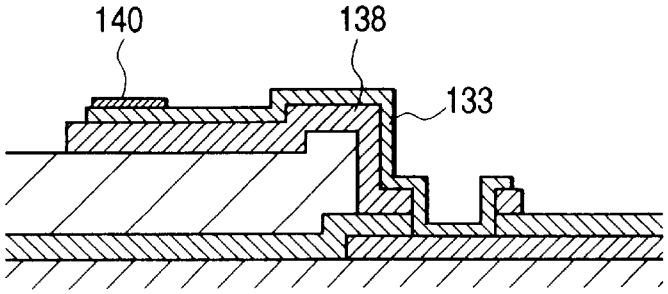

Then, as shown in FIG. 7D, the wirings 133 made of Al (aluminum) are patterned and formed on the SiN film 138 by the spattering method, photo-lithography method and dry etching. Two wirings 133 are formed in correspondence to the electrodes 135 provided on the element substrate 1 in parallel along the left-and-right direction and are connected to the respective electrodes 135 though the through holes 138*a*. A temperature measuring resisting body 140 is patterned and formed to straddle two wirings 133. The temperature measuring resisting body 140 acts as the detecting portion 132 shown in FIGS. 6A and 6B.

Figure 7E:
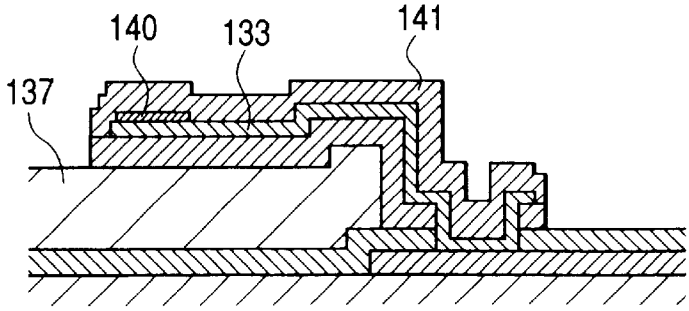

Then, as shown in FIG. 7E, an SiN film 141 as a protection layer for protecting the wirings 133 is formed to cover the entire structure, and this film is patterned in a planar configuration of the solid structure portion 131. Lastly, the gap forming member 137 is removed by wet etching.

In this way, the sensor 13 in which the detecting portion 132 comprised of the wirings 133 and the temperature measuring resisting body 140 is provided on the solid structure portion 131 comprised of the SiN films 138, 141 can easily be formed on the element substrate 1.

A height from the surface of the element substrate 1 to the detecting portion 132 is determined by a distance from the element substrate 1 to the beam 131*b*, i.e., a thickness of the gap forming member 137. For example, when the liquid discharge head is used as an ink jet recording head, so long as the distance of the beam 131*b* from the surface of the element substrate 1 is within a range from several $\mu$m to several tens of $\mu$m, liquid having a fresh condition (described later) can be detected. Incidentally, the position of the beam 131*b* can be appropriately set by changing the thickness of the gap forming member 137.

As mentioned above, in the liquid discharge head according to the illustrated embodiment, the circuits and the function elements for driving the heat generating bodies 2 and for controlling the driving of the heat generating bodies are shared into the element substrate 1 and the top plate 3 in accordance with their functions. When it is desired to check the condition of the liquid in the liquid flow path 7 by the sensor 13, the condition of the liquid is influenced by the heat generated from the circuits provided on the element substrate 1 and the top plate 3. Particularly, since the heat generating bodies 2 are provided on the element substrate 1, if the sensor 13 is provided on the element substrate 1, the influence upon the condition of the ink becomes great. Further, in the vicinity of the surface of the element substrate 1 and the surface of the top plate 3, due to viscosity of the liquid, the flow of the liquid will be slowed in comparison with other areas.

In consideration of this, by providing the sensor 13 on the solid structure portion 131 and by detecting the condition of the liquid at a position spaced apart from the element substrate 1 and in a condition that the sensor is almost surrounded by the liquid, the sensor is hard to be influenced by the heat of the element substrate 1 and the top plate 3, and the liquid can be detected in the fresh condition (not in a dwelled condition). Thus, in comparison with a case where the condition of the liquid is detected on the surface of the element substrate 1, the condition of the liquid can be detected more accurately. Further, in the illustrated embodiment, since the solid structure portion 131 is constituted by the post 131*a* and the beam 131*b* and the area contacted with the element substrate 1 is small, the influence of noise generated on the element substrate 1 can be reduced.

(1b) Sensor of Reference Electrode Pair Type

In a case where pH of the liquid is detected by utilizing the fact that voltage in the interface to the liquid is changed in response to ions or molecules in the liquid, it is required to use an electrode voltage of which is not sensitive to the ions or molecules in the liquid. In such a case, the sensor of reference electrode pair type is used.

Figure 8A:
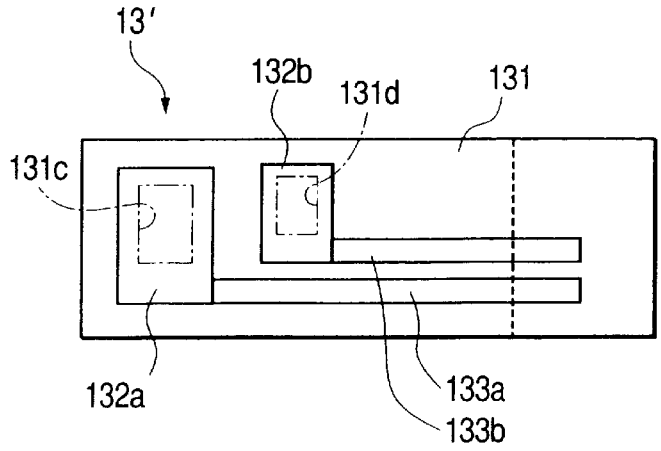
FIGS. 8A and 8B are schematic enlarged views showing an example of a sensor of reference electrode pair type applicable to the present invention.
Figure 8B:
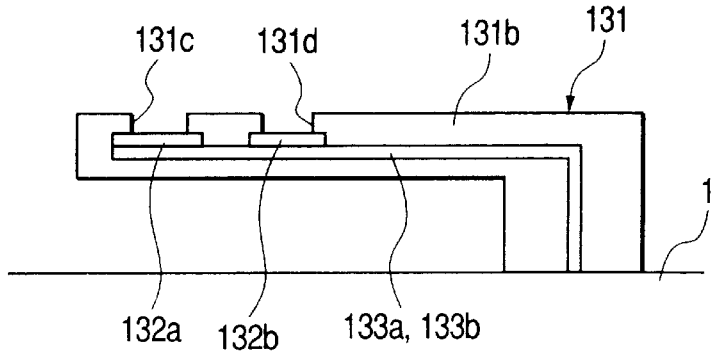

FIGS. 8A and 8B are schematic enlarged views showing an example of a sensor of reference electrode pair type. Incidentally, in FIGS. 8A and 8B, the same elements as those in FIGS. 6A and 6B are designed by the same reference numerals.

As shown in FIGS. 8A and 8B, the sensor 13' has a detecting portion 132*a* comprised of a member for generating voltage corresponding to a component (to be detected) in the liquid contacting with the member and for detecting the component, and a reference portion 132*b* comprised of a member voltage of which is not changed by the component (to be detected) in the liquid contacting with the member or which generates voltage different from that in the detecting portion 132*a*. The detecting portion 132*a* and the reference portion 132*b* are disposed on the beam 131*b* of the solid structure portion 131 protruded from the surface of the element substrate 1 and are connected to wirings (not shown) of the element substrate 1 via wirings 133*a*, 133*b*, respectively. Further, the beam 131*b* is provided with openings 131*c*, 131*d* at positions corresponding to the detecting portion 132*a* and the reference portion 132*b* so that the upper surfaces of the detecting portion 132*a* and the reference portion 132*b* are partially exposed.

Similar to the sensor 13 of unitary detecting portion type, the sensor 13' can be manufactured by using the semiconductor manufacturing process. In this case, for example, when the sensor 13' is formed in the steps as shown in FIGS. 7A to 7E, the openings 131*c*, 131*d* associated with the upper surfaces of the detecting portion 132*a* and the reference portion 132*b* can be formed by partially removing the SiN film 141 to obtain the predetermined configuration by the photo-lithography method and etching, after the step shown in FIG. 7E.

As will be fully described later, by providing the detecting portion 132*a* and the reference portion 132*b*, pH of the liquid can be detected by detecting potential difference between the detecting portion 132*a* and the reference portion 132*b* via the liquid.

Also in the sensor of reference electrode pair type shown in FIG. 8, similar to the sensor of unitary detecting portion type, since the detecting portion 132*a* and the reference portion 132*b* are provided on the cubic structure portion 131, the component in the liquid can be detected more accurately than that in the case where the component is detected on the surface of the element substrate 1, and the influence of noise generated on the element substrate 1 can be reduced.

While the two types of the sensor applicable to the present invention were explained, the configuration of the solid structure portion 131 is not limited to those shown in FIGS. 6A, 6B, 8A and 8B so long as the detecting portion is spaced apart from the surface of the element substrate 1 and the plural surfaces (not single surface) are surrounded by the liquid, but may be a cubic configuration, for example.

Figure 9:
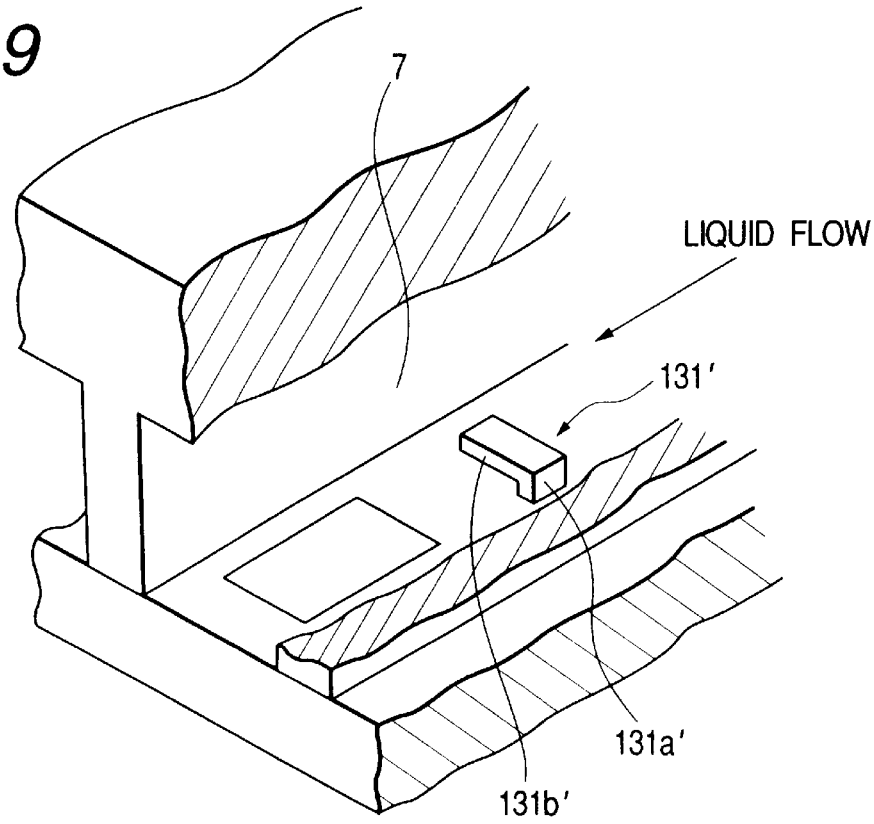
FIG. 9 is a perspective view for explaining another example of a cubic arrangement in the liquid flow path.

Particularly, although the configurations shown in FIGS. 6A and 6B and 9 are preferably in the point that the upper and lower surfaces of the beam 131*b* are contained with the liquid to increase the contact area between the beam and the liquid, even when such configuration having the beam 131*b* is adopted, the orientation of the beam 131*b* in the liquid flow path 7 is not limited to that shown in FIG. 1. For example, in the arrangement shown in FIG. 1, while the free end of the beam 131*b* was located at a downstream side with respect to the liquid flowing direction, an arrangement as shown in FIG. 9 may be adopted.

In an example shown in FIG. 9, although a configuration of a solid structure portion 131' is the same as that shown in FIGS. 6A and 6B, a post 131*a*' is offset from a center of the liquid flow path 7 along a width-wise direction, and a beam 131*b*' extends from the post 131*a*' in the width-wise direction of the liquid flow path 7. Incidentally, although not shown in FIG. 9, the detecting portion 132 shown in FIGS. 6A and 6B or the detecting portion 132*a* and the reference portion 132*b* shown in FIGS. 8A and 8B are formed on the beam 131*b*'. By arranging the solid structure portion 131' in this way, even when the sensor has a solid structure, the flow of the liquid in the liquid flow path 7 is not obstructed by the sensor. The solid structure portion 131' shown in FIG. 9 can also be formed to have the same dimension as that shown in FIGS. 7A to 7E by changing the patterning configurations of the gap forming member and SiN film.

Further, in the above-mentioned examples, while the sensor was provided on the element substrate 1, the sensor may be provided on the top plate. So long as the top plate 3 is formed from semiconductor substrate, even when the sensor is provided on the top plate 3, the sensor can be formed by using the semiconductor wafer process.

(2) Kind of Sensor

In the present invention, the sensor for detecting the condition of the liquid is used. Typical kinds of the sensor used in the present invention will now be described with reference to FIG. 1 and the like.

(2a) When Change in Temperature of Liquid is Detected

One of conditions of the liquid affecting an influence upon the discharge property is viscosity of the liquid. The viscosity of the liquid varied with kind of liquid to be discharged and is also changed by evaporation of water in a time-lapse manner. Accordingly, in the discharge of small amount of liquid, the viscosity of the liquid affects a great influence upon the discharge. Thus, in order to achieve stable discharge, it is required the driving condition of the liquid discharge head be controlled in accordance with the kind of the liquid and time-lapse change.

One of factors for guessing the viscosity of the liquid is temperature. When the discharge control is effected by utilizing the temperature of the liquid, it is desirable that the influence of the heat generating portion be minimized. As mentioned above, the element substrate 1 and the top plate 3 includes various function elements, and these function elements consume electric power more or less not only when the heat generating bodies 2 are driven but also when the heat generating bodies are not driven, thereby generating heat. Thus, the temperature of the liquid at the interfaces to the element substrate 1 and the top plate 3 is increased more than that of the other liquid to be discharged. Accordingly, in order to know the viscosity of the liquid to be discharged, it is desirable that the temperature of the liquid be detected at a position spaced apart from the element substrate 1 and the top plate 3.

To this end, by using the temperature sensor in which the detecting portion 132 is provided on the solid structure portion 131 as shown in FIG. 6, the temperature of the liquid to be discharged can be detected more accurately. The temperature sensor is not particularly limited so long as the detecting portion 132 can be provided on the solid structure portion 131. Thus, the sensor using the temperature measuring resisting body as mentioned above, a sensor using polycrystal silicon (resistance value is varied with temperature by controlling an amount of impurity of polycrystal silicon) or a thermistor can be used. Among them, it is desirable to use a sensor in which the sensor can be formed on the element substrate 1 together with the wirings 133 by using the semiconductor manufacturing process technique. Further, the wirings 133 connected to the detecting portion 132 may be formed from material (for example, aluminum) which has low electrical resistance and which does not affect an influence upon the temperature property of the detecting portion 132.

By the way, if there is great temperature gradient in the interface between the liquid and the substrate, the heat at the interface between the liquid and the substrate can be removed by the flow of the liquid.. Thus, a technique in which a heater is provided in the vicinity of the temperature sensor, the liquid is locally heated by driving the heater to create temperature difference, and a flow rate of the liquid is detected by utilizing the fact that the removed heat amount varied with the flow of the liquid can be used.

Even when a flow rate sensor is constituted in this way, in the arrangement in which the temperature sensor and the heater are arranged on the surface of the substrate, even if the liquid is locally heater, since the heat is escaped to the substrate and the flow of the liquid becomes small in the vicinity of the surface of the substrate due to the viscosity of the liquid, the flow rate cannot be detected with high accuracy in the minute flow path.

To avoid this, by providing the temperature sensor and the heater on the solid structure portion 131 protruded from the surface of the element substrate 1 as shown in FIG. 6 to greatly surround the sensor and the heater by the liquid, since the heat of the heater is hard to be escaped to the substrate and the flow itself of the liquid becomes great in comparison with that on the surface of the element substrate 1, the detecting accuracy for the difference in flow of liquid can be improved greatly.

(2b) When Pressure of Liquid is Detected

In the liquid discharge head in which the liquid is abruptly heated by driving the heat generating body 2 and thus a bubble is generated in the liquid by film boiling thereby to discharge the liquid, pressure caused by generation of the bubble acts on the liquid. Accordingly, a method in which the pressure (as one of the conditions of the liquid) acting on the liquid is detected and the driving condition of the liquid discharge head is controlled on the basis of a detection result is one of means for stabilizing the discharge property.

To this end, by introducing the element a resistance value of which is changed by the pressure of the liquid or which generates the voltage onto the detecting portion 132 shown in FIGS. 6A and 6B, a sensor for detecting the pressure acting on the liquid can be obtained. Further, since such element is disposed on the solid structure portion 131 and is greatly surrounded by the liquid, the pressure of the liquid acts on the element effectively in comparison with the case where the element is disposed on the surface of the element substrate 1, thereby detecting the pressure more accurately.

(2c) When Component in Liquid is Detected

In the liquid discharge head, the discharge property is varied with components included in the liquid to be discharged. Thus, by utilizing a membrane responsive to ions or molecules included in the liquid to generate potential difference in its equilibrium state as the detecting portion 132 of the solid structure portion 131 as shown in FIGS. 6A and 6B, the condition or the change in components included in the liquid can be detected. In this case, a part of the solid structure portion 131 covering the detecting portion 132 (membrane) shown in FIGS. 6A and 6B is removed to expose the detecting portion 132 so that the detecting portion 132 is exposed to the liquid.

Also when the components included in the liquid are detected in this way, since the flow of the liquid is bad to be hard to achieve the equilibrium state at the interface between the liquid and the substrate, by providing the solid structure portion 131 as shown in FIGS. 6A and 6B, almost all the part are surrounded by the liquid, and, since the detecting portion 132 is disposed in the flow of the liquid, the components in the liquid can stably be detected.

(2d) When pH in Liquid is Detected

One of membranes responsive to concentration of hydrogen ions in the liquid is a silicon oxide membrane. When the silicon oxide membrane is provided as the detecting portion 132*a* shown in FIGS. 8A and 8B, potential difference is created in accordance with the concentration of hydrogen ions in the liquid at the interface between the silicon oxide membrane and the liquid. By detecting such potential difference, pH in the liquid can be detected. However, since the silicon oxide membrane itself is an insulation member, in order to detect the potential difference, an electrode is provided and a reference electrode different from the aforementioned electrode is provided as the reference portion 132*b* shown in FIGS. 8A and 8B. And, the potential difference between the silicon oxide membrane (detecting portion 132*a*) and the reference electrode (reference portion 132*b*) via the liquid can be detected in low impedance state by using FET (voltage effect transistor).

In place of the silicon oxide membrane, when a membrane response to component different to the hydrogen ion concentration is used as the membrane constituting the detecting portion 132*a,* the condition of the desired component in the liquid can be detected.

In this way, by providing the detecting portion 132*a* and the reference portion 132*b* on the solid structure portion 131 protruded from the surface of the element substrate 1, since the component of the liquid detected in the fresh condition (not liquid dwelled condition), the detecting accuracy can be greatly improved in comparison with the case where the detecting portion and the reference portion are provided on the surface of the element substrate 1.

Regarding the reference electrode or reference portion 132*b,* so long as it has electrical property which is not changed with respect to the component of the liquid to be detected or which is changed differently from the detecting portion 132*a,* it is not necessary that the reference portion be provided on the same solid structure portion 131 as the detecting portion 132*a*. That is to say, a solid structure portion having the detecting portion 132*a* and a solid structure portion having the reference portion 132*b* may be provided independently. However, as shown in FIGS. 8A and 8B, when the detecting portion 132*a* and the reference portion 132*b* are provided on the same solid structure portion 131, since the local condition of ink can be detected accurately, such arrangement is more desirable.

Incidentally, in the above-mentioned sensors, the strain sensor and the pressure sensor are desirable to be provided on a movable member. Further, it is preferable that the viscosity sensor and the ion sensor be provided in the vicinity of the discharge port at a downstream side of the heat generating body. In this case, in order to prevent these sensors (disposed in the vicinity of the discharge port) from affecting a bad influence upon the liquid discharge, these sensor may not necessarily be provided on the solid structure portion but may be provided on the wall of the liquid flow path.

(3) Sharing Sensors and Circuits

Although the above-mentioned circuits are shared in accordance with their functions, the reference for the sharing will now be described.

The circuits corresponding to the heat generating bodies 2 and electrically connected thereto independently or in block are formed on the element substrate 1. In the example shown in FIGS. 4A and 4B, such circuits are the driver 11 and the image data transfer portion 12. Since the drive signals are supplied to the heat generating bodies 2 in parallel, wirings corresponding to the number of signals must be provided. Accordingly, if such circuits are formed on the top plate 3, the connection points between the element substrate 1 and the top plate 3 are increased, with the result that the danger of causing poor connection is increased. However, when such circuits are provided on the element substrate 1, the poor connection between the heat generating bodies 2 and the circuits can be prevented.

Since analogue circuits such as control circuits are sensitive to heat, such circuits are provided on the substrate on which the heat generating bodies 2 are not provided, i.e., provided on the top plate 3. In the example shown in FIGS. 4A and 4B, the heat generating body control portion 16 is one of such circuits.

The sensors 13 may be provided on the element substrate 1 or on the top plate 3 so long as the sensors are contacted with the liquid. However, when the sensors detect the condition of the liquid on the basis of the temperature of the liquid, it is preferable that such sensors be provided at positions not influenced by the heat as less as possible.

Lastly, circuits not corresponding to the heat generating bodies 2 and not electrically connected thereto independently or in block, circuits which are not necessarily be provided on the measuring accuracy even if they are provided on the top plate 3 are provided on the element substrate 1 or on the top plate 3 appropriately so that these circuits and sensors are not concentrated into one of the element substrate 1 or on the top plate 3. In the example shown in FIGS. 4A and 4B, one of such circuits or sensors is the sensor drive portion 17.

By providing the circuits and sensors on the element substrate 1 and the top plate 3 on the basis of the above consideration, the number of electrical connection points between the element substrate 1 and the top plate 3 can be reduced as less as possible, and the circuits and sensors can be shared in a good balanced condition.

(4) Control Example of the Liquid Discharge Head

The ink conditions detected by the sensors are utilized in the control for driving the heat generating bodies. As an example of the control for driving the heat generating body, control for driving the heat generating body effected by using the temperature sensor detecting the temperature of the liquid will be explained.

Figure 10A:
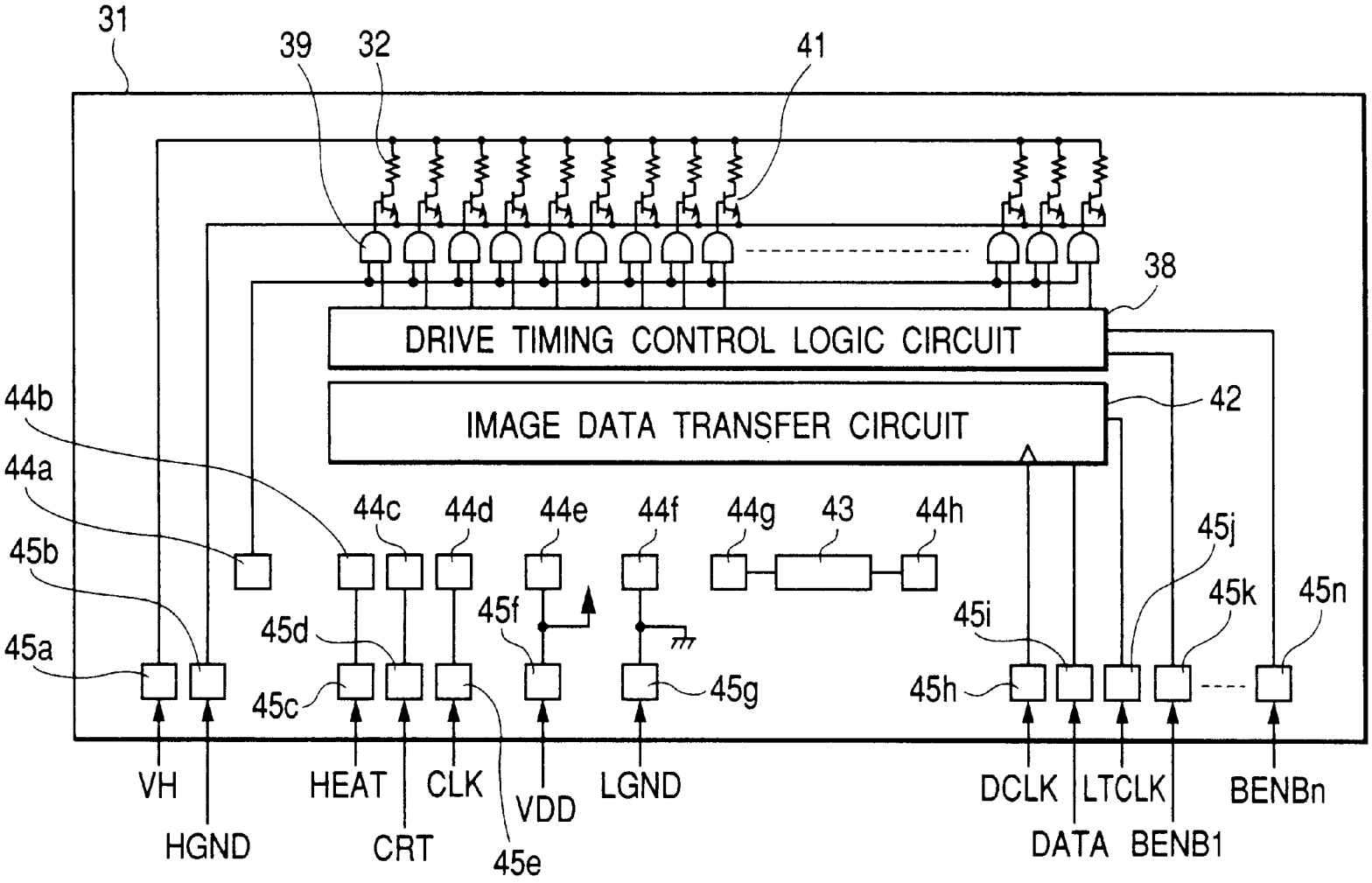
FIGS. 10A and 10B are views showing an element substrate and a top plate, respectively, in an example that a driving condition of heat generating elements are controlled in accordance with a temperature of the liquid.
Figure 10B:
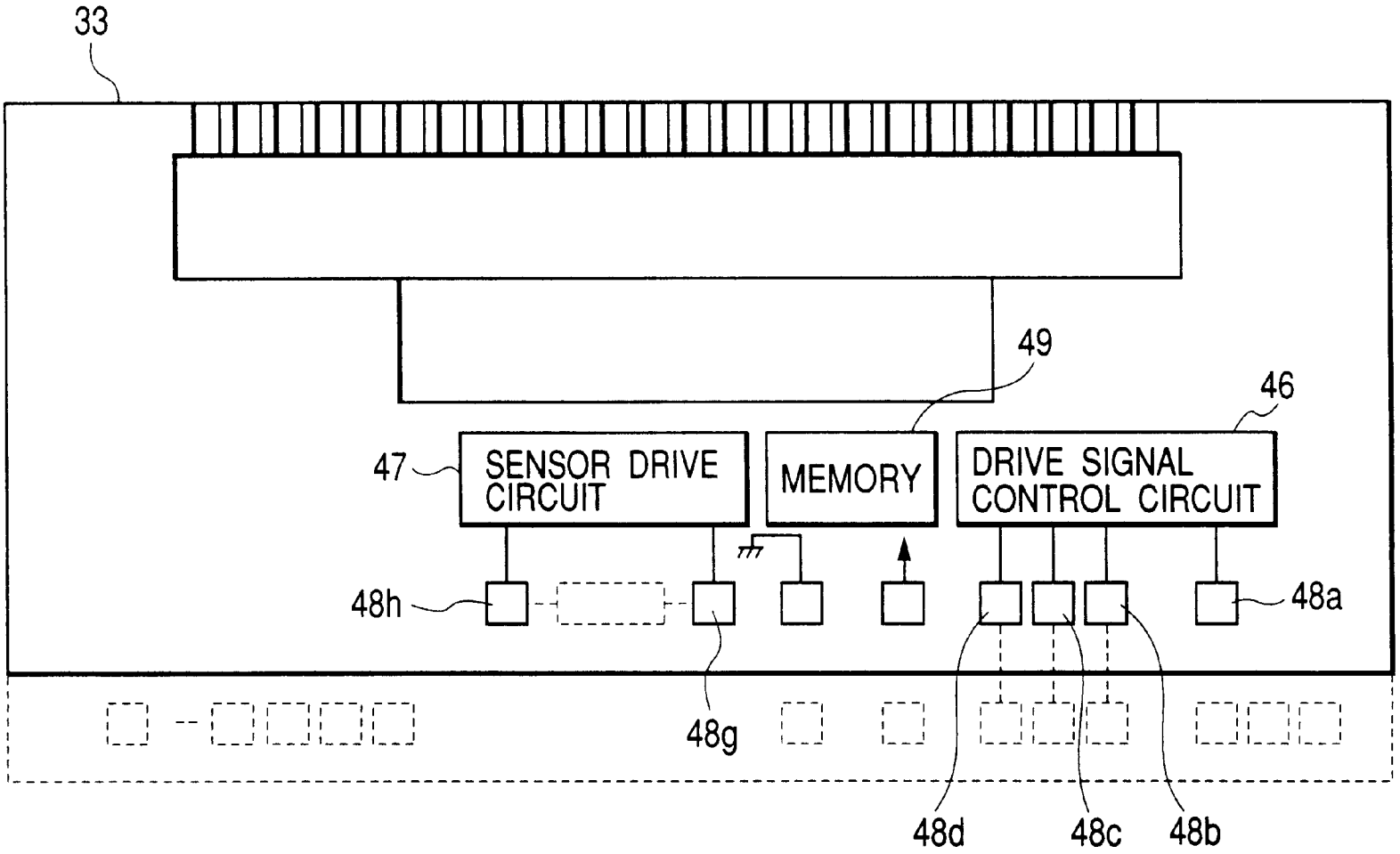

FIGS. 10A and 10B are views showing circuit arrangements of the element substrate and the top plate in an example that the driving conditions of the heat generating bodies are controlled in accordance with the temperatures of the liquids. In the example shown in FIGS. 10A and 10B, before bubble generating energy is applied to each of heat generating bodies 32, the heat generating body 32 is preheated (preliminary heating not generating a bubble in the liquid), and, a pre-heat pulse width for the heat generating body 32 is controlled on the basis of a detection result of a sensor (not shown in FIGS. 10A and 10B) for detecting the temperature of the liquid.

As shown in FIG. 10A, a plurality of heat generating bodies 32 arranged in a line, power transistors 41 acting as drivers, AND circuits 39 for controlling the driving of the power transistors 41, a drive timing control logic circuit 38 for controlling the drive timings of the power transistors 41, an image data transfer circuit 42 constituted by a shift register and a latch circuit, and sensors for detecting the temperature of the liquid are formed on an element substrate 31 by the semiconductor process. The sensors are provided in a solid structure for respective liquid flow paths, i.e., for the respective heat generating bodies 32.

The drive timing control logic circuit 38 serves to energize the heat generating bodies 32 in a time-lapse manner (not energize the heat generating bodies 32 simultaneously) for reducing power supply capacity of the apparatus, and enable signal for driving the drive timing control logic circuit 38 is inputted from enable signal input terminals 45*k* to 45*n* which are external contact pads.

Further, as external contact pads provided on the element substrate 31, there are provided an input terminal 45*a* for a drive power supply for the heat generating bodies 32, grounding terminal 45*b* for the power transistors 41, input terminals 45*c* to 45*e* for signals required for controlling energy driving the heat generating bodies 32, a drive power supply terminal 45*f* for the logic circuit, a grounding terminal 45*g*, an input terminal 45*i* for serial data inputted to the shift register of the image data transfer circuit 42, an input terminal 45*h* for a serial clock signal synchronous with this, and an input terminal 34*j* for a latch clock signal inputted to the latch circuit, as well as enable signal input terminals 45*k* to 45*n*.

On the other hand, as shown in FIG. 10B, on a top plate 33, there are formed a drive signal control circuit 46 for determining the driving timings of the heat generating bodies 32 and for monitoring output from a sensor 43 to determine the pre-heat widths of the heat generating bodies 32 on the basis of a result from the sensor, and a memory 49 for storing selection data for selecting the pre-heat width corresponding to each heat generating body as head information and for outputting such data to the drive signal control circuit 46.

Further, as connection contact pads, on the element substrate 31 and the top plate 33, there are provided terminals 44*b* to 44*d* and 48*b* to 48*d* for connecting the input terminals 45*c* to 45*e* for signals required to control the energy for driving the heat generating bodies 32 externally to the drive signal control circuit 46, and a terminal 48*a* for inputting output of the drive signal control circuit 46 to one of terminals of the AND circuits 39.

In an arrangement as mentioned above, first of all, the temperatures of the liquids in the respectively liquid flow paths are detected by the corresponding sensors, and results thereof are stored in the memory 49. In the drive signal control circuit 46, in accordance with the temperature data and the selection data stored in the memory 49, the pre-heat pulse widths for the respective heat generating bodies 32 are determined, and determined results are outputted to the AND circuits 39 through the terminals 48*a*, 44*a*. On the other hand, the image data inputted in serial is stored in the shift register of the image data transfer circuit 43 and is latched in the latch circuit by a latch signal and is outputted to the AND circuits 39 via the drive timing control circuit 38.

By outputting the image data signal to the AND circuits 39, the pre-heat pulses determined in the drive signal control circuit 46 and the predetermined heat pulses are given to the heat generating bodies 32. As a result, after the pre-heat, the energy for generating the bubble in the liquid is applied to the heat generating bodies 32. In this way, by controlling the pre-heat widths in accordance with the detection results of the sensors, regardless of the temperature condition, the discharge amounts at the discharge ports can be kept to constant.

Further, in the head data stored in the memory 49, kinds of liquid to be discharged (in case of ink, ink color or the like) may be included, as well as the aforementioned temperature data. The reason is that, depending upon the kind of the liquid, property of matter thereof and discharge property are differentiated. The storing of the heat information to the memory 49 may be effected in a non-volatile manner after the liquid discharge head is assembled or may be effected by transferring the information from the apparatus side after the liquid discharge apparatus to which the liquid discharge head is mounted is risen up.

Incidentally, in the liquid discharge head explained in connection with FIGS. 10A and 10B, as a resistance value sensor, there are further provided a rank heater 43 form on the element substrate 31 in the same manner as the heat generating bodies 32, and a sensor drive circuit 47 formed on the top plate 33 and adapted to drive the rank heater 43. Terminals 44*g*, 44*h* and 48*g*, 48*h* for connecting the sensor drive circuit 47 to the rank heater 43 are formed on the element substrate 31 and the top plate 33. This arrangement serves to determine the pulse width of the pulse applied to the heat generating body 32 on the basis of the resistance value detected by the rank heater 43, and the drive signal control circuit 46 monitors the output from the rank heater 43 and controls energy applied to the heat generating body 32 on the basis of a monitored result. Further, the memory 49 serves to store the resistance value data detected by the rank heater 43 or a code value ranked from the resistance value and predetermined liquid discharge amount properties (liquid discharge amounts when the predetermined pulse is applied under given temperature) for the respective heat generating bodies 32, as the head information and to output the information to the drive signal control circuit 46.

Now, the control of the energy applied to the heat generating body 32 by utilizing the rank heater 43 will be explained. First of all, the resistance value of the rank heater 43 is detected, and the result is stored in the memory 43. Since the rank heater 43 is formed in the same manner as the heat generating bodies 32, the resistance value thereof is substantially the same as that of the heat generating body 32 so that the resistance value of the rank heater 43 can be regarded s the resistance value of the heat generating body 32. In the drive signal control circuit 46, in accordance with the resistance value data and the liquid discharge amount property stored in the memory 49, rise-up data and rise-down data of the drive pulse for the heat generating body 32 are determined, and the determined results are outputted to the AND circuit 39 via the terminals 48*a*, 44*a*. As a result, the pulse width of the heat pulse is determined. When the image data is outputted from the image data transfer circuit 42 to the AND circuit 39 through the drive timing control circuit 38, the heat generating body 32 is energized with the pulse width determined by the drive signal control circuit 46, with the result that substantially constant energy is applied to the heat generating body 32.

(5) Other Examples of Liquid Discharge Head

In the example shown in FIG. 1, while an example that the grooves defining the liquid flow paths 7 are formed in the top plate 3 and the member (orifice plate 4) having the discharge ports 5 is constituted by a member different from the element substrate 1 and the top plate 3 was explained, the structure of the liquid discharge head to which the present invention is applied is not limited to such an example.

For example, a wall having a thickness corresponding to that of the orifice plate may be left at an end face of the top plate and discharge ports may be formed in the wall by ion beam working or electron beam working. In this way, a liquid discharge head can be manufactured without using any orifice plate. Further, in place of the fact that the groves are formed in the top plate, when the walls of the liquid flow paths are formed in the element substrate, positional accuracy of the liquid flow paths with respect to the heat generating bodies can be improved and the configuration of the top plate can be simplified. Although movable members can be formed in the top plate by using the photolithography process, when the walls of the liquid flow paths are formed in the element substrate in this way, at the same time when the movable members are firmed in the element substrate, the element substrate can be manufactured, which will be described later.

Further, the Inventors proposed a liquid discharge head having movable members (provided in liquid flow paths) for directing a bubble pressure transferring direction toward a downstream side. Next, an example that the present invention is applied to a liquid discharge head having movable members will be explained.

Figure 11:
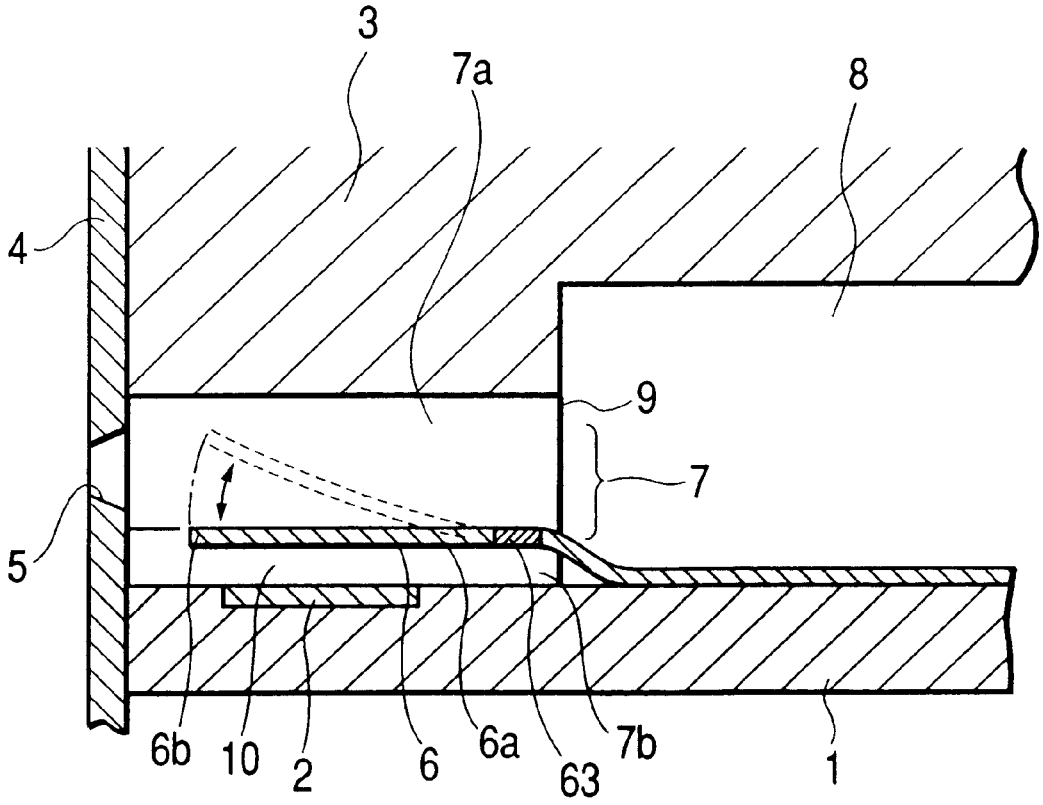
FIG. 11 is a sectional view of a liquid discharge head according to another embodiment of the present invention, along a liquid flow path direction thereof.

FIG. 11 is a sectional view of a liquid discharge head according to another embodiment of the present invention, taken along a direction of a liquid flow path thereof. In FIG. 11, the same elements as those in FIG. 1 are designated by the same reference numerals.

The liquid discharge head shown in FIG. 11 is similar to the liquid discharge head shown in FIG. 1, except that movable members 6 are formed in the element substrate 1 and a sensor 63 is formed in a part of each movable member 6.

Each movable member 6 is a cantilever-supported thin membrane formed by the semiconductor wafer process so that it is opposed to the corresponding heat generating body 2 and it divides the corresponding liquid flow path 7 into a first liquid flow path 7*a* communicated with the discharge port 5 and a second liquid flow path 7*b* including the heat generating body 2. The movable member 6 has a fulcrum 6*a* at an upstream side of great liquid flow (caused by the liquid discharge operation) flowing from the common liquid chamber 8 to the discharge port 5 through the movable member 6 and a free end 6*b* at a downstream side of the fulcrum 6*a* and is spaced apart from the heat generating body 2 by a predetermined distance to cover the opposed heat generating body 2. In the example shown in FIG. 11, a bubble generating area 10 is defined between the heat generating body 2 and the movable member 6.

In the arrangement as mentioned above, when the heat generating body 2 is heated, heat acts on the liquid in the bubble generating area 10 between the movable member 6 and the heat generating body 2, with the result that a bubble is created above the heat generating body 2 by a film boiling phenomenon and the bubble is grown. Pressure created by growth of the bubble preferentially acts on the movable member 6, with the result that the movable member 6 is displaced around the fulcrum 6*a* to greatly open toward discharge port 5, as shown by the broken line in FIG. 11. By the displacement of the movable member 6 or in the displacement condition of the movable member, the transfer of the pressure generated by occurrence of the bubble and the growth of the bubble itself are directed toward the discharge port 5, thereby discharging the liquid from the discharge port 5.

Namely, by providing the movable member 6 having the fulcrum 6*a* at the upstream side of the liquid flow (common liquid chamber 8 side) and the free end 6*b* at the downstream side (discharge port 5 side) above the bubble generating area 10, the pressure transferring direction of the bubble is directed toward the downstream side, with the result that the pressure of the bubble contributes the liquid discharge directly and efficiently. Similar to the pressure transferring direction, the growing direction itself of the bubble is also directed toward the downstream side, and, thus, the bubble is grown more greatly at the downstream side than the upstream side. In this way, by controlling the growing direction itself of the bubble and the pressure transferring direction of the bubble by means of the movable member, the fundamental discharge property such as discharge efficiency, discharge force or discharge speed can be improved.

On the other hand, when the bubble starts to be disappeared, by the aid of the elastic force of the movable member 6, the bubble is quickly disappeared, and the movable member 6 is ultimately returned to its original position shown by the solid line in FIG. 11. In this case, in order to compensate for contacting volume of the bubble in the bubble generating are 10 and to compensate for a volume corresponding to the discharged liquid, new liquid flows into the bubble generating area from the upstream side, i.e., from the common liquid chamber 8, thereby effecting re-fill of the liquid to the liquid flow path 7. The re-fill of the liquid is effected efficiently, reasonably and stably during the restoring action of the movable member 6.

The above-mentioned operation is the operation principle of the liquid discharge head having the movable members. In the example shown in FIG. 11, by utilizing the fact that the movable member 6 is the member formed on the surface of the element substrate 1, a sensor 63 is formed on a part of the movable member 6, particularly, on a portion spaced apart from the element substrate 1. That is to say, the movable member 6 itself is used as a solid structure portion, and the detecting portion 132 and wirings 133 shown in FIG. 6 or the detecting portion 132*a,* reference portion 132*b* and wirings 133*a,* 133*b* shown in FIGS. 7A to 7E are formed in the movable member 6.

By providing the sensor 63 on the part of the movable member 6 in this way, similar to the above, in a condition that stagnation of the flow of the liquid on the walls of the liquid flow path 7 and the influence of the heat of the element substrate 1 are small, the condition of the liquid can be detected. In addition, since the movable member 6 is provided, the fundamental liquid discharge property and re-fill efficiency can be improved.

The position of the detecting portion formed on the movable member 6 is not particularly limited so long as the detecting portion is spaced apart from the surface of the element sbstrate 1 and the desired condition of the liquid can be detected. However, since the movable member 6 is opposed to the heat generating body 2 to be apt to be influenced by the heat from the heat generating body 2, if the sensor 63 is a temperature sensor, it is preferable that the detecting portion be located at a position which is less influenced by the heat from the heat generating body 2, for example, at a position spaced apart from the heat generating body 2 as great as possible, and more preferably, at a position at the upstream side with respect to the liquid flowing direction. Further, if the sensor 63 is a pressure sensor, the movable member 6 directly receiving the pressure caused by the generation of the bubble is most preferable as the position where the pressure sensor is provided.

Now, an example of a method for forming the movable member 6 on the element substrate 1 will be described.

FIGS. 12A to 12E are sectional views for explaining an example of a method for forming the movable member 6 in the liquid discharge head shown in FIG. 11, taken along a direction of the liquid flow path 7. In the manufacturing method explained with reference to FIGS. 12A to 12E, by joining the element substrate 1 on which the movable members 6 are formed to the top plate in which the liquid flow path side walls are formed, the liquid discharge head shown in FIG. 11 is manufactured. Accordingly, in this manufacturing method, before the top plate is joined to the element substrate 1 having the movable members 6, the liquid flow path side walls are formed in the top plate.

Figure 12A:
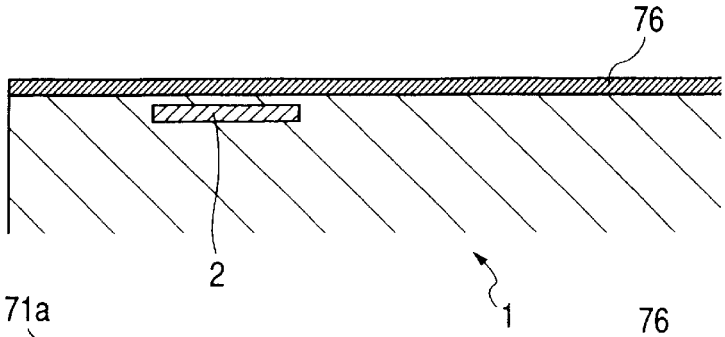
FIGS. 12A, 12B, 12C, 12D and 12E are views for explaining an example of a method for forming a movable member of the liquid discharge head shown in FIG. 11.

First of all, in FIG. 12A, a TiW film (first projection layer) 76 having a thickness of about 5000 Å for protecting the connection pad portions for effecting electrical connection to the heat generating bodies 2 is formed on the entire surface of the element substrate 1 near the heat generating bodies 2 by the spattering method. Incidentally, although not shown, prior to formation of the TiW film 76, wirings for connection to wirings of the sensor 63 (FIG. 11) and an SiN film as a protection layer therefore are formed on the element substrate 1.

Figure 12B:
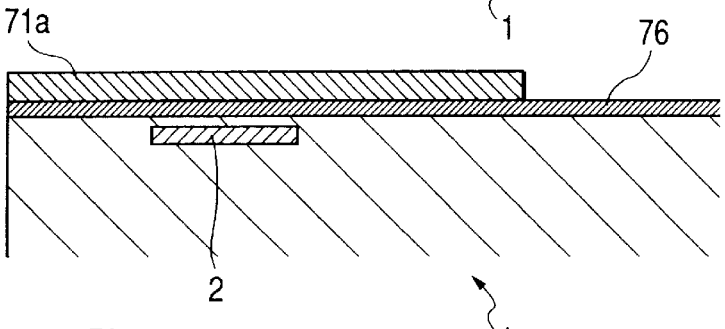

Then, in FIG. 12B, an Al film having a thickness of about 4 $\mu$m for forming a gap forming member 71*a* is formed on the surface of the TiW film 76 by the spattering method. The gap forming member 71*a* extends up to an area where an SiN film 72*a* is etched in a step shown in FIG. 12D which will be described later.

By patterning the formed Al film by using the known photo-lithography process, only a portion of the Al film corresponding to the support fixed portion of the movable member 6 is removed, thereby forming the gap forming member 71*a* on the surface of the TiW film 76. Accordingly, a portion of the TiW film 76 corresponding to the support fixed portion of the movable member 6 is exposed. The gap forming member 71*a* comprises Al film for forming the gap between the element substrate 1 and the movable member 6. The gap forming member 71*a* is formed on the whole area (except for the portion corresponding to the support fixed portion of the movable member 6) of the surface of the TiW film 76 including a position corresponding to the bubble generating area 10 between the heat generating body 2 and the movable member 6 shown in FIG. 11. Accordingly, in this manufacturing method, the gap forming member 71*a* is formed up to a portion of the surface of the TiW film 76 corresponding to the liquid flow path side walls. As will be described later, the gap forming member 71*a* acts as an etching stop layer when the movable member 6 is formed by the dry etching.

Figure 12C:
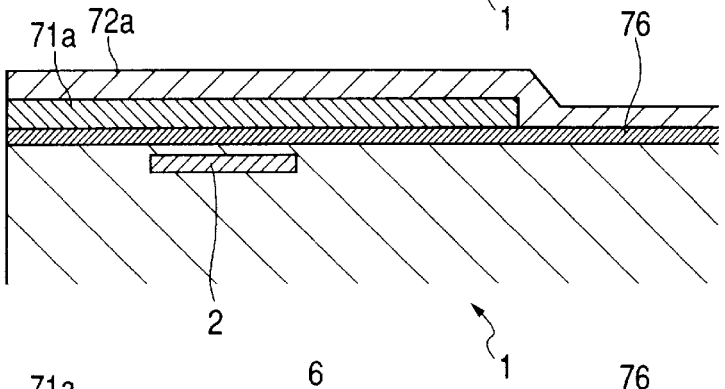

Then, in FIG. 12C, an SiN film 72*a* for constituting the movable member 6 is formed on the entire surface of the gap forming member 71*a* and the entire exposed surface of the TiW film 76 by using the plasma CVD method. When the SiN film 72*a* is formed by using the plasma CVD apparatus, as will be described hereinbelow with reference to FIG. 13, an anti-cavitation film (made of Ta) provided on the element substrate 1 is grounded through the silicon substrate constituting the element substrate 1. As a result, the function elements such as the heat generating bodies 2 and the latch circuit in the element substrate 1 can be protected from ions and radical charges decomposed by plasma discharge within a reaction chamber of the plasma CVD device.

Figure 13:
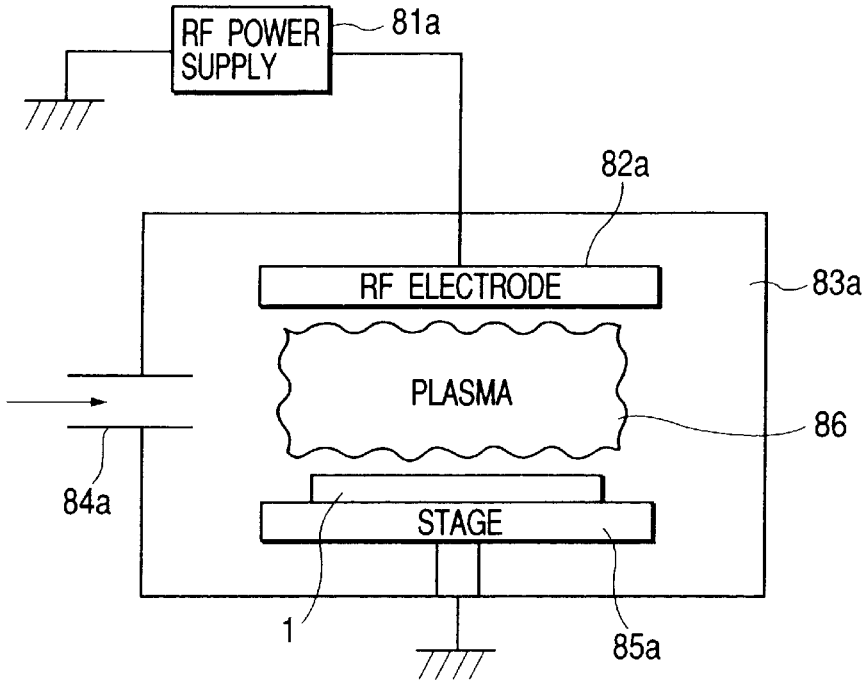
FIG. 13 is a view for explaining a method for forming an SiN film on the element substrate by using a plasma CVD apparatus.

As shown in FIG. 13, within the reaction chamber 83*a* of the plasma CVD apparatus for forming the SiN film 72*a,* there are provided an RF electrode 82*a* and a stage 85*a* which are opposed to each other with a predetermined distance. Voltage is applied to the RF electrode 82*a* from an RF power supply 81*a* externally of the reaction chamber 83*a*. On the other hand, the element substrate 1 is attached to a surface of the stage 85*a* near the RF electrode 82*a* so that the surface of the element substrate 1 near the heat generating bodies 2 is opposed to the RF electrode 82*a*. Here, the anti-cavitation film (made of Ta) provided on the heat generating bodies 2 of the element substrate 1 is electrically connected to the silicon substrate of the element substrate 1, and the gap forming member 71*a* is grounded through the silicon substrate of the element substrate 1 and the stage 85*a*.

In the plasma CVD apparatus having such a construction, in a condition that the anti-cavitation film is grounded, gas is supplied into the reaction chamber 83*a* through a supply tube 84*a*, thereby generating plasma 46 between the element substrate 1 and the RF electrode 82*a*. Ions and radicals decomposed by the plasma discharge within the reaction chamber 83*a* are accumulated on the element substrate 1, thereby forming the SiN film 72*a* on the element substrate 1. In this case, although charges are created on the element substrate 1. In this case, although charges are created on the element substrate 1 by the ions and radicals, since the anti-cavitation film is grounded as mentioned above, the function elements such as the heat generating bodies 2 and the latch circuit in the element substrate 1 can be prevented from being damaged by the charges due to ions and radicals.

Figure 12D:
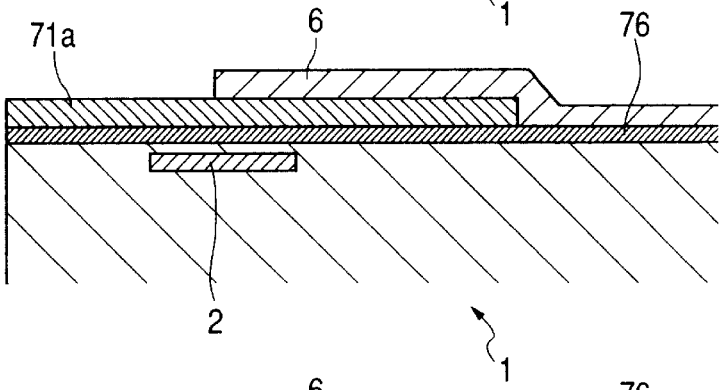

Then, in FIG. 12D, after an Al film having a thickness of about 6100 Å is formed on the surface of the SiN film 72*a* by the spattering method, the formed Al film is patterned by using the known photo-lithography process, thereby leaving the Al film (not shown) as a second protection layer on a portion of the surface of the SiN film 72*a* corresponding to the movable member 6. The Al film as the second protection layer acts as a protection layer (etching stop layer) or mask when the SiN film 72*a* is subjected to the dry etching to form the movable member 6.

The SiN film 72*a* is patterned by an etching device using dielectric coupling plasma by utilizing the second protection layer as the mask, with the result that the movable member 6 is formed by the remaining portion of the SiN film 72*a*. In the etching device, mixed gas comprised of $CF_4$ and $O_2$ is used, and, in the step for patterning the SiN film 72*a*, as shown in FIG. 11, undesired portions of the SiN film 72*a* are removed to directly fix the support fixed portion of the movable member 6 to the element substrate 1. The constituent material of the fixed portion between the movable member 6 and the element substrate 1 includes TiW which is constituent material for the pad protection layer and Ta which is constituent material for the anti-cavitation film of the element substrate 1.

When the SiN film 72*a* is etched by using the dry etching device, as will be described herein below with reference to FIG. 14, the gap forming member 71*a* is grounded via the element substrate 1. As a result, during the dry etching, charges due to ions and radicals caused by decomposition of $CF_4$ gas are prevented from being trapped in the gap forming member 71*a*, thereby protecting the function elements such as the heat generating bodies 2 and the latch circuit in the element substrate 1. Further, in the etching step, as mentioned above, since the gap forming member 71*a* has been formed on the portion exposed by removing the undesired portions of the SiN film 72*a*, i.e., an area to be etched, the surface of the TiW film 76 is not exposed, thereby positively protecting the element substrate 1 by the gap forming member 71*a*.

Figure 14:
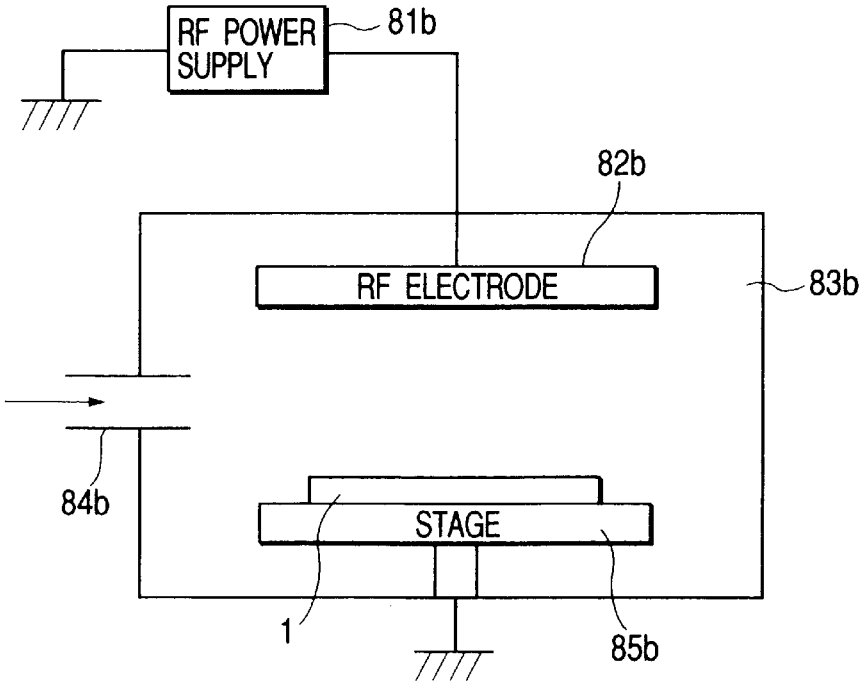
FIG. 14 is a view for explaining a method for forming an SiN film by using dry etching apparatus.

As shown in FIG. 14, within a reaction chamber 83*b* of the dry etching apparatus for etching the SiN film 72*a*, there are provided an RF electrode 82*b* and a stage 85*b* which are opposed to each other with a predetermined distance. Voltage is applied to the RF electrode 82*b* from an RF power supply 81*b* externally of the reaction chamber 83*a*. On the other hand, the element substrate 1 is attached to a surface of the stage 85*b* near the RF electrode 82*b* so that the surface of the element substrate 1 near the heat generating bodies 2 is opposed to the RF electrode 82*b*. Here, the gap forming member 71*a* comprised of the Al film is electrically connected to the anti-cavitation film (made of Ta) provided on the element substrate 1, and, as mentioned above, the anti-cavitation film is electrically connected to the silicon substrate of the element substrate 1, and the gap forming member 71*a* is grounded through the anti-cavitation film and the silicon substrate of the element substrate 1 and the stage 85*b*.

In the dry etching apparatus having such a construction, in a condition that the gap forming member 71*a* is grounded, the mixed gas ($CF_4$ and $O_2$) is supplied into the reaction chamber 83*b* through a supply tube 84*b*, thereby etching the SiN film 72*a*. In this case, although charges are created on the element substrate 1 by the ions and radicals generated by decomposition of the $CF_4$ gas, since the gap forming member 71*a* is grounded as mentioned above, the function elements such as the heat generating bodies 2 and the latch circuit in the element substrate 1 can be prevented from being damaged by the charges due to ions and radicals.

In the illustrated embodiment, while the mixed gas ($CF_4$ and $O_2$) was used as the gas supplied into the reaction chamber 83*b*, $CF_4$ gas or $C_2F_6$ gas which is not mixed with $O_2$, or mixed gas of $C_2F_6$ and $O_2$ may be used.

Although the movable member 6 composed of SiN is formed in this way, in the step for forming the movable member 6 starting from the step for forming the SiN film 72*a*, for example, as shown in FIGS. 7C to 7E, the detecting portion and wirings of the movable member 6 are formed.

Figure 12E:
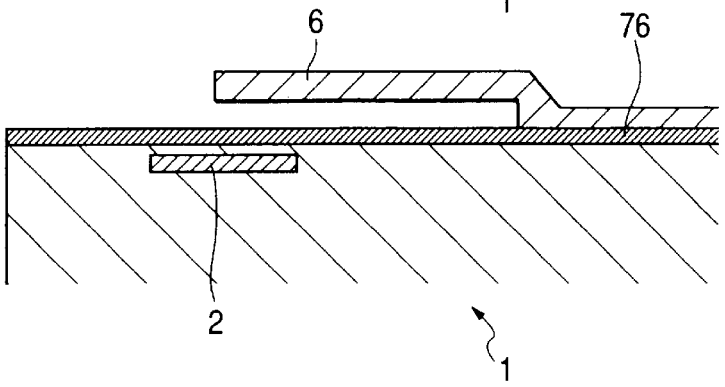

Then, in FIG. 12E, by using mixed acid of acetic acid, phosphoric acid and nitric acid, the second protection layer comprised of the Al film and the gap forming member 71*a* comprised of the Al film are dissolved and removed, thereby forming the movable member 6 on the element substrate 1. Thereafter, by using hydrogen peroxide, portions of the TiW film 76 formed on the element substrate 1 corresponding to the bubble generating area 10 and the pads are removed.

In this way, the element substrate 1 having the movable members 6 is manufactured. Here, while an example that the support fixed portion of the movable member 6 is directly fixed to the element substrate 1 as shown in FIG. 1 was explained, by using this manufacturing method, a liquid discharge head in which movable members are fixed to an element substrate via seat portions can be manufactured. In this case, prior to the step for forming the gap forming member 71*a* shown in FIG. 12B, a seat portion for fixing an end of the movable member opposite to the free end thereof to the element substrate is formed on the surface of the element substrate near the heat generating bodies. Also in this case, the constituent material of the fixed portion between the seat portion and the element substrate includes TiW which is constituent material for the pad protection layer and Ta which is constituent material for the anti-cavitation film of the element substrate.

In the above-mentioned example, while an example that the liquid flow path side walls 9 are formed in the top plate 3 was explained, by using the photo-lithography process, at the same time when the movable members 6 are formed in the element substrate 1, the liquid flow path side walls 9 can be formed in the element substrate 1.

Now, an example of steps for forming the movable member 6 and the liquid flow path side walls 9 when the movable members 6 and the liquid flow path side walls 9 are formed in the element substrate 1 will be explained with reference to FIGS. 15 and 16. Incidentally, FIGS. 15A to 15C and 16A to 16C are sectional views of the element substrate in which the movable members and the liquid flow path side walls are formed, taken along a direction perpendicular to the liquid flow path thereof. Further, in the example shown in FIGS. 15A to 15C and 16A to 16C, similar to the example explained with reference to FIGS. 12A to 12E, although the detecting portion and wirigns are formed on the movable member 6, since the formation of such elements is the same as that in the example explained with reference to FIGS. 7A to 7E, in the following explanation, the formation of the movable member 6 and the liquid flow path side walls 9 is mainly explained, and explanation of formation of the detecting portion and wirings on the movable member 6 will be omitted.

Figure 15A:
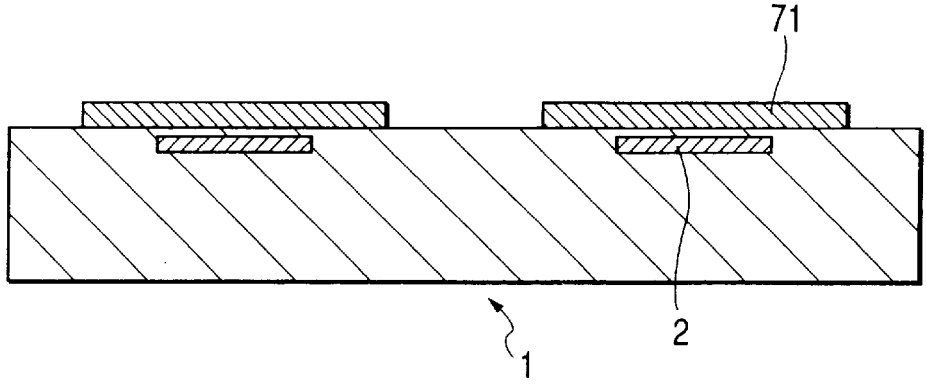
FIGS. 15A, 15B and 15C are views for explaining a method for forming a movable member and flow path side walls on the element substrate.

First of all, in FIG. 15A, a TiW film (first protection layer) (not shown) having a thickness of about 5000 Å for protecting the connection pad portions for effecting electrical connection to the heat generating bodies 2 is formed on the entire surface of the element substrate 1 near the heat generating bodies 2 by the spattering method. An Al film having a thickness of about 4 $\mu$m for forming a gap forming member 71 is formed on the surface of the element substrate 1 near the heat generating bodies 2 by the spattering method. The formed Al film is patterned by using the known photo-lithography process, thereby forming a plurality of gap forming members 71 comprised of Al films for forming the gap between the element substrate 1 and the movable members 6 at positions corresponding to the bubble generating areas 10 between the heat generating bodies 2 and the movable member 6 shown in FIG. 11. The respective gap forming members 71 extend up to an area where an SiN film 72 for forming the movable members 6 is etched in a step shown in FIG. 16B which will be described later. The gap forming members 71 act as etching stop layers when the liquid flow paths 7 and the movable members 6 are formed by dry etching which will be described later. Thus, widths of the respective gap forming members 71 in a direction perpendicular to the liquid flow path 7 are selected to be greater than a width of the liquid flow path 7 formed in a step shown in FIG. 16B which will be described later so that the surface of the element substrate 1 near the heat generating bodies 2 and the TiW layer on the element substrate 1 are not exposed when the liquid flow paths 7 are formed by the dry etching.

Further, during the dry etching, ions and radicals are generated by decomposition of $CF_4$ gas, which may damage the heat generating bodies 2 and the function elements of the element substrate 1. However, the gap forming members 71 comprised of Al catch the ions and radicals to protect the heat generating bodies 2 and the function elements of the element substrate 1.

Figure 15B:
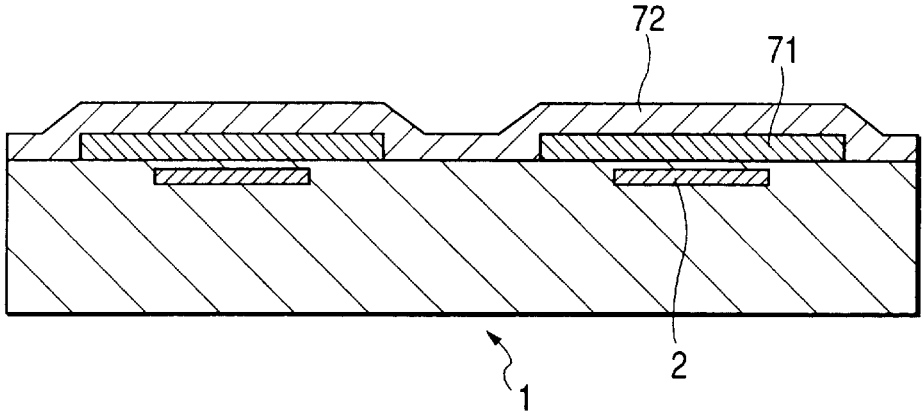

Then, in FIG. 15B, the SiN film 72 for forming the movable members 6 is formed on the surfaces of the gap forming members 71 and the surface of the element substrate 1 near the gap forming members 71 by using the plasma CVD method to cover the gap forming members 71. Here, when the SiN film 72 is formed by using a plasma CVD apparatus, as described in connection with FIG. 13, the anti-cavitation film (made of Ta) provided on the element substrate 1 is grounded via the silicon substrate constituting the element substrate 1. As a result, the function element such as the heat generating bodies 2 and the latch circuit in the element substrate 1 can be protected from charges due to ions and radicals decomposed by plasma discharge within a reaction chamber of the plasma CVD device.

Figure 15C:
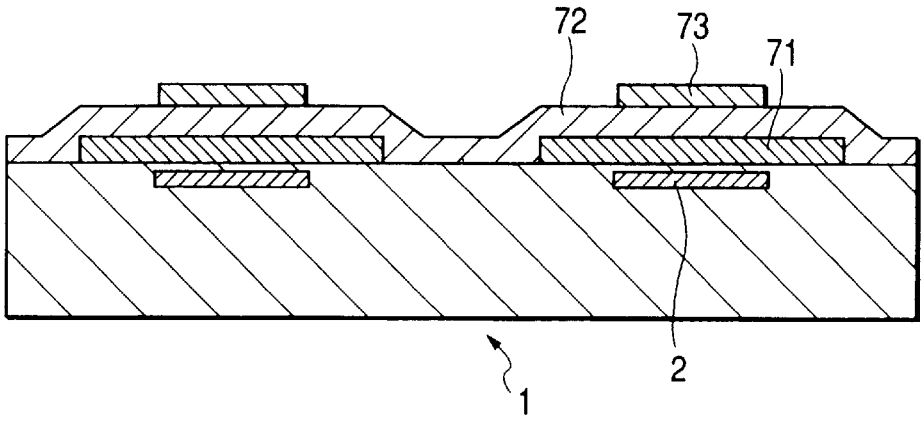

Then, in FIG. 15C, after an Al film having a thickness of about 6100 Å is formed on the surface of the SiN film 72 by the spattering method, the formed Al film is patterned by using the known photo-lithography process, thereby leaving an Al film 73 as a second protection layer on a portion of the surface of the SiN film 72 corresponding to the movable members 6, i.e., on a movable member forming areas of the surface of the SiN film 72. The Al film 73 acts as a protection layer (etching stop layer) when the liquid flow paths are formed by the dry etching.

Figure 16A:
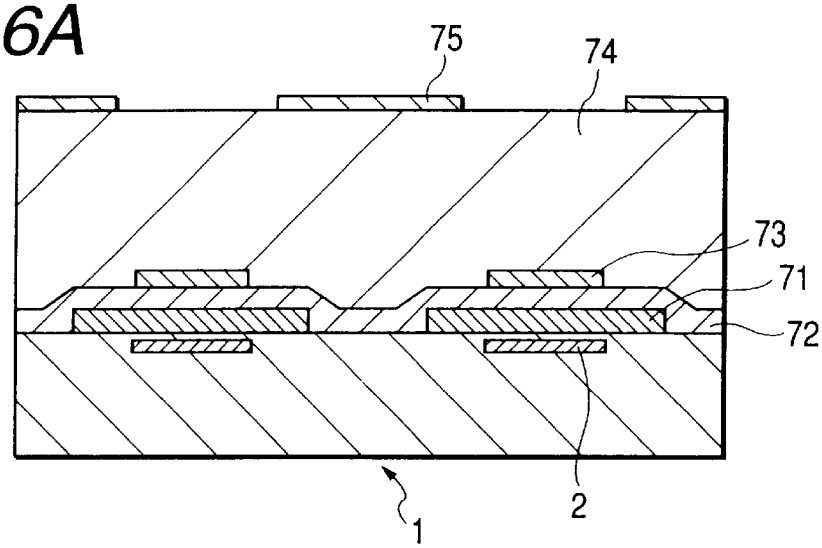
FIGS. 16A, 16B and 16C are views for explaining a method for forming movable members and flow path side walls on the element substrate.

Then, in FIG. 16A, an SiN film 74 having a thickness of about 50 $\mu$m for forming the liquid flow path side walls 9 is formed on the surfaces of the SiN film 72 and the Al film 73 by a micro wave CVD method. Here, as gas used for forming the SiN film 74 by the micro wave CVD method, monosilane ($SiH_4$), nitrogen ($N_2$) and argon (Ar) were used. As combinations of gasses, other than the above, a combination of disilane ($Si_2H_6$) and ammonia ($NH_3$) or mixed gas may be used. Further, under a condition that power of the micro wave having frequency of 2.45 GHz is 1.5 kW, monosilane of 100 sccm, nitrogen of 100 sccm and argon of 40 sccm are supplied as gas flow rate and pressure is 5 mTorr (high vacuum), the SiN film 74 was formed. Further, the SiN film 74 may be formed by a micro wave plasma CVD method with gas component ratio other than the above or by a CVD method using an RF power supply.

When the SiN film 74 is formed by the CVD method, similar to the method for forming the SiN film 72 described in connection with FIG. 13, the anti-cavitation film (made of Ta) formed on the heat generating bodies 2 is grounded via the silicon substrate of the element substrate 1. As a result, the function elements such as the heat generating bodies 2 and the latch circuit in the element substrate 1 can be protected from the charges due to ions and radicals decomposed by plasma discharge in the reaction chamber of the CVD device.

After the Al film is formed on the entire surface of the SiN film 74, the formed Al film is patterned by using the known photo-lithography to form an Al film 75 on the surface of the SiN film 74 except for a portion corresponding to the liquid flow paths 7. As mentioned above, since the widths of the respective gap forming members 71 in the direction perpendicular to the liquid flow path 7 are greater than the width of the liquid flow paths 7 formed in a step shown in FIG. 16B, edge portion of the Al film 74 are disposed above edge portion of the gap forming members 71.

Figure 16B:
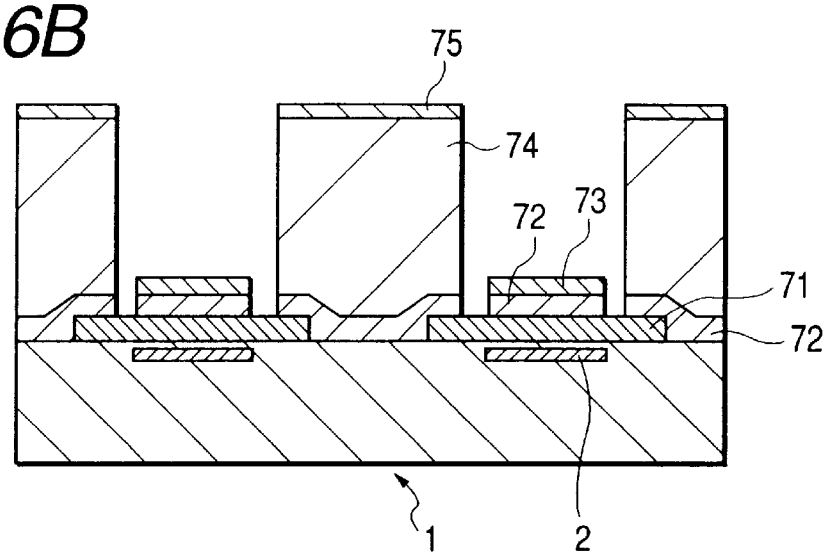

Then, in FIG. 16B, the SiN film 74 and the SiN film 72 are patterned by using an etching device utilizing dielectric coupled plasma to form the liquid flow path walls 9 and the movable members 6 simultaneously. In the etching device, by using mixed gas comprised of $CF_4$ and $O_2$, the SiN film 74 and the SiN film 72 are etched with the aid of the Al film 72, 25 and the gap forming members 71 as etching stop layers or masks. In the step for patterning the SiN film 72, undesired portions of the SiN film 72 are removed so that the support fixed portions of the movable members 6 are directly fixed to the element substrate 1. The constituent material of the fixed portion between the support fixed portion of the movable member 6 and the element substrate 1 includes TiW which is constituent material for the pad protection layer and Ta which is constituent material for the anti-cavitation film of the element substrate 1.

When the SiN films 72, 74 are etched by using the dry etching apparatus, as explained in connection with FIG. 14, the gap forming members 71 are grounded via he element substrate 1. As a result, the charges due to the ions and radicals generated by decomposition of the $CF_4$ gas during the dry etching are prevented from being trapped in the gap forming members 71, thereby protecting the function elements such as the heat generating bodies 2 and the latch circuit in the element substrate 1. Further, since the widths of the gap forming members 71 are greater than the widths of the liquid flow paths 7 formed in this etching step, when the undesired portions of the SiN film 74 are removed, the surface of the element substrate 1 near the heat generating bodies 2 is not exposed, so that the element substrate 1 is positively protected by the gap forming members 71.

Figure 16C:
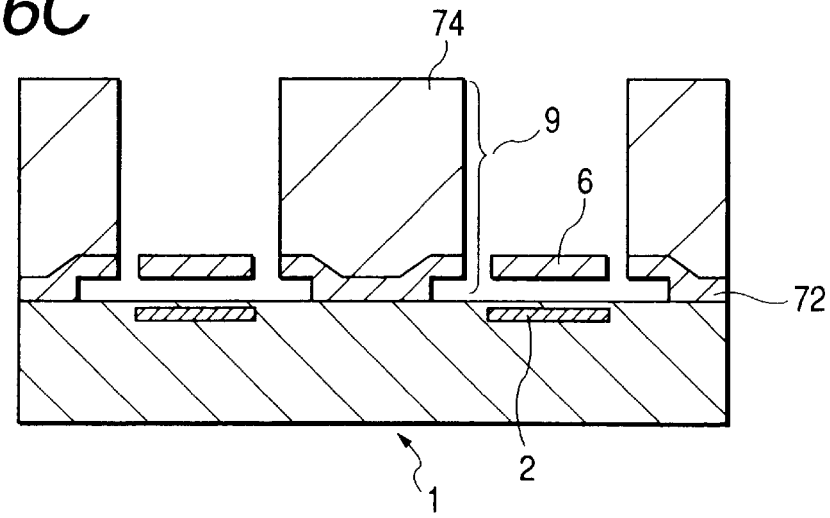

Then, in FIG. 16C, by using mixed acid of acetic acid, phosphoric acid and nitric acid, the Al films 73, 75 are heated and etched to dissolve and remove the Al films 73, 75 and the gap forming members 71 comprised of the Al films, thereby forming the movable members 6 on the element substrate 1. Thereafter, by using hydrogen peroxide, portions of the TiW film as the pad protection layer formed on the element substrate 1 corresponding to the bubble generating areas 10 and the pads are removed.

The constituent material of the fixed portion between the element substrate 1 and the liquid flow path wall 9 includes TiW which is constituent material for the pad protection layer and Ta which is constituent material for the anti-cavitation film of the element substrate 1.

(6) Application Example of Liquid Discharge Head

Next, a liquid discharge apparatus to which the above-mentioned liquid discharge head is mounted will be briefly explained.

Figure 17:
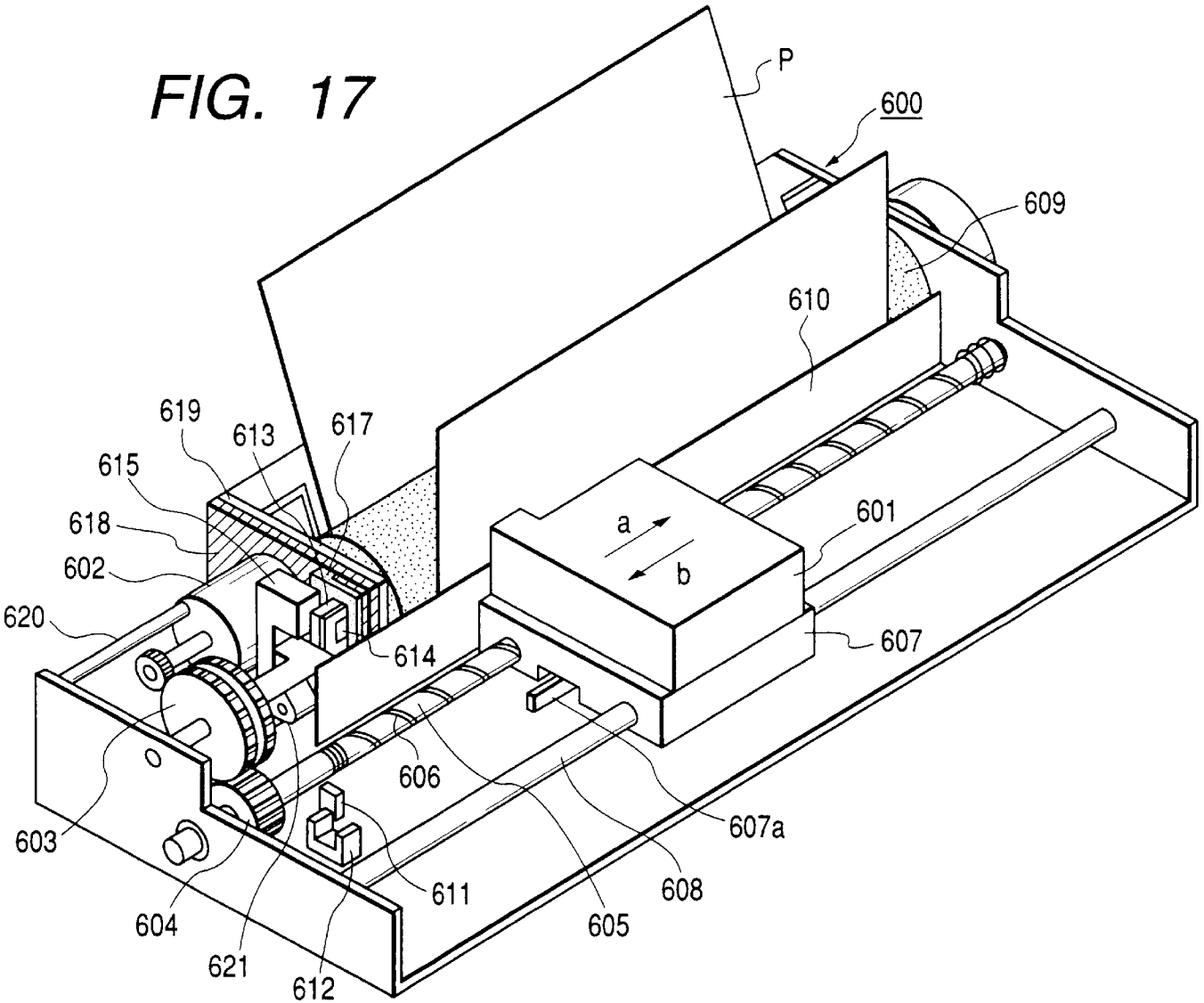
FIG. 17 is a schematic perspective view of an ink jet recording apparatus as an example of a liquid discharge apparatus to which the liquid discharge head of the present invention can be mounted and applied.

FIG. 17 is a schematic perspective view of an ink jet recording apparatus 600 as an example of a liquid discharge apparatus to which the liquid discharge head according to the present invention can be mounted.

In FIG. 17, an ink jet head cartridge 601 is constituted by integrally forming the above-mentioned liquid discharge head and an ink tank for holding ink to be supplied to the liquid discharge head. The ink jet head cartridge 601 is mounted on a carriage 607 engaged by a helical groove 606 of a lead screw 605 rotated (via drive force transmitting gears 603, 604) in synchronous with normal and reverse rotations of a drive motor 602, so that the cartridge is reciprocally shifted together with the carriage 607 in directions shown by the arrows a, b along a guide 608 by a driving force of the drive motor 602. A recording material P is conveyed on a platen roller 609 by recording material conveying means (not shown) and is urged against the platen roller 609 by a sheet pressing plate 610 along a shifting direction of the carriage 607.

Photo-couplers 611, 612 are disposed in the vicinity of one end of the lead screw 605. The photo-couplers constitute home position detecting means for recognizing the presence of a lever 607*a* of the carriage 607 in this area and for switching a rotational direction of the drive motor 602.

A support member 613 serves to support a cap member 614 for covering a front surface (discharge port surface) including the discharge ports of the ink jet head cartridge 601. Further, ink suction means 615 serves to suck ink trapped in the cap member 614 by idle suction from the ink jet head cartridge 601. By the ink suction means 615, suction recovery of the ink jet head cartridge 601 is effected via a cap opening portion 616. A cleaning blade for sweeping the discharge port surface of the ink jet head cartridge 601 is can be shifted by a shift member 618 in a front-and-rear direction (direction perpendicular to a shifting direction of the carriage 607). The cleaning blade 617 and the shift member 618 are supported by a body support 619. The cleaning blade 617 is not limited to the illustrated one, but may be one of other known cleaning blades.

In the suction recovery operation of the liquid discharge head, a lever 620 for starting suction is shifted in response to movement of a cam 621 engaged by the carriage 607, and this shifting is controlled by switching the driving force from the drive motor 602 by means of known transmitting means such as clutch switching. An ink jet recording control portion (not shown) for supplying signals to the heat generating bodies of the liquid discharge head of the ink jet head cartridge 601 and for controlling the driving of the above-mentioned mechanisms is provided in a body of the apparatus.

In the ink jet recording apparatus 600 having the above-mentioned construction, regarding the recording material P conveyed on the platen roller 609 by the recording material conveying means (not shown), the recording is effected on the whole width of the recording material P by reciprocally shifting the ink jet head cartridge 601.

(Second Embodiment)

In a second embodiment of the present invention, a pressure sensor is provided on a movable member.

By arranging the movable member having the pressure sensor element in the liquid flow path, the pressure caused by the bubble generated above the heat generating element can be measured electrically by the pressure sensor element responsive to displacement of the movable member. Particularly, the bubble pressure can be guessed from an amount of displacement of the movable member in the liquid, and, by adjusting the driving condition of the energy generating element on the basis of such displacement amount, the discharge property can be stabilized.

Now, the second embodiment of the present invention will be explained with reference to the accompanying drawings.

Figure 18:
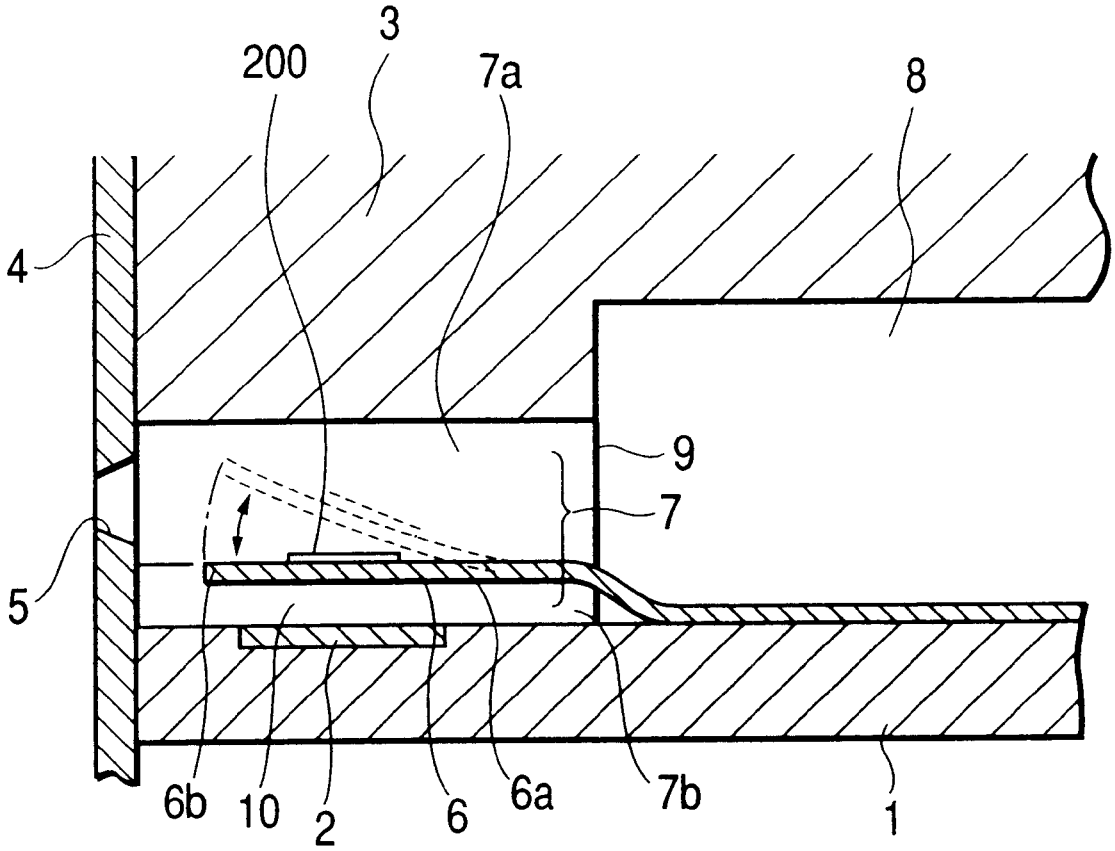
FIG. 18 is a sectional view for explaining a construction of the liquid discharge head according to an embodiment of the present invention, taken along a liquid flow path thereof.

FIG. 18 is a sectional view of a liquid discharge head according to the second embodiment, taken along a direction of a liquid flow path thereof.

As shown in FIG. 18, the liquid discharge head comprises an element substrate 1 on which a plurality of heat generating bodies 2 (only one of which is shown in FIG. 1) for providing thermal energy for generating bubbled in the liquid are arranged in parallel, a top plate 3 joined to the element substrate 1, an orifice plate 4 joined to front end faces of the element substrate 1 and the top plate 3, movable members 6 disposed within liquid flow paths 7 defined by the element substrate 1 and the top plate 3, pressure sensors 200 provided on the respective movable members 6 and each adapted to detect pressure of a bubble generated in the liquid or fluid pressure of the liquid flow on the basis of distortion or vibration of the movable member 6.

The element substrate 1 is constituted by forming silicon oxide film or silicon nitride film for insulation and heat regeneration onto a silicon substrate and by patterning electrical resistive layers and wirings constituting the heat generating bodies 2 on the substrate. By applying electric current to the electrical resistive layers from the wirings, the heat generating bodies 2 emit heat.

The top plate 3 defines the plurality of liquid flow paths 7 corresponding to the heat generating bodies 2 and a common liquid chamber 8 for supplying the liquid to the liquid flow paths 7. To this end, liquid path side walls 9 extending from a ceiling portion to portions between the heat generating bodies 2 are integrally formed with the top plate. The top plate 3 is formed from silicon material, and patterns of the liquid flow paths 7 and the common liquid chamber 9 may be formed by etching or, after material constituting the liquid path side walls 9 such as silicon nitride or silicon oxide is deposited on the silicon substrate by a known film forming method such as CVD, portions corresponding to the liquid flow paths 7 may be formed by etching.

The orifice plate 4 is provided with a plurality of discharge ports 5 corresponding to the liquid flow paths and communicated with the common liquid chamber 9 through the liquid flow paths 7. The orifice plate 4 is also formed from silicon material and may be formed, for example, by cutting a silicon substrate with the discharge ports 5 formed therein into a plate having a thickness of about 10 to 150 $\mu$m. Incidentally, the orifice plate 4 is not inevitable for the present invention. Thus, in place of the orifice plate 4, a wall having a thickness corresponding to that of the orifice plate 4 may be left at a front end face of the top plate 3 when the liquid flow paths 7 are formed in the top plate 3 and the discharge ports 5 may be formed in such a wall, thereby providing a top plate with discharge ports.

Each movable member 6 is a thin membrane formed from silicon material such as silicon nitride or silicon oxide and cantilever-supported so that it is opposed to the corresponding heat generating body 2 and it divides the corresponding liquid flow path 7 into a first liquid flow path 7*a* communicating the liquid flow path 7 with the discharge port 5 and a second liquid flow path 7*b* including the heat generating body 2.

The movable member 6 has a fulcrum 6*a* at an upstream side of great liquid flow (caused by the liquid discharge operation) flowing from the common liquid chamber 8 to the discharge port 5 through the movable member 6 and a free end 6*b* at a downstream side of the fulcrum 6*a* and is spaced apart from the heat generating body 2 by a predetermined distance to cover the opposed heat generating body 2. A bubble generating area 10 is defined between the heat generating body 2 and the movable member 6.

Next, the movable member 6 having the pressure sensor and opposed to the bubble generating area 10 will be explained with reference to FIGS. 19A and 19B and FIG. 20.

Figure 19A:
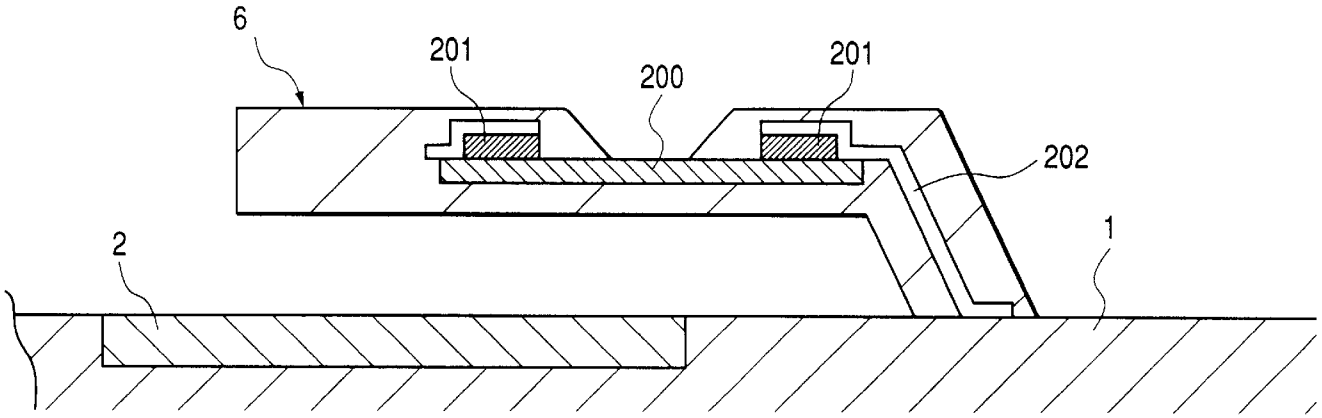
FIGS. 19A and 19B are views for best showing a nozzle having a movable member having a pressure sensor, according to an embodiment of the present invention.
Figure 19B:
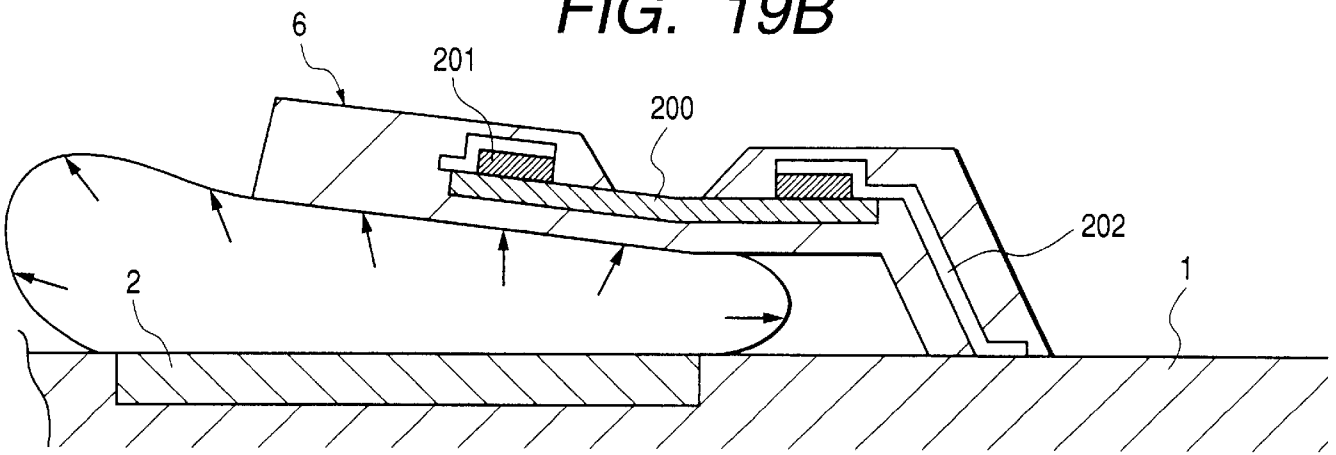
Figure 20:
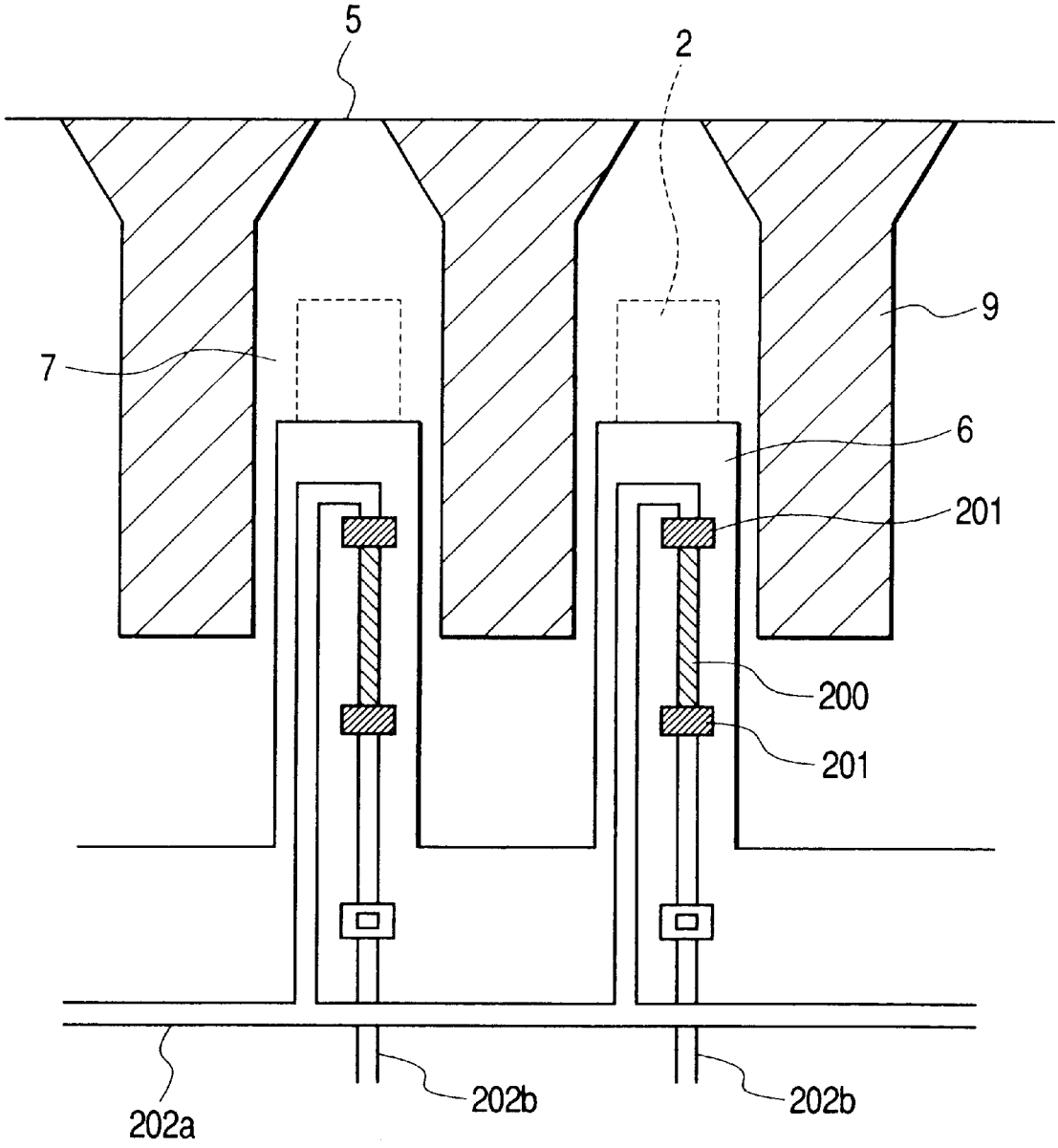
FIG. 20 is a sectional view for showing electrical wirings of FIGS. 19A and 19B for pressure sensors for the movable members provided in liquid flow paths, taken along a direction parallel to the element substrate.

FIG. 19A is a sectional view of a nozzle including the movable member 6 having the pressure sensor, taken along a direction of the liquid flow path perpendicular to the element substrate 1, and FIG. 19B is a view showing a condition that the movable member 6 is displaced by a bubble generated in the liquid by the heat generating body 2 in FIG. 19A. Further, FIG. 20 is a sectional view showing electrical wirings for the pressure sensors of the movable members 6 disposed in the liquid flow paths 7, taken along a direction parallel with the element substrate 1.

As shown in FIGS. 19A and 19B, the pressure sensor 200 provided at its both ends with electrodes 201 connected to lead wires 202 is incorporated into the movable member 6.

For example, as the pressure sensor 200 in the movable member 6 made of SiN, a semiconductor strain gauge utilizing Piezo-resistance effect in a polysilicon film or a Piezo-electric element which generates voltage in response to external pressure is used. In the illustrated embodiment, the movable member is partially removed on one or both upper and lower sides of the pressure sensor element 200 so that the sensor element can be flexed efficiently. Further, as shown in FIG. 20, among the electrodes 201 on both ends of the pressure sensor elements 200 of the movable members 6 in the liquid flow paths, one electrode is connected to a common wiring 202*a* together with one similar electrodes of other pressure sensor elements, and the other electrodes are connected to segment wirings 202*b* of the respective movable members 6.

Next, a method for manufacturing the movable member 6 having the pressure sensor on the element substrate 1 by utilizing the photo-lithography process will be explained.

FIGS. 21A to 21D and FIGS. 22A to 22D are sectional views for explaining an example of a method for manufacturing the movable member in the liquid discharge head shown in FIG. 1 and FIGS. 19A and 19B, taken along a direction of the liquid flow path 7 thereof. In the manufacturing method explained with reference to FIGS. 21A to 21D and FIGS. 22A to 22D, by joining the element substrate 1 on which the movable members 6 are formed to the top plate in which the liquid flow path side walls are formed, the liquid discharge head shown in FIG. 1 is manufactured. Accordingly, in this manufacturing method, before the top plate is joined to the element substrate 1 having the movable members 6, he liquid flow path side walls are formed in the top plate.

Figure 21A:
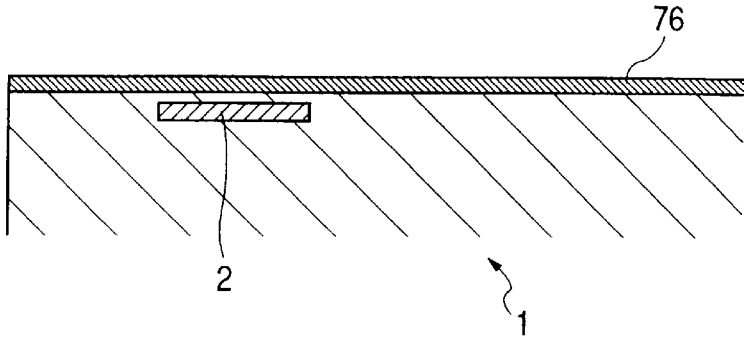
FIGS. 21A, 21B, 21C and 21D are views for explaining a method for forming a movable member having a pressure sensor element on the element substrate shown in FIGS. 19A and 19B.

First of all, in FIG. 21A, a TiW film (first protection layer) 76 having a thickness of about 5000 Å for protecting the connection pad portions for effecting electrical connection to the heat generating bodies 2 is formed on the entire surface of the element substrate 1 near the heat generating bodies 2 by the spattering method.

Figure 21B:
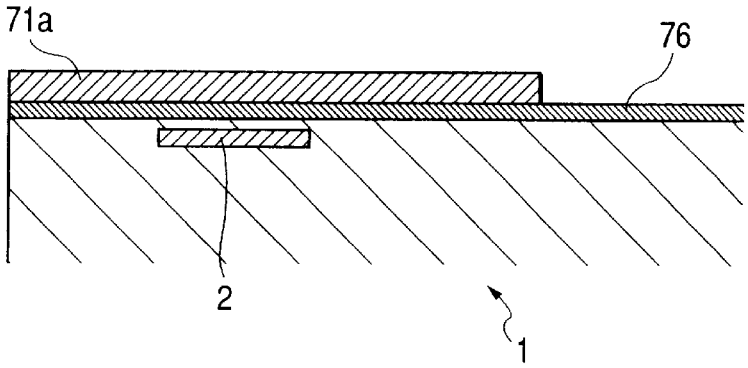

Then, in FIG. 21B, an Al film having a thickness of about 4 $\mu$m for forming a gap forming member 71*a* is formed on the surface of the TiW film 76 by the spattering method. The gap forming member 71*a* extends up to an area where an SiN film 72*a* is etched in a step shown in FIG. 21D which will be described later.

By patterning the formed Al film by using the known photo-lithography process, only a portion of the Al film corresponding to the support fixed portion of the movable member 6 is removed, thereby forming the gap forming member 71*a* on the surface of the TiW film 76. Accordingly, a portion of the surface of the TiW film 76 corresponding to the support fixed portion of the movable member 6 is exposed. The gap forming member 71*a* comprises Al film for forming the gap between the element substrate 1 and the movable member 6. The gap forming member 71*a* is formed on the whole area (except for the portion corresponding to the support fixed portion of the movable member 6) of the surface of the TiW film 76 including a position corresponding to the bubble generating area 10 between the heat generating body 2 and the movable member 6 shown in FIG. 1. Accordingly, in this manufacturing method, the gap forming member 71*a* is formed up to a portion of the surface of the TiW film 76 corresponding to the liquid flow path side walls.

As will be described later, the gap forming member 71*a* acts as an etching stop layer when the movable member 6 is formed by the dry etching. The TiW film 76, a Ta film as the anti-cavitation film on the element substrate 1 and the SiN film (protection layer) on the resistance bodies are etched by the etching gas used for forming the liquid flow paths 7. In order to prevent the etching of such films and layers, the gap forming member 71*a* is formed on the element substrate 1. As a result, when the SiN film is subjected to the dry etching to form the movable member 6, the surface of the TiW film 76 is not exposed, with the result that the damage of TiW film 76 and the function elements in the element substrate 1 due to the dry etching can be prevented by the gap forming member 71*a*.

Figure 21C:
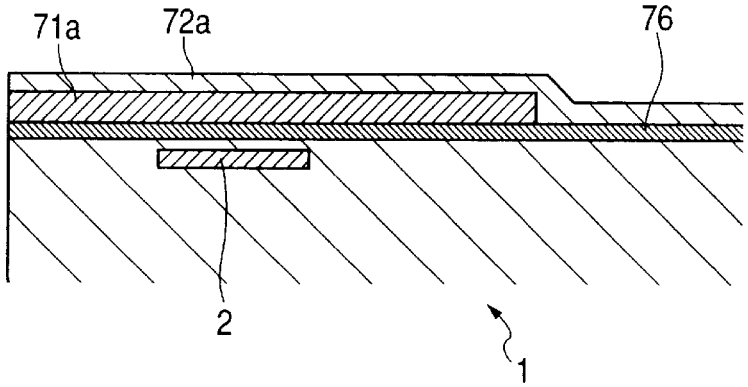
Figure 21D:
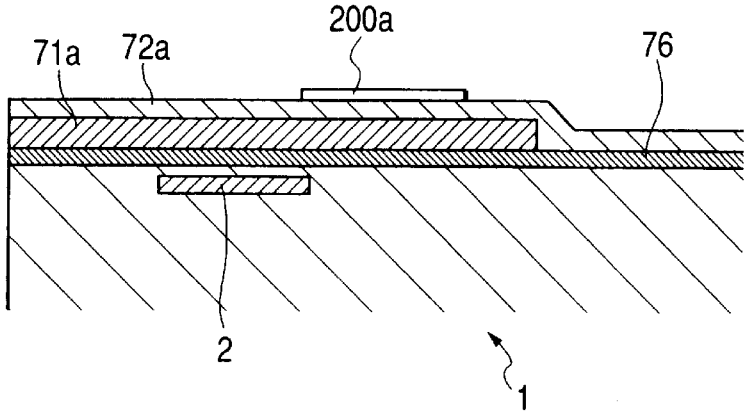

Then, in FIG. 21C, an SiN film 72*a* having a thickness of about 2.5 $\mu$m for forming the movable member 6 is formed on the entire surface of the gap forming member 71*a* and the entire exposed surface of the TiW film 76 to cover the gap forming member 71*a* by using the plasma CVD method.

Then, after a polysilicon film is formed on the entire surface of the SiN film 72*a,* the formed polysilicon film is patterned by using the known photo-lithography process, thereby leaving a polysilicon film 200*a* on a portion of the movable member 6 corresponding to the pressure sensor element 200 (FIGS. 19A and 19B).

Figure 22A:
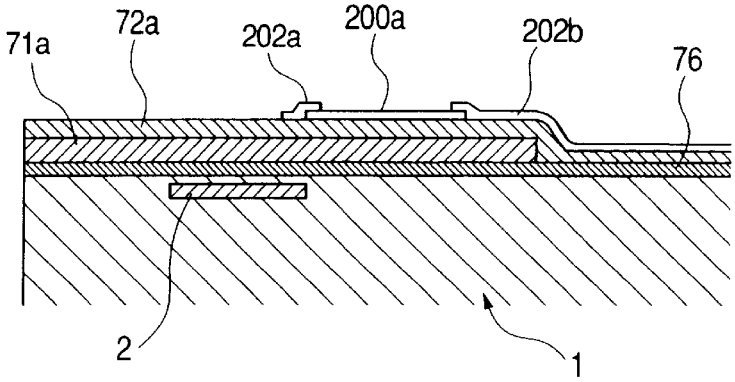
FIGS. 22A, 22B, 22C and 22D are views for explaining a method for forming a movable member having a pressure sensor element on the element substrate shown in FIGS. 19A and 19B.

Then, as shown in FIG. 22A, in association with both ends of the polysilicon film 200*a* constituting the pressure sensor element, the lead wires 202*a,* 202*b* (FIGS. 19A, 19B and 20) made of Al or Cu/W are patterned.

Figure 22B:
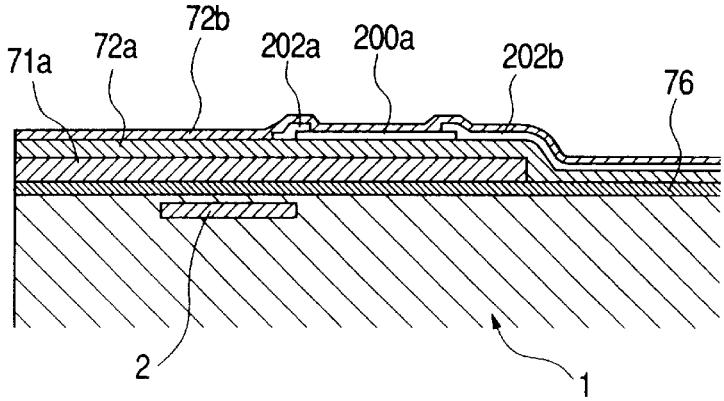

Then, in FIG. 22B, an SiN film 72*b* having a thickness of about 2.0 $\mu$m for forming the movable member 6 is formed on the entire surface of the SiN film 72*a* by the plasma CVD method to cover the polysilicon film 200*a* and the lead wires 202*a,* 202*b.*

Then, after an Al film having a thickness of about 6100 Å is formed on the surface of the SiN film 72*b* by the spattering method, the formed Al film is patterned by using the known photo-lithography process, thereby leaving an Al film (second protection layer) (not shown) on a portion of the surface of the SiN film 72*b* corresponding to the movable member 6. However, the Al film (second protection layer) (not shown) is not left on a part of the SiN film 72*b* on the polysilicon film 200*a* to expose a part of the polysilicon film 200*a* during the dry etching (described later). The Al film as the second protection layer acts as a protection layer (etching step layer) or mask when the SiN films 72*a,* 72*b* are subjected to the dry etching to form the movable member 6.

Figure 22C:
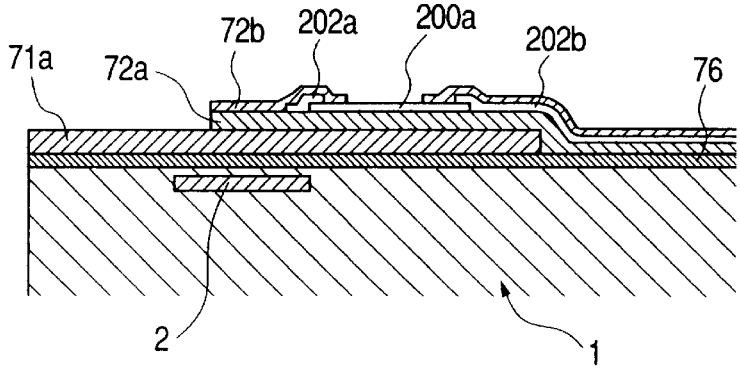

In FIG. 22C, the SiN films 72*a,* 72*b* are patterned by using an etching device utilizing dielectric coupled plasma with the aid of the second protection layer as the mask, thereby forming the movable member 6 by the remaining portions of the SiN films 72*a,* 72*b.* In the etching device, mixed gas comprised of $CF_4$ and $O_2$ is used, and, in the step of patterning the SiN films 72*a,* 72*b,* as shown in FIG. 1, an undesired portion of the SiN film 72*a* is removed so that the support fixed portion of the movable member 6 is directly fixed to the element substrate 1. The constituent material of the fixed portion between the support fixed portion of the movable member 6 and the element substrate 1 includes TiW which is constituent material for the pad protection layer and Ta which is constituent material for the anti-cavitation film of the element substrate 1.

Figure 22D:
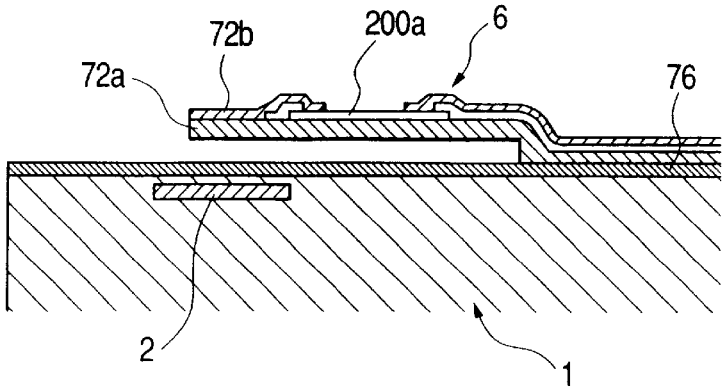

Then, in FIG. 22D, by using mixed acid comprised of acetic acid, phosphoric acid and nitric acid, the second protection layer comprised of the Al film formed on the movable member 6 and the gap forming member 71*a* comprised of the Al film are dissolved and removed, thereby forming the movable member 6 on the element substrate 1. Thereafter, by using hydrogen peroxide, portions of the TiW film 76 formed on the element substrate 1 corresponding to the bubble generating area 10 and the pads are removed.

In this way, the element substrate 1 including the movable members 6 having the pressure sensor elements is manufactured. Here, while an example that the support fixed portion of the movable member 6 is directly fixed to the element substrate 1 as shown in FIG. 1 was explained, by using this manufacturing method, a liquid discharge head in which movable members are fixed to an element substrate via seat portions can be manufactured. In this case, prior to the step for forming the gap forming member 71*a* shown in FIG. 21B, a seat portion for fixing an end of the movable member opposite to the free end thereof to the element substrate is formed on the surface of the element substrate near the heat generating bodies. Also in this case, the constituent material of the fixed portion between the seat portion and the element substrate includes TiW which is constituent material for the pad protection layer and Ta which is constituent material for the anti-cavitation film of the element substrate.

Thereafter, in the top plate 3 as the other element substrate, gold bump is formed on the surfaces on which electrical connection pads are formed, thereby forming convex electrode portions.

Although not shown, the convex electrodes of the top plate and concave electrodes of the element substrate 1 are joined by utilizing metal eutectic. In this case, when the same metal is used as metals of both sides, temperature and pressure in the joining can be reduced and joining strength can be increased.

Then, orifices 5 are formed by using an excimer laser with the aid of a contact mask installed on the entire surface of the face. In this way, the liquid discharge head shown in FIG. 1 is manufactured.

In the above-mentioned manufacturing method, while an example that the liquid flow path side walls 9 are formed in the top plate 3 was explained, at the same time when the movable members 6 are formed in the element substrate 1, the liquid flow path side walls 9 may be formed in the element substrate 1 by the photo-lithography process. Further, while an example that the structure having the semiconductor pressure sensor is manufactured by using the polysilicon film 200*a* was explained, in place of the polysilicon film 200*a,* even when a piezo-electric element is used, the liquid discharge head according to the present invention can be manufactured in the same manufacturing method.

Figure 23A:
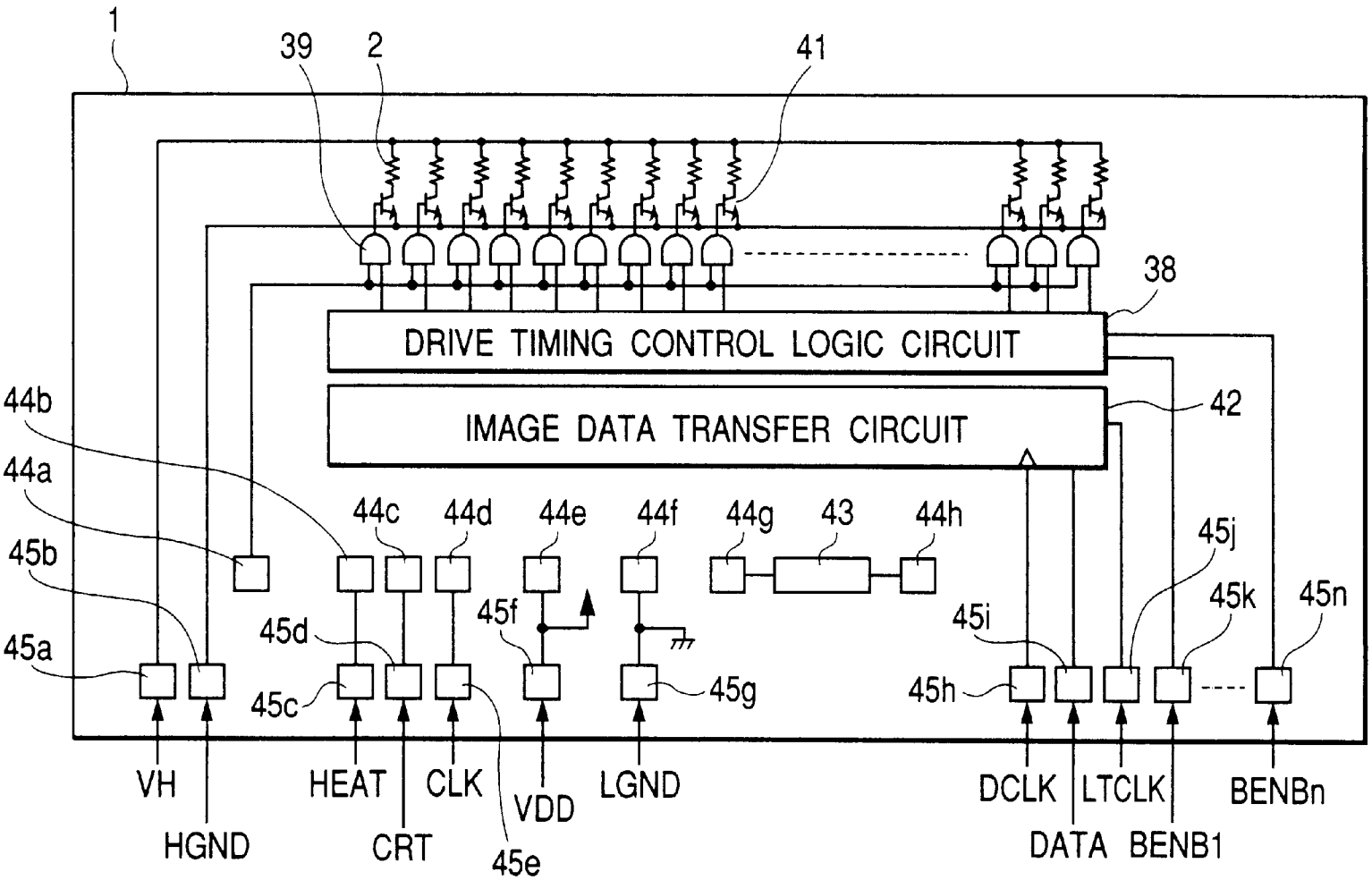
FIGS. 23A and 23B are views for explaining a circuit arrangement of the liquid discharge head shown in FIG. 1, when
Figure 23B:
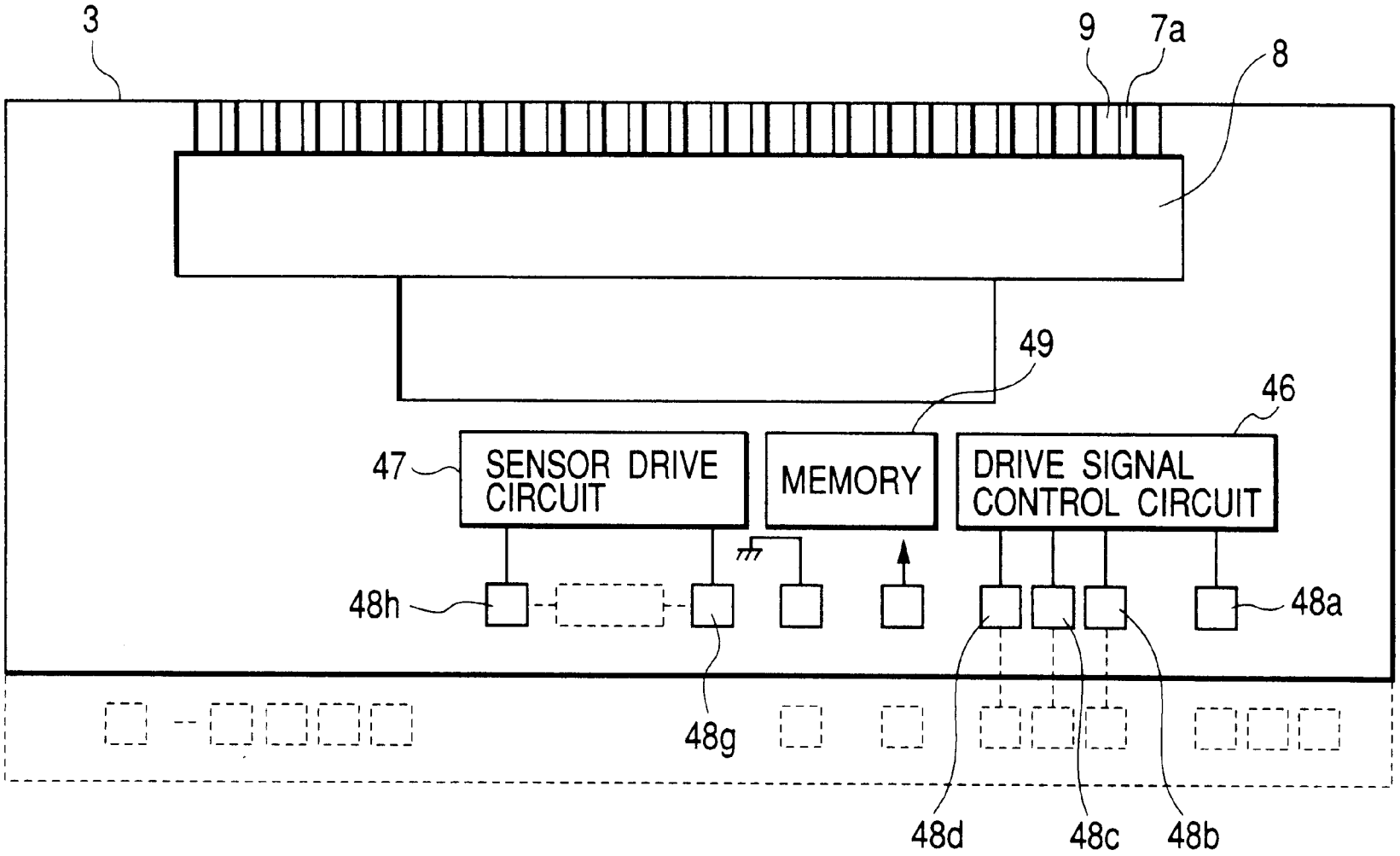

FIGS. 23A and 23B show an example of circuit arrangements of a element substrate 1 and a element substrate 3 in which output signals detected by the pressure sensors provided on the movable members 6 are calculated to control energy applied to the heat generating bodies.

As shown in FIG. 23A, the element substrate 1 includes a plurality of heat generating bodies 2 arranged in a line, power transistors 41 acting as drivers, AND circuits 39 for controlling the driving of the power transistors 41, a drive timing control logic circuit 38 for controlling the drive timings of the power transistors 41, an image data transfer circuit 42 constituted by a shift register and a latch circuit, and pressure sensors (not shown) for detecting pressure of bubbles generated by the heat generating bodies 2 by monitoring displacement amounts of movable members opposed to the heat generating bodies 2.

The drive timing control logic circuit 38 serves to energize the heat generating bodies 2 in a time-lapse manner (not energize the heat generating bodies 2 simultaneously) for reducing power supply capacity of the apparatus, and an enable signal for driving the drive timing control logic circuit 38 is inputted from enable signal input terminals 45*k* to 45*n* which are external contact pads.

Further, as external contact pads provided on the element substrate 1, there are provided an input terminal 45*a* for a drive power supply for the heat generating bodies 32, grounding terminal 45*b* for the power transistors 41, input terminals 45*c* to 45*e* for signals required for controlling energy driving the heat generating bodies 32, a drive power supply terminal 45*f* for the logic circuit, a grounding terminal 45*g,* an input terminal 45*i* for serial data inputted to the shift register of the image data transfer circuit 42, an input terminal 45*h* for a serial clock signal synchronous with this, and an input terminal 34*j* for a latch clock signal inputted to the latch circuit, as well as enable signal input terminals 45*k* to 45*n.*

On the other hand, as shown in FIG. 23B, on the element substrate 3 as a top plate, there are formed a sensor drive circuit 47 for driving the pressure sensors, a drive signal control circuit 46 for monitoring the output from the pressure sensors and for controlling energy supplied to the heat generating bodies on the basis of results from the sensors, and a memory 49 for storing output value data detected by the pressure sensors or code values ranked from the output values and pre-measured liquid discharge amount properties for heat generating bodies 2 (liquid discharge amounts when predetermined pulse is applied under a given temperature) as head information and for outputting such information to the drive signal control circuit 46.

Further, as connection contact pads, on the element substrate 1 and the top plate 3, there are provided terminals 44*g*, 44*h* and 48*g*, 48*h* for connecting a discharge heater rank heater 43 to the sensor drive circuit 47, terminals 44*b* to 44*d* and 48*b* to 48*d* for connecting the input terminals 45*c* to 45*e* for signals required to control the energy for driving the heat generating bodies 2 externally to the drive signal control circuit 46, and a terminal 48*a* for inputting output of the drive signal control circuit 46 to one of terminals of the AND circuits 39.

In an arrangement as mentioned above, first of all, the displacements of the movable members 6 are detected by the pressure sensor elements 200 and results are stored in the memory 49. In the drive signal control circuit 46, in accordance with the output value data and the liquid discharge amount properties stored in the memory 49, rise-up data and rise-down data of drive pulses for the heat generating bodies 2 are determined, and determined results are outputted to the AND circuits 39 through the terminals 48*a*, 44*a*. On the other hand, the image data inputted in serial is stored in the shift register of the image data transfer circuit 43 and is latched in the latch circuit by a latch signal and is outputted to the AND circuits 39 via the drive timing control circuit 38. As a result, the pulse widths of heat pulses are determined in accordance with the rise-up data and rise-down data, and the heat generating bodies 2 are energized with such pulse widths. As a result, substantially constant energy are applied to the heat generating bodies 2.

Next, an example of a circuit for monitoring the output from the pressure sensor element will be explained with reference to FIGS. 24A, 24B, 25 and 26.

Figure 24A:
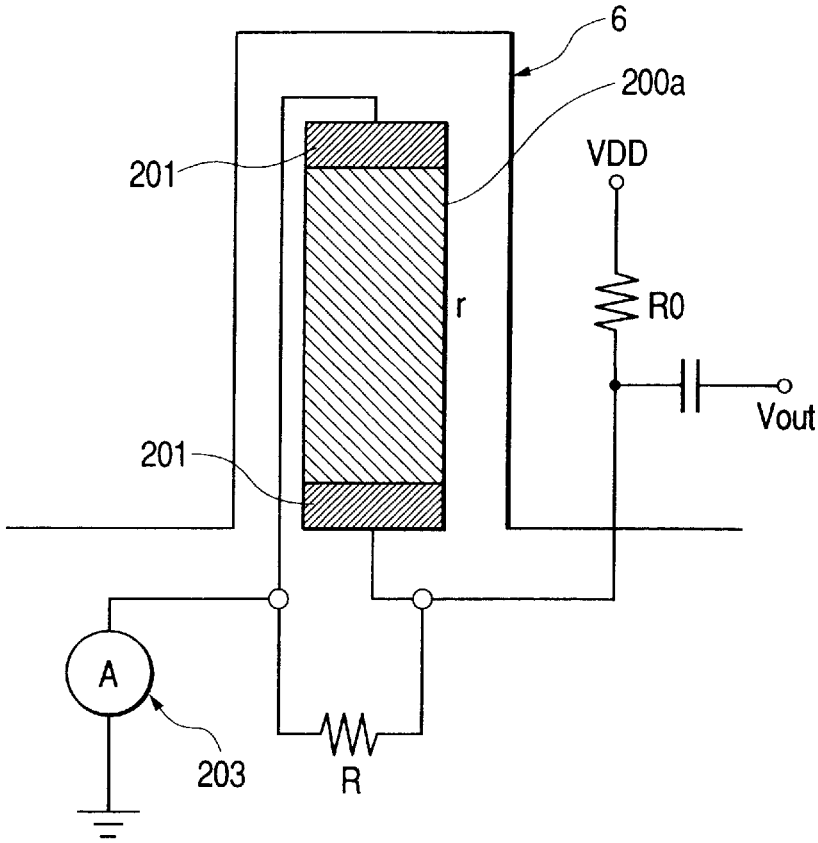
FIGS. 24A and 24B are circuit diagrams showing a sensor provided in the liquid discharge head according to the present invention.
Figure 24B:
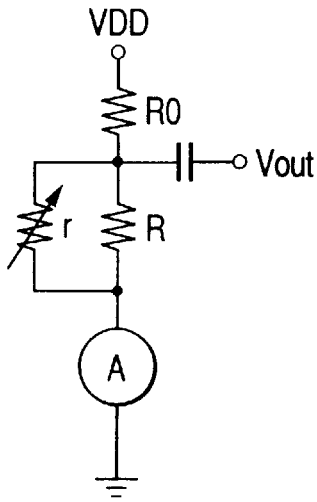

FIGS. 24A and 24B show a circuit for monitoring the output from the pressure sensor utilizing the polysilicon film. FIG. 24A shows a circuit for detecting output voltage of the pressure sensor of the movable member shown in FIGS. 19A, 19B and 20, and FIG. 24B is a schematic circuit diagram of FIG. 24A.

In FIGS. 24A and 24B, when it is assumed that a resistance value of the polysilicon film 200*a* is r in a normal condition, electric current i (=VDD/(R0+R×r(R+r)) flows through an ammeter 203. When the heat generating body (energy generating element) is energized to generate the bubble in the recording liquid, the movable member (valve) 6 and the polysilicon film 200*a* are displaced by pressure of the bubble. Since the polysilicon has a property in which a resistance value is increased substantially in proportion to its displacement amount, the resistance value r of the polysilicon film 200*a* is changed as the movable member 6 is displaced, with the result that the current value measured by the ammeter 203 is also changed accordingly. That is to say, on the basis of the change in current value, the displacement amount of the movable member 6, bubble pressure, discharge energy and pressure of the movable member directing rearwardly (toward the common liquid chamber) can be measured.

Further, in the circuit shown in FIGS. 24A and 24B, voltage of $V_{out}$ terminal is (VDD−i×R), and this voltage is also changed in accordance with the change in resistance value of the polysilicon film 200*a*. Thus, $V_{out}$ output is fed-back to the memory 49 (FIG. 23B) of the element substrate 3. In this case, in the drive signal control circuit 46, by effecting the switching and selection of the drive pulse and adjustment of the pulse width on the basis of the fed-back signal, the stable bubble pressure can always be obtained.

Figure 25:
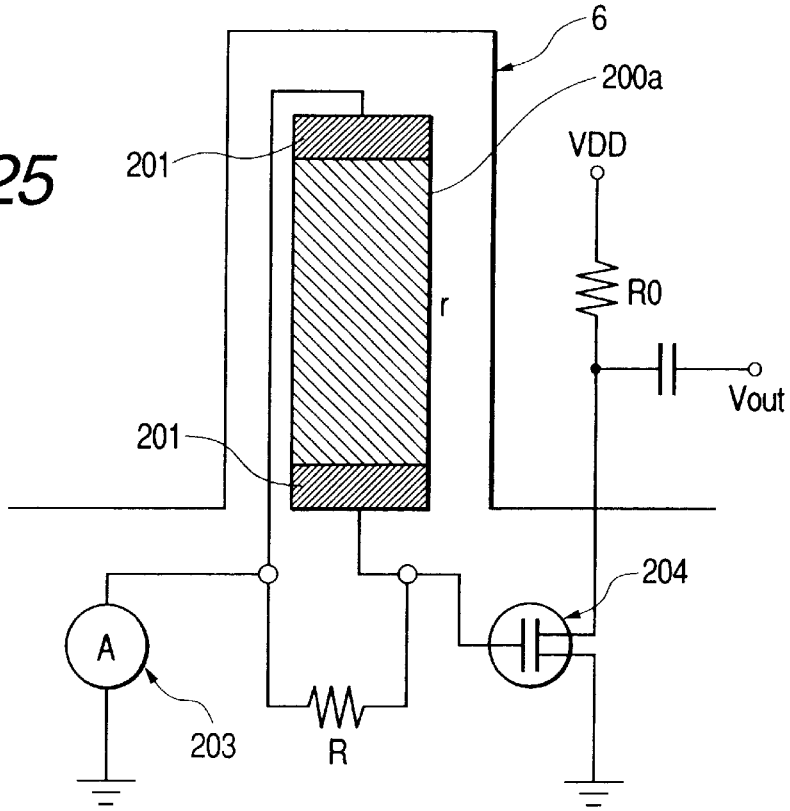
FIG. 25 is a circuit diagram showing a sensor provided in the liquid discharge head according to the present invention.

When the polysilicon film is used in the pressure sensor element as mentioned above, since the polysilicon has a property in which strain resistance thereof is changed in accordance with a temperature, in an example shown in FIG. 25, it is desirable to additionally provide a temperature sensor 204 for monitoring the temperature of the polysilicon film 200*a*. Namely, in FIG. 25, by supplying voltage VDD to the polysilicon film 200*a* through the temperature sensor 340, the change in property of the polysilicon film 200*a* due to change in temperature caused by the heat during the bubbling is compensated, with the result that the feed-back control can be effected more accurately.

Figure 26:
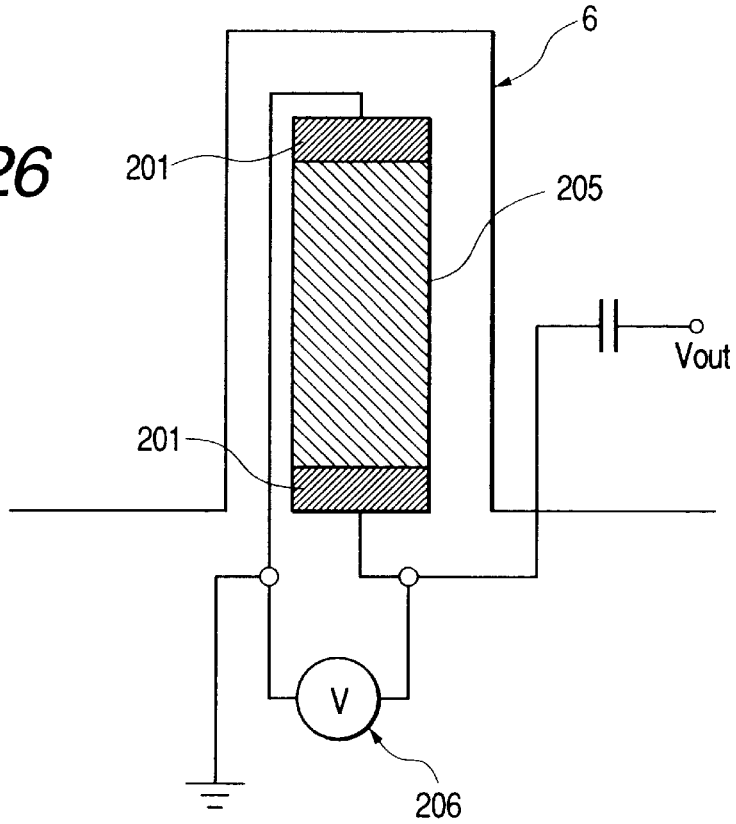
FIG. 26 is a circuit diagram showing a sensor provided in the liquid discharge head according to the present invention.

Further, when the piezo-electric element is used as the pressure sensor element, as is in a circuit shown in FIG. 26, by measuring an electromotive force generated by displacement of a pizeo-electric element 205 caused by the bubble pressure in the recording liquid, the displacement amount of the movable member 6 and the bubble pressure can be measured.

Further, in the circuit of FIG. 26, voltage at $V_{out}$ terminal is equal to the electromotive force of the piezo-electric element 205. Thus, $V_{out}$ output is fed-back to the memory 49 (FIG. 23B) of the element substrate 3. Also in this case, in the drive signal control circuit 46, by effecting the switching and selection of the drive pulse on the basis of the fed-back signal, the stable bubble pressure can always be obtained.

As mentioned above, even when the driving of the heat generating bodies 2 in order to obtain good image quality, if a bubble is generated in the common liquid chamber and it is shifted into the liquid flow path during the re-fill, inconvenience that the liquid cannot be discharged may arise, regardless of the presence of the liquid in the common liquid chamber.

To cope with this, it is preferable that a processing circuit in which, if abnormality of bubbling condition is detected by the pressure sensors of the movable members 6 in the liquid flow paths, abnormality result is outputted to a circuit for controlling a suction recovery operation (described later) be provided on the element substrate 1 or 3. And, on the basis of the output from the processing circuit, by forcibly sucking the liquid in the liquid discharge head through the discharge ports by means of ink suction means of a liquid discharge recording apparatus (described later), the bubbles in the liquid flow paths can be removed.

Next, detection of the bubbling condition using the pressure sensor and defect recovery operation will be explained with reference to FIGS. 27 and 28.

Figure 27:
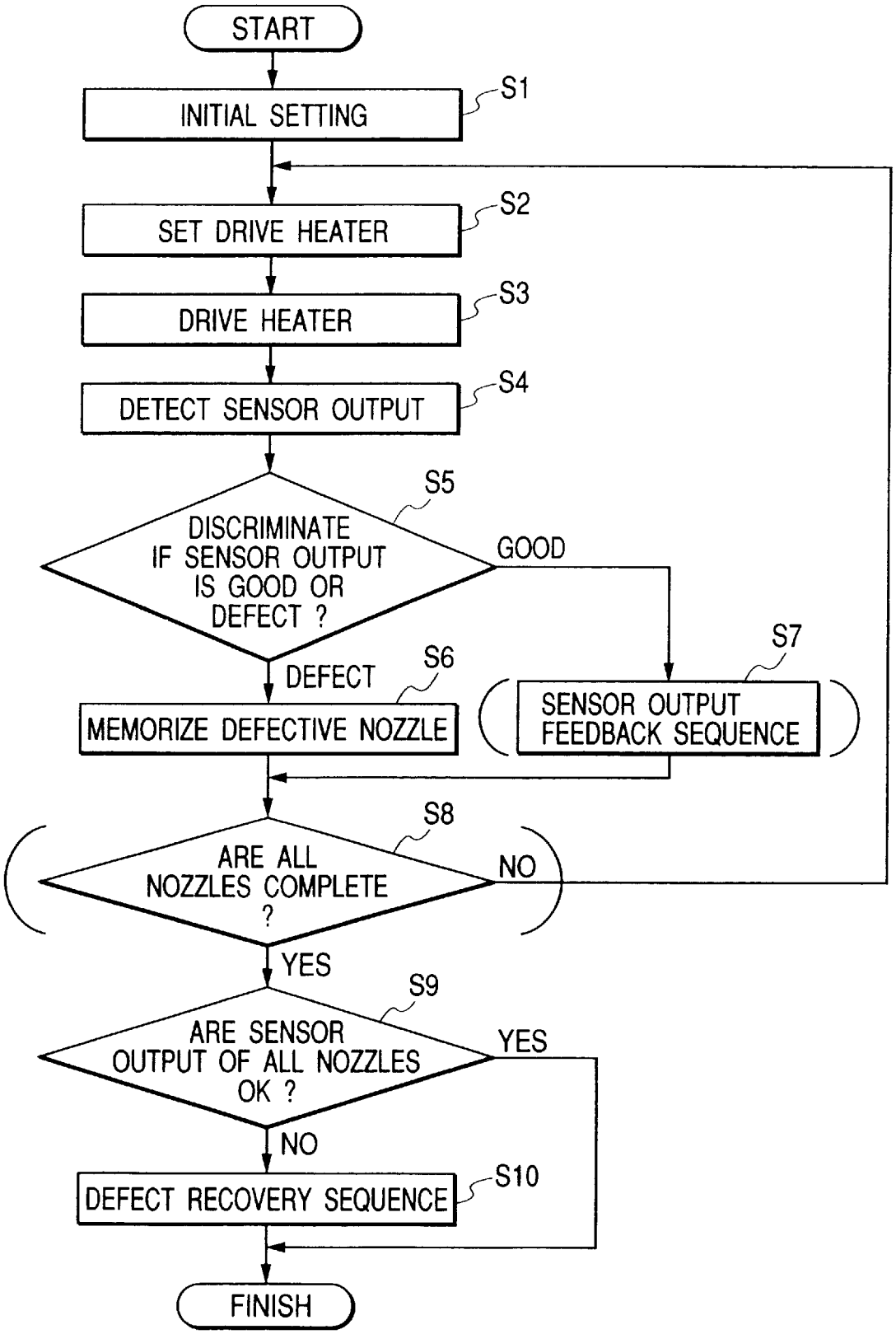
FIG. 27 is a flow chart for effecting discharge recovery by detecting a bubbling condition by a sensor in the liquid discharge head according to the present invention in a non-printing state.

FIG. 27 is a flow chart for explaining a control operation for detecting the abnormality of the bubbling condition and for effecting discharge recovery of the head in a non-printing state. The non-printing state means a preliminary discharge operation from a nozzle performed upon power-on of the recording apparatus or before printing after the recovery operation. As shown in FIG. 27, the heater (heat generating body 2) is driven in accordance with the set driving condition (steps S1 to S3). In this case, when the bubble is corrected generate on the surface of the heater, the movable member is displaced by the bubble pressure. Thus, good or defect of the bubbling condition can be judged by knowing whether or not the movable member is displaced in response to the driving of the heater, and magnitude of bubbling power can be known by the displacement amount of the movable member. After the heater is driven, output from the pressure sensor provided on the movable member is detected, and good or defect of the bubbling condition is judged on the basis of the output value (steps S4, S5).

If the bubbling condition is defective, i.e., discharge is defective, the defective nozzle is memorized (step S6). On the other hand, if there is no problem regarding the bubbling condition, the output value data from the pressure sensor is fed-back to the memory 49 shown in FIG. 23B, and, in the printing, the width of the pulse applied to the heat generating body 2 may be adjusted while referring the stored output value data in the drive signal control circuit 46 (step S7).

The operations in steps S1 to S7 are repeated for all of the nozzles (step S8). Incidentally, in this example, while the bubbling conditions of the respective nozzles were successively judged by the sensors, the bubbling condition of the plural nozzles may be judged.

After the bubbling conditions of all of the nozzles are judged, it is judged whether sensor outputs of all nozzles are good or defective, i.e., there is defective nozzle or not (step S9). Other than a case where sensor outputs of all nozzles are good, the suction recovery operation of the apparatus is effected for nozzles (described later) (step S10).

In this way, the bubbling condition detecting sequence in the non-printing state is completed.

Figure 28:
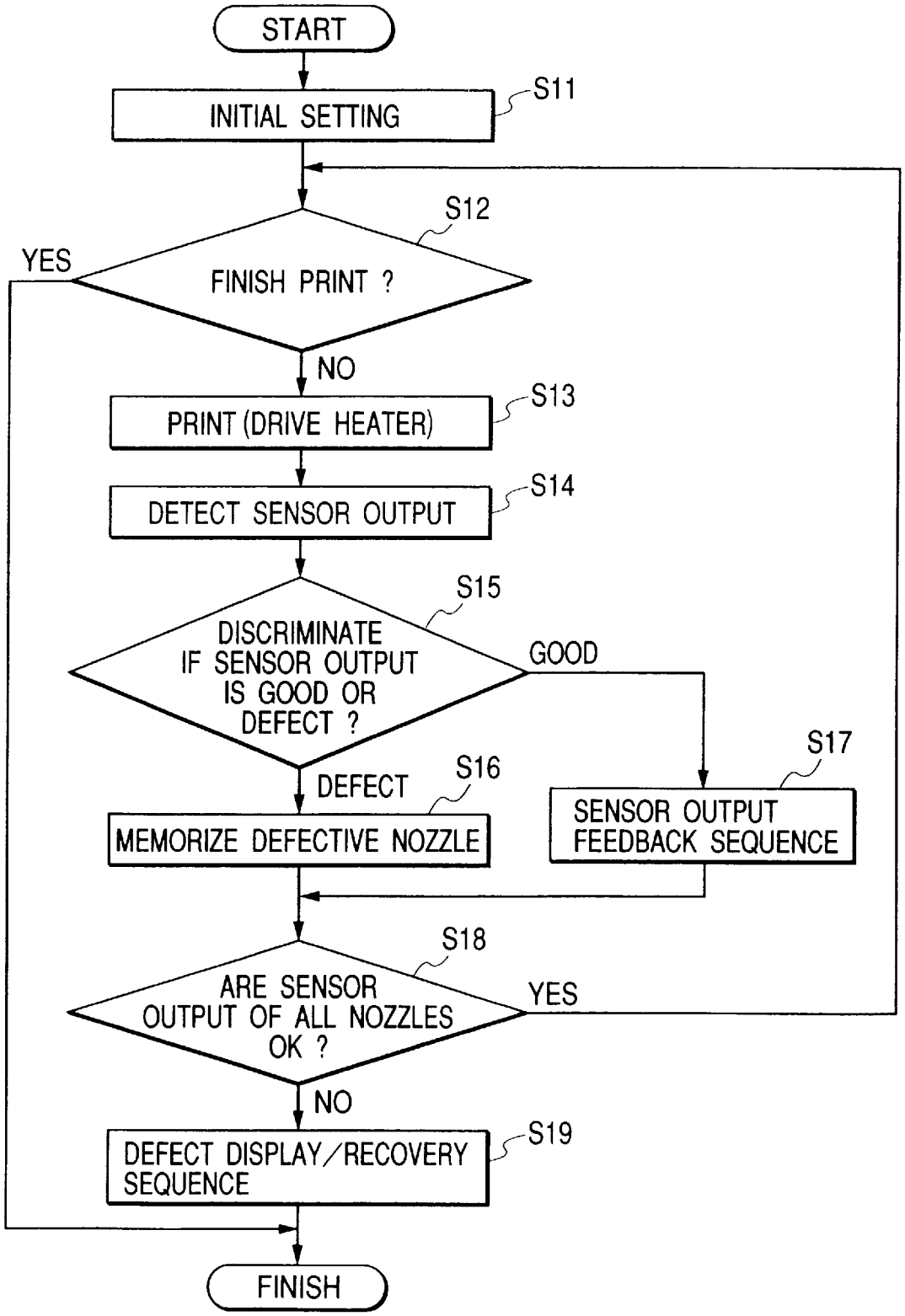
FIG. 28 is a flow chart for effecting discharge recovery by detecting a bubbling condition by a sensor in the liquid discharge head according to the present invention in a printing state.

On the other hand, FIG. 28 is a flow chart for explaining a control operation for detecting the abnormality of the bubbling condition and for effecting discharge recovery of the head in a printing state. As shown in FIG. 28, the heater (heat generating body 2) is driven in accordance with the set driving condition and the printing is effected (steps S12 to S13), until print command based on the predetermined image data is finished. After the heater is driven, similar to the sequence shown in FIG. 27, output from the pressure sensor provided on the movable member is detected, and good or defect of the bubbling condition is judged on the basis of the output value (steps S14, S15).

If the bubbling condition is defective, i.e., discharge is defective, the defective nozzle is memorized (step S16). On the other hand, if there is no problem regarding the bubbling condition, the output value data from the pressure sensor is fed-back to the memory 49 shown in FIG. 23B, and, the width of the pulse applied to the heat generating body 2 for next printing is adjusted while referring the stored output value data in the drive signal control circuit 46 (step S17).

After the bubbling conditions of all of the nozzles are judged, it is judged whether sensor outputs of all nozzles are good or defective, i.e., there is defective nozzle or not (step S18). Other than a case where sensor outputs of all nozzles are good, the suction recovery operation of the apparatus is effected (described later).

In this way, the bubbling condition detecting sequence in the printing state is completed.

(Third Embodiment)

A third embodiment of the present invention relates to a head in which movable members are provided in nozzles and dynamic viscosity of the liquid in the liquid flow paths is guessed by detecting strain during the displacement of the movable members, thereby adjusting the driving conditions of the heat generating elements. According to this arrangement, a recording head and a recording apparatus, in which dynamic viscosity of the liquid in each nozzle is monitored and liquid droplet discharge associated with each heat generating element can be stabilized can be provided.

More specifically, in a liquid discharge head wherein, in first and second substrates joined together to define a plurality of liquid flow paths communicated with a plurality of corresponding discharge ports for discharging liquid, there are provided a plurality of energy generating elements disposed in the respective liquid flow paths to generate discharge energy for discharging the liquids from the discharge ports, and a plurality of elements or circuits having different functions and adapted to control driving conditions of the energy generating elements, and movable members arranged in the respective liquid flow paths are further provided, the liquid discharge head further includes strain gauges provided on the movable members, and a circuit portion for reading output voltages detected by the strain gauges.

Further, this embodiment relates to a liquid discharge recording apparatus having the above-mentioned liquid discharge head and in which the energy generating elements are driven while adjusting the energy generating elements on the basis of the output voltages obtained in the circuit portion, thereby effecting the recording by discharging the liquid onto a recording medium.

In the above-mentioned arrangement, since the movable members having the strain gauges are disposed in the liquid flow paths, displacement amounts of the movable members can be measured electrically on the basis of change in resistance of the strain gauges. Particularly, a dynamic viscous force of the liquid and a temperature factor governing the dynamic viscous force can be guessed from the distorted amount of the movable member in the liquid, and, by adjusting the driving condition of the energy generation element on the basis of the guessed result, the discharge property can be stabilized.

Now, the third embodiment will be described with reference to the accompanying drawings.

Figure 29A:
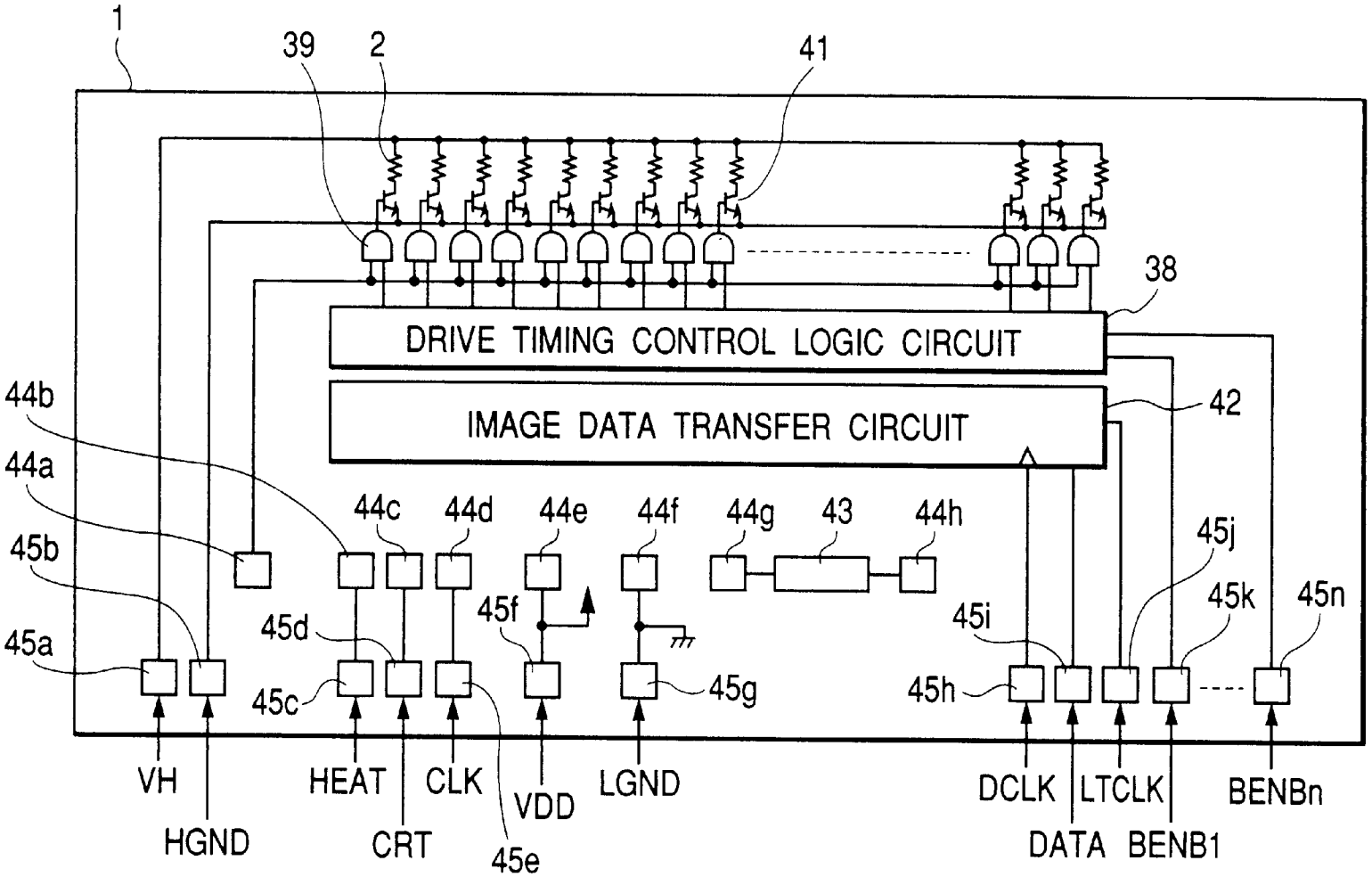
FIGS. 29A and 29B are views for explaining a circuit arrangement of the liquid discharge head shown in FIG. 1, where
Figure 29B:
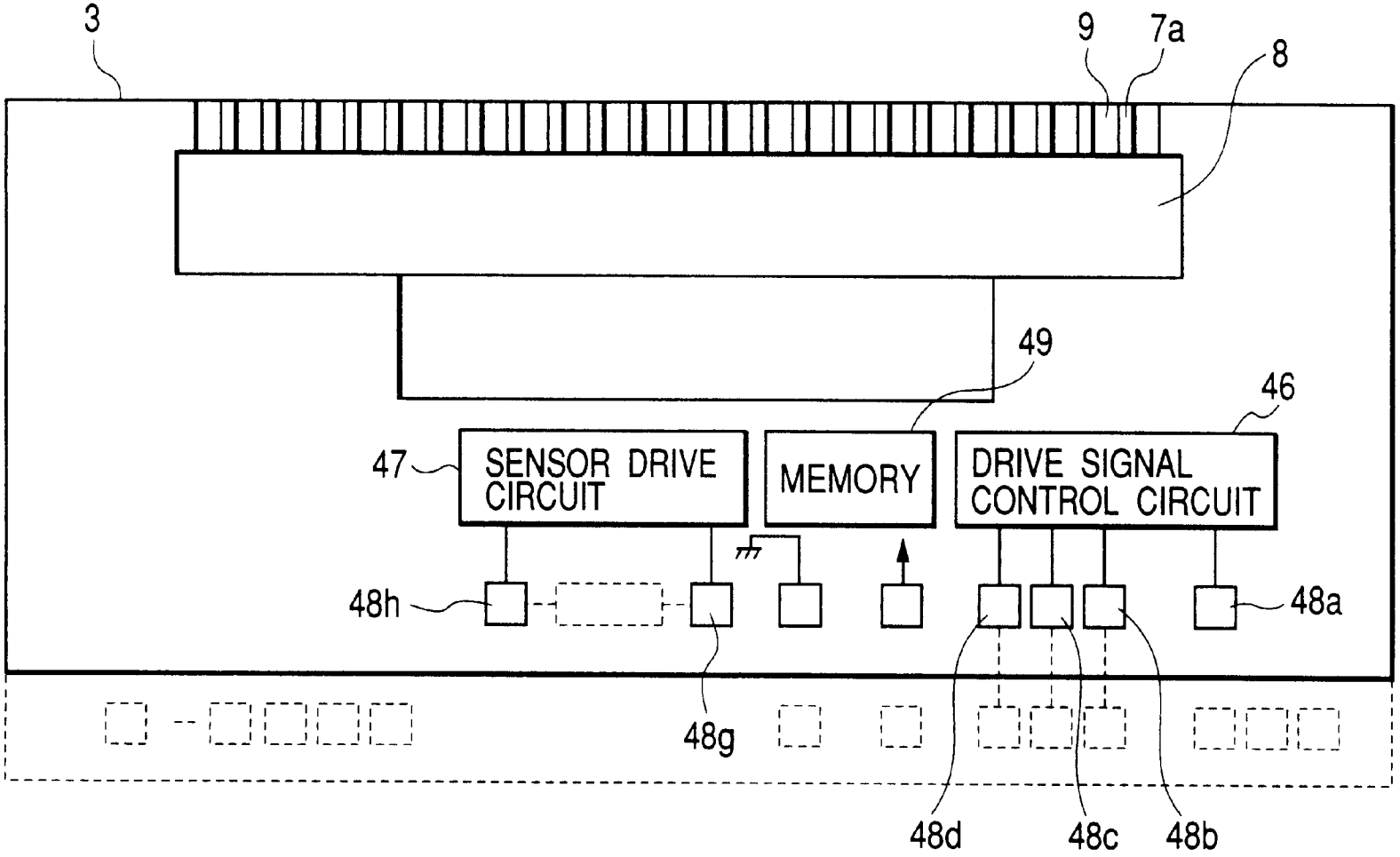

FIGS. 29A and 29B show an example of circuit arrangements of a element substrate 1 and a element substrate 3 in which output voltage signals detected by the strain sensors provided on the movable members are calculated to control energy applied to the heat generating bodies.

In FIG. 29A, the element substrate 1 includes a plurality of heat generating bodies (discharge heaters) 2 arranged in a line, power transistors 41 acting as drivers, AND circuits 39 for controlling the driving of the power transistors 41, a drive timing control logic circuit 38 for controlling the drive timings of the power transistors 41, an image data transfer circuit 42 constituted by a shift register and a latch circuit, and a rank heater 43 for the discharge heaters 2.

The drive timing control logic circuit 38 serves to energize the heat generating a bodies 2 in a time-lapse manner (not energize the heat generating bodies 2 simultaneously) for reducing power supply capacity of the apparatus, and an enable signal for driving the drive timing control logic circuit 38 is inputted from equal signal input terminals 45*k* to 45*n* which are external contact pads.

Further, as external contact pads provided on the element substrate 1, there are provided an input terminal 45*a* for a drive power supply for the heat generating bodies 2, grounding terminal 45*b* for the power transistors 41, input terminals 45*c* to 45*e* for signal required for controlling energy driving the heat generating bodies 2, a drive power supply terminal 45*f* for the logic circuit, a grounding terminal 45*g*, an input terminal 45*i* for serial data inputted to the shift register of the image data transfer circuit 42, an input terminal 45*h* for a serial clock signal synchronous with this, and an input terminal 34*j* for a latch clock signal inputted to the latch circuit, as well as enable signal input terminals 45*k* to 45*n*.

On the other hand, as shown in FIG. 29B, in the element substrate 3 as a top plate, there are formed a sensor drive circuit 47 for driving strain sensors (not shown) on the movable members 6, a drive signal control circuit 46 for monitoring the output from the strain sensors and for controlling energy supplied to the heat generating bodies on the basis of results from the sensors, and a memory 49 for storing output value data detected by the sensors or code values ranked from the output values and pre-measured liquid discharge amount properties for heat generating bodies 2 (liquid discharge amounts when predetermined pulse is applied under a given temperature) as head information and for outputting such information to the drive signal control circuit 46.

Further, as connection contact pads, on the element substrate 1 and the top plate 3, there are provided terminals 44*g*, 44*h* and 48*g*, 48*h* for connecting the rank heater 43 for discharge heaters to the sensor drive circuit 47, terminals 44*b* to 44*d* and 48*b* to 48*d* for connecting the input terminals 45*c* to 45*e* for signals required to control the energy for driving the heat generating bodies 2 externally to the drive signal control circuit 46, and a terminal 48*a* for inputting output of the drive signal control circuit 46 to one of terminals of the AND circuits 39.

Figure 30A:
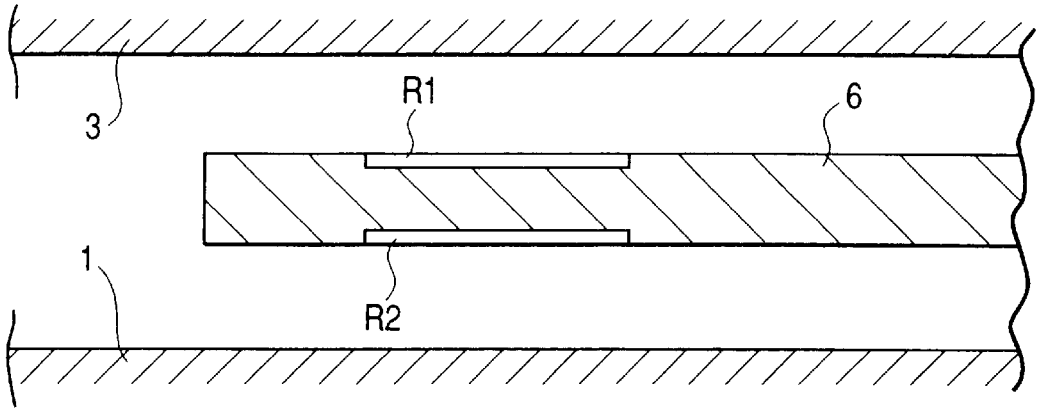
FIGS. 30A and 30B are sectional views showing a sensor provided in the liquid discharge head according to the present invention.
Figure 30B:
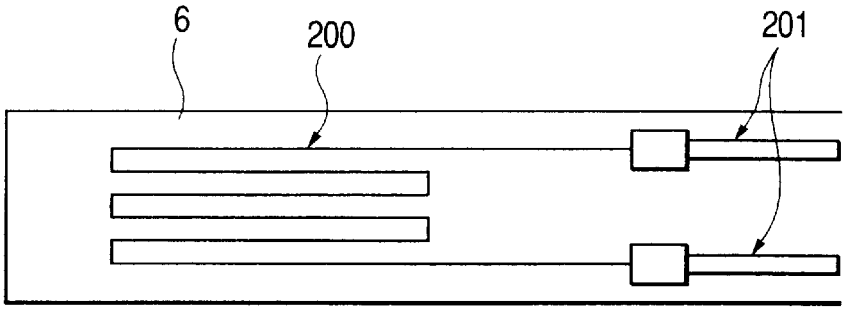

Regarding an arrangement as mentioned above, FIGS. 30A and 30B show a structure in which strain gauges (elements for converting distortion of the movable member into change in electrical resistance) is incorporated into the movable member. FIG. 30A is a sectional view showing one nozzle, taken along a direction of a liquid flow path thereof, and FIG. 30B is a plan view of the movable member. As shown in FIG. 30A, strain gauges R1, R2 are provided on surface layers of the movable member 6 near the top plate 3 and near the heater board 1, respectively. For example, as shown in FIG. 30B, in these strain gauges R1, R2, a fine polysilicon resistance line or wire 200 is formed on the movable member 6 made of SiN, and both ends of the resistance wire are connected to lead electrodes 201.

The fundamental principle of the strain gauge is as follows. First of all, when it is assumed that a length of one resistance rod is L [m] and a cross-sectional area thereof is S [$m^2$], a total resistance value R [Ω] is represented by the following equation:

$$R=\rho L/S$$

Where, ρ is resistivity [Ω·m]. When the resistance body is pulled by deformation of an object to be measured, the resistance wire is extended. As a result, the length is increased to L+ΔL, and the resistance is increased. In this case, the cross-sectional area is decreased to S−ΔS and the resistivity is changed from ρ to ρ'. A relationship between increased amount ΔR of resistance and increased amount ΔL of the length becomes as follows:

$$R+\Delta R=\rho'\times(L+\Delta L)/(S-\Delta S)\cong\rho\times L/S+\{\rho'/(S-\Delta S)\}\times\Delta L$$

Accordingly, $$\Delta R/R=(\rho'/\rho)\times\{S/(S-\Delta S)\}\times(\Delta L/L)=Kg\times(\Delta L/L)$$

Here, influence of the change in resistivity and cross-sectional area is represented by constant coefficient Kg. This coefficient Kg (change in resistance to distortion) is called as gauge factor.

Figure 31:
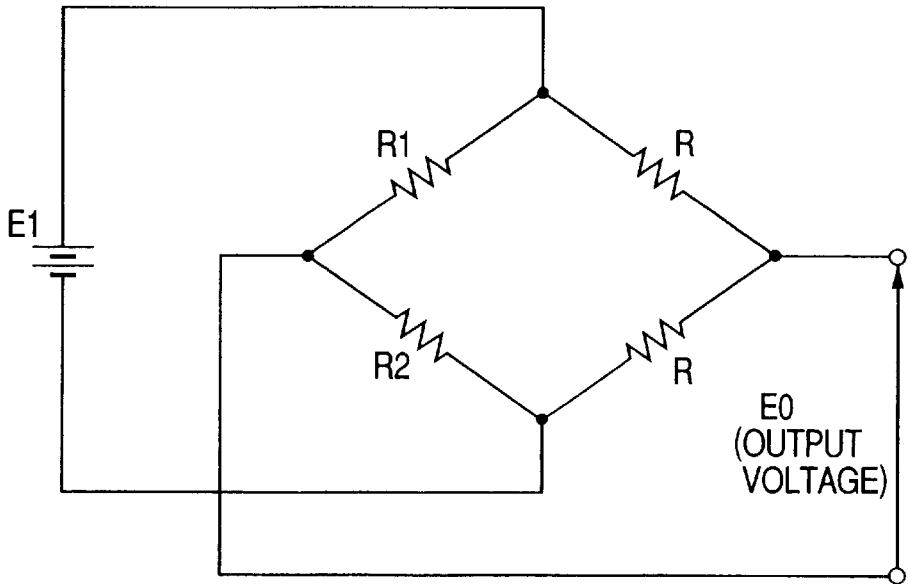
FIG. 31 is a view showing a bridge circuit for converting resistivity change of strain gauges as the sensor shown in FIG. 30 into voltage.

FIG. 31 shows a bridge circuit for converting the change in resistivity into voltage by using the strain factor. As shown in FIGS. 30A, 30B and 31, when it is assumed that resistance values are R, R1, R2 [Ω] and input voltage is E1 [V], output voltage E0 [V] is represented as follows:

$$E0=(R1\times R-R2\times R)/\{(R1+R)(R2+R)\}\times E1$$

Here, since, regarding R1 and R2, the same resistance wires are used, R1=R2=r is established, and, by distortion, R1 is changed to r+Δr and R2 is changed to r−Δr. Thus, the following relationship is obtained:

$$E0=\{R\times 2\Delta r/\{(R+r)2-\Delta r2)\}\}\times E1$$

Here, since distortion amount is minute and change in resistivity is negligible with respect to the initial resistance, $$E0=\{R\times 2\Delta r/(R+r)2\}\times E1$$

Here, if R≅r, $$E0=(½)\times(\Delta r/r)\times E1$$

is established. Thus, in the small change, the output voltage is proportional to the resistance change Δr, and the voltage proportional to the distortion (Δr/r) can be obtained.

For example, in case of polysilicon resistance wire having initial resistance value of 10 [Ω], when the gauge factor is about 100 and distortion amount is 50 [μm], the change amount Δr of the resistance value becomes as follows:

$$\Delta r=10\ [\Omega]\times 50\times 10^{-6}\times 100=50\ [\Omega].$$

When the input voltage E1 is 10 [V], the output voltage 0 becomes 25 [mV].

In this way, by detecting the output voltage E0, the distortion amount of the movable member 6 itself can be measured. Particularly, the dynamic viscous force of the liquid and the temperature factor governing the dynamic viscous force can be guessed from the distortion amount of the movable member in the liquid, and, thus, by adjusting the pulse width and pulse shape applied to the heat generating element, the discharge property can be stabilized.

Further, since the dynamic viscosity of the liquid can be guessed, amounts of the bubble and pressure wave generated by the heat generating element which are to be distributed to nozzle forward (toward the discharge port) and nozzle rearward (toward the common liquid chamber) can be detected. By controlling the pulse width and pulse shape applied to the heater generating element on the basis of the distributed amounts, the stable discharge can always be maintained.

(Fourth Embodiment)

In a fourth embodiment of the present invention, viscosity sensors are provided in the liquid flow paths.

In a liquid discharge head filled with liquid including moisture, if the discharge is not carried out for a long term, moisture in the liquid stayed in the discharge ports and therearound is vaporized to increase viscosity of the liquid, with the result that there may exist dispersion in discharge amounts of liquid discharged from the discharge ports or the liquid may be adhered to the discharge ports to cause defective discharge. Further, due to change in dye (pigment) density, quality of an image formed on the recording medium may be worsened.

In the past, the control of the discharge amount was effected on the basis of the temperature of the element substrate including the electrical/thermal converters and/or an environmental temperature. Further, in order to prevent the defective discharge, preliminary discharge as discharge recovery operation has been performed. The preliminary discharge serves to recover the discharge property in such a manner that, for example, in a home position of the liquid discharge head, by supplying the normal head drive signal to the liquid discharge head to discharge, by several times, the liquid toward a light absorbing body opposed to the liquid discharge head thereby to recover the drying of the surface of the liquid discharge head and to discharge old liquid in the discharge ports.

It is well known that chronic defective printing after long term disposition is caused by increase in viscosity of the liquid and/or adhesion of the liquid. In the conventional techniques, the discharge recovery operation was set in accordance with the factors controlling the increase in density of the liquid on the basis of the temperature of the element substrate and/or environmental temperature. Further, in a conventional liquid discharge head having relative great discharge amount such as 360 dpi, in order to suppress dispersion in ink discharge amounts due to increase in viscosity of ink and defective discharge due to ink adhered to the discharge ports, regardless of printing condition and non-printing condition, after a predetermined time period is elapsed or a predetermined number of sheets are printed, the discharge recovery operation has been effected automatically for all of the discharge ports.

However, as the recording density is increased, the discharge amount of liquid becomes small, and further, the size of the energy generating means also becomes small, and further, the size of the energy generating means also becomes small, with the result that discharge energy generated by the energy generating means becomes fewer. On the other hand, although the increase in viscosity of liquid due to reduction of moisture in liquid becomes small as the diameter of the discharge port becomes small, the discharge energy becomes more fewer, with the result that, whenever the scanning is effected, preliminary discharge may be pre-formed.

Further, when the viscosities of respective liquids in the plural liquid flow paths formed in the liquid discharge head are not directly measured, but the viscosities of respective liquids in the liquid flow paths are represented by one measured value such as the temperature of the element substrate or the environmental temperature and the viscosities are measured indirectly, great margin should be required. That is to say, in order to discharge the desired amounts of liquid from all of the plural discharge ports formed in the liquid discharge head, excessive preliminary discharge may be performed, thereby worsening through-put and consuming excessive liquid.

In consideration of the above, this embodiment has a purpose for providing a liquid discharge head and a liquid discharge apparatus using such a liquid discharge head in which through-put is improved and includes viscosity detection sensors disposed in the respective liquid flow paths and adapted to detect viscosities of liquids in the liquid flow paths, and discharge control means for applying drive pulses based on outputs from the viscosity detection sensors to be energy generating elements.

In the liquid discharge head according to the present invention having the above-mentioned arrangement, the viscosity detection sensors for directly detecting the viscosities of liquids in the light flow paths are provided, and, since the drive pulses are applied to the energy generating elements on the basis of the outputs from the viscosity detection sensors, the number of preliminary discharges for each liquid flow path can be controlled in accordance with the viscosity of the liquid in the preliminary discharge.

The viscosity detection sensor may comprise a set of electrodes contacted with the liquid in the liquid flow path, and each electrode may be provided on an end (near the discharge port) of the energy generating element provided in the element substrate having the liquid flow path into which the liquid is supplied from the upstream side and which is communicated with the discharge port at the downstream side.

Further, in the liquid discharge head according to the present invention, the energy generating element serves to generate the bubble in the liquid by applying thermal energy to the liquid, and the movable member having a free end at the downstream side (toward the discharge port) and opposed to the corresponding energy generating element is provided in the corresponding liquid flow path, and t least one of the electrodes may be provided on the movable member.

Further, at least one of the electrodes may be provided on a wall surface facing the liquid in the corresponding liquid flow path of the top plate, or at least one of the electrodes may be provided on a wall surface facing the liquid in the corresponding liquid flow path of the element substrate.

Further, the discharge control means may serve to the number of drive pulse applying times or may serve to control the pulse width of the drive pulse or may serve to control the pulse widths of the drive pulses applied to the energy generating means so that the liquid discharge amounts from the discharge ports become substantially the same, or the discharge control means may be provided in the element substrate and may serve to supply a drive signal to a thermal insulation heater for heating the liquids in all of the liquid flow paths.

Further, the liquid discharge apparatus according to the present invention comprises convey means for conveying a recording medium, and holding means for holding the liquid discharge head of the present invention for effecting the recording on the recording medium and capable of shifting in a direction transverse to a conveying direction of the recording medium.

The liquid discharge apparatus according to the present invention may comprise recovery means effecting recovery operation for sucking the liquid in the liquid discharge head in response to the output signal from the viscosity detection sensor.

(Fifth Embodiment)

Now, detailed explanation will be made, with reference to the accompanying drawings, regarding a liquid discharge head according to a fifth embodiment of the present invention, comprising a plurality of discharge ports for discharging liquid, first and second substrates for forming a plurality of liquid flow paths communicated with the respective discharge ports by joining these substrates together, a plurality of energy converting elements disposed within the respective liquids flow paths to convert electrical energy into discharge energy for liquids in the liquid flow paths, a viscosity detecting portion for detecting viscosities in the liquid flow paths, and a plurality of elements or electric circuit having different function and adapted to control driving conditions of the energy converting elements, and wherein the elements or the electric circuits are shared into the first and second substrates in accordance with their functions. Incidentally, in the illustrated embodiment, the liquid includes components such as moisture which is apt to be vaporized.

Figure 32:
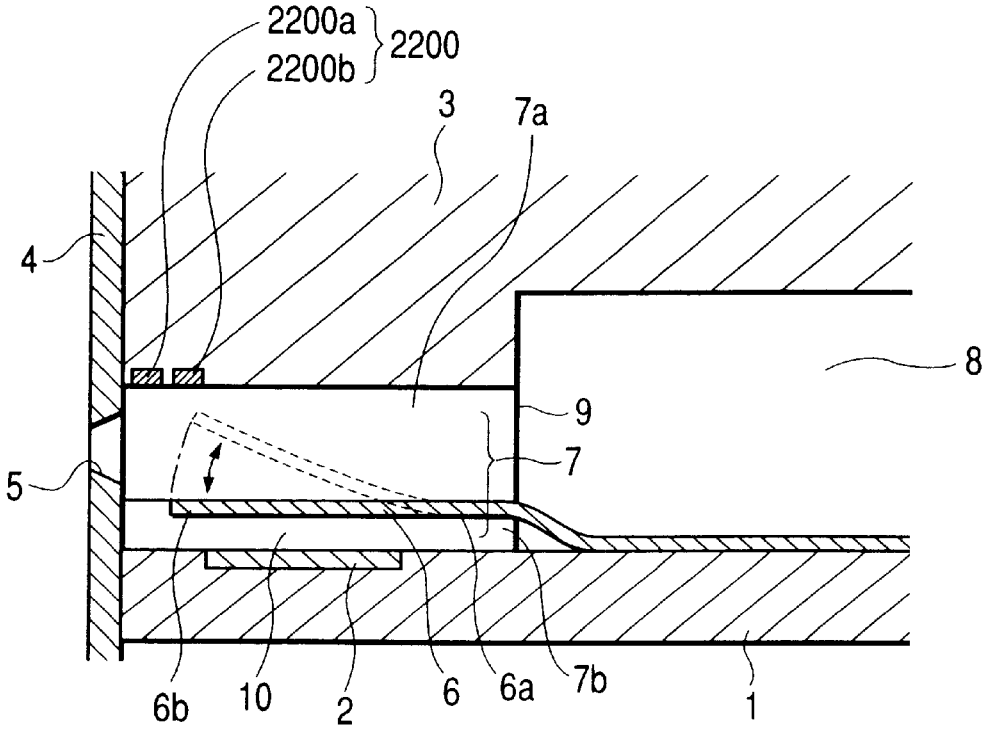
FIG. 32 is a sectional view for explaining a structure of a liquid discharge head according to a first embodiment of the present invention, taken along a direction of a liquid flow path thereof.
Figure 33:
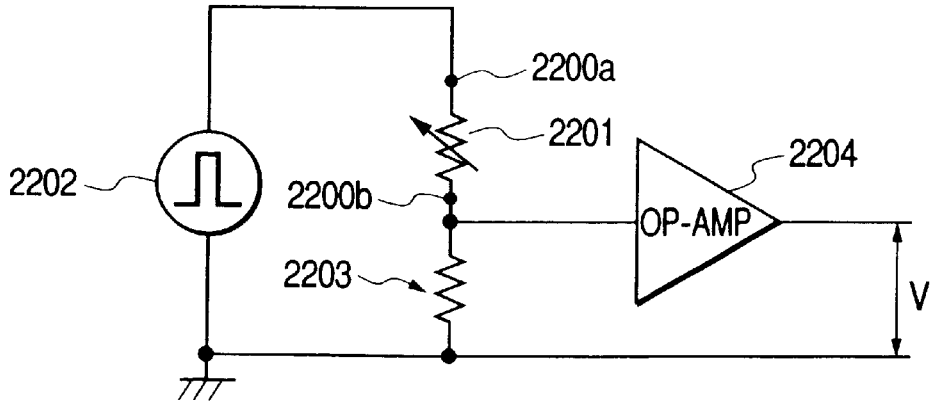
FIG. 33 is a view for explaining a viscosity measuring circuit of a viscosity sensor.

FIG. 32 is a sectional view of a liquid discharge head according to the illustrated embodiment, taken along a direction of a liquid flow path thereof, and FIG. 33 is a schematic view of a viscosity measuring circuit connected to electrode provided in a top plate.

As shown in FIG. 32, the liquid discharge head comprises an element substrate 1 on which a plurality of discharge heaters 2 for providing thermal energy for generating bubbles in the liquid are arranged in parallel, a top plate 3 joined to the element substrate 1 and having electrodes 2200*a,* 2200*b* for a viscosity sensor 2200, and an orifice plate 4 joined to front end faces of the element substrate 1 and the top plate 3.

The element substrate 1 is constituted by forming silicon oxide film or silicon nitride film for insulation and regeneration onto a silicon substrate and by patterning electrical resistive layers and wirings constituting the discharge heaters 2 on the substrate. By applying electric current to the electrical resistive layers from the wirings, the discharge heaters 2 emit heat.

The top plate 3 defines the plurality of liquid flow paths 7 corresponding to the discharge heaters 2 and a common liquid chamber 8 for supplying the liquid to the liquid flow paths 7. To this end, liquid path side walls 9 extending from a ceiling portion to portions between the discharge heaters 2 are integrally formed with the top plate. The top plate 3 is formed from silicon material, and patterns of the liquid flow paths 7 and the common liquid chamber 9 may be formed by etching or, after material constituting the liquid path side walls 9 such as silicon nitride or silicon oxide is deposited on the silicon substrate by a known film forming method such as CVD, portions corresponding to the liquid flow paths 7 may be formed by etching.

The electrodes 2200*a,* 2200*b* contacted with the liquid and constituting the viscosity sensor 2200 for measuring the viscosity of the liquid in a first liquid flow path 7*a* are provided on the surface of the top plate 3 in the vicinity of the discharge ports 5 in parallel along a flowing direction. The viscosity sensor 2200 has a viscosity measuring circuit shown in FIG. 33. The viscosity measuring circuit includes a resistance 2203 for giving a resistance value as a reference, and an OP-amplifier 2204 having a buffer function. Resistance of the liquid 2201 is liquid resistance variable with viscosity of the liquid between the electrodes 2200*a* and 2200*b*. The viscosity measuring circuit outputs output voltage V outputted when input pulse voltage 2202 applied from a viscosity sensor drive circuit 47 (FIG. 36) (described later) is changed changed by the resistance value of the resistance 2201, i.e., viscosity of the liquid. Since the viscosity sensors 2200 are simultaneously formed by the semiconductor process when the top plate 3 is formed, there is almost no dispersion in properties between the viscosity sensors 2200 in the respective liquid flow paths 7. Incidentally, since the viscosity is apt to be increased due to evaporation of moisture in the liquid particularly in the vicinity of the discharge port 5, the electrodes 2200*a,* 2200*b* are arranged in the vicinity of the discharge port 5 in order to measure the viscosity of the liquid in the vicinity of the discharge port 5. Further, it is further desirable that the electrodes 2200*a,* 2200*b* be located at a downstream side of a downstream end face of the discharge heater 2. The orifice plate 4 is provided with a plurality of discharge ports 5 communicated with the common liquid chamber 9 through the liquid flow paths 7. The orifice plate 4 is also formed from silicon material and may be formed, for example, by cutting a silicon substrate with the discharge ports 5 formed therein into a plate having a thickness of about 10 to 150 $\mu$m. Incidentally, the orifice plate 4 is not inevitable for the present invention. Thus, in place of the orifice plate 4, a wall having a thickness corresponding to that of the orifice plate 4 may be left at a front end face of the top plate 3 when the liquid flow paths 7 are formed in the top plate 3 and the discharge ports 5 may be formed in such a wall, thereby providing a top plate with discharge ports.

Each movable member 6 is a thin membrane formed from silicon material such as silicon nitride or silicon oxide and cantilever-supported so that it is opposed to the corresponding discharge heater 2 and it divides the corresponding liquid flow path 7 into a first liquid flow path 7*a* communicating the liquid flow path 7 with the discharge port 5 and a second liquid flow path 7*b* including the discharge heater 2.

The movable member 6 has a fulcrum 6*a* at an upstream side of great liquid flow (caused by the liquid discharge operation) flowing from the common liquid chamber 8 to the discharge port 5 through the movable member 6 and a free end 6*b* at a downstream side of the fulcrum 6*a* and is spaced apart from the discharge heater 2 by a predetermined distance to be opposed to the discharge heater 2. A bubble generating area 10 is defined between the discharge heater 2 and the movable member 6.

Further, the liquid discharge head according to the illustrated embodiment has circuits and elements for driving the discharge heaters 2 and for controlling the driving of the heaters. These circuits and elements are shared into the element substrate 1 and the top plate 3 in accordance with their functions. Further, since the element substrate 1 and the top plate 3 are formed from silicon material, these circuits and elements can be formed by using the semiconductor wafer process easily and minutely.

Next, arrangement of the circuits and elements to the element substrate 1 and the top plate 3 will be explained.

Figure 34A:
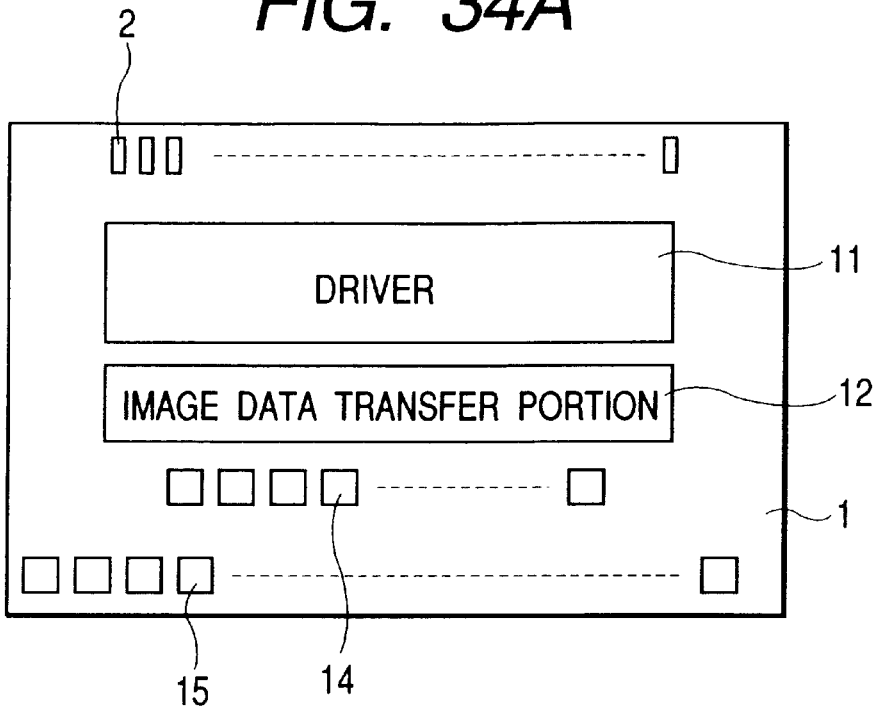
FIGS. 34A and 34B are views for explaining a circuit arrangement of the liquid discharge head shown in FIG. 32, where
Figure 34B:
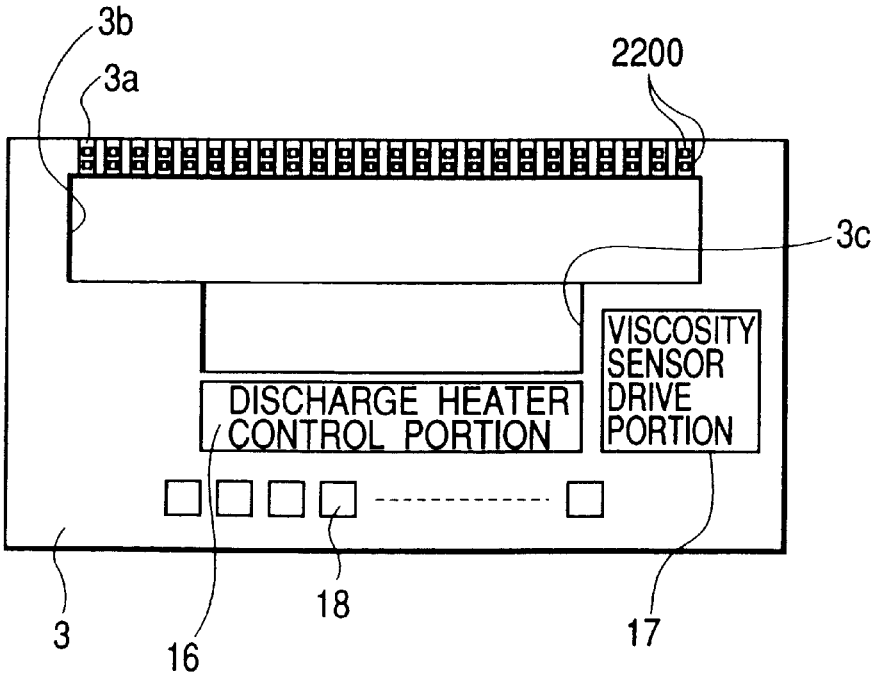

FIGS. 34A and 34B are views for explaining a circuit arrangement of the liquid discharge head shown in FIG. 1, where FIG. 34A is a plan view of the element substrate and FIG. 34B is a plan view of the top plate. Incidentally, FIGS. 34A and 34B illustrate opposite surfaces.

As shown in FIG. 34A, the element substrate 1 includes the plurality of discharge heaters 2 arranged in parallel, a driver 11 for driving the discharge heaters 2 in accordance with image data, and an image data transfer portion 12 for outputting the inputted image data to the driver 11.

The image data transfer portion 12 includes a shift register for outputting the image data inputted in serial to the drivers 11 in parallel, and a latch circuit for temporarily storing the data outputted from the shift register. Incidentally, the image data transfer portion 12 may be designed to output the image data in correspondence to the respective discharge heaters 2 or may be designed to output the image data to each block when the discharge heaters 2 are divided into a plurality of blocks. Particularly, by providing a plurality of shift registers in a single head so that data transferred from a recording apparatus is shared into the plurality of shift registers, a printing speed can easily by increased.

On the other hand, as shown in FIG. 34B, in the top plate 3, in addition to the fact that grooves 3*a,* 3*b* defining the liquid flow paths and the common liquid chamber are formed as mentioned above, there are provided viscosity sensors 2200 for measuring the viscosities of the liquid in the first liquid flow paths 7*a,* a viscosity sensor driving portion 17 for driving the viscosity sensors 13, and a discharge heater control portion 16 for controlling the driving conditions of the discharge heaters 2 on the basis of the detection results from the sensors driven by the viscosity sensor driving portion 17. Incidentally, the top plate 3 is provided with a supply port 3*c* through which liquid is supplied to the common liquid chamber from an external source and which is communicated with the common liquid chamber.

Further, connection contact pads 14, 18 for electrically connecting circuits formed in the element substrate 1 to circuits formed in the top plate 3 are formed on corresponding portions of the interface between the element substrate 1 and the top plate 3. Further, the element substrate 1 is provided with external contact pads 15 as input terminals for external electric signal. The dimension of the element substrate 1 is greater than that of the top plate 3, and the external contact pads 15 are exposed from the top plate 3 when the element substrate 1 is joined to the top plate 3.

Here, an example of formation of circuits and the like on the element substrate 1 and the top plate 3 will be explained.

Regarding the element substrate 1, first of all, circuits constituting the driver 11 and the image data transfer portion 12 are formed on a silicon substrate by using the semiconductor wafer process technique. Then, the discharge heaters 2 are formed as mentioned above, and, lastly, the connection contact pads 15 and the external contact pads 15 are formed.

Regarding the top plate 3, first of all, the discharge heater control portion 16, viscosity sensors 2200 and a circuit constituting the viscosity sensor drive portion 17 are formed on a silicon substrate by using the semiconductor wafer process technique. Then, as mentioned above, the grooves 3*a*, 3*b* constituting the liquid flow paths and the common liquid chamber and the supply port 3*c* are formed by the film forming technique and the etching, and, lastly, the connection contact pads 18 are formed.

When the element substrate 1 and the top plate 3 constructed as mentioned above are aligned and joined, the discharge heaters 2 are positioned in correspondence to the respective liquid flow paths and the circuits formed on the element substrate 1 and the top plate 3 are electrically interconnected via the connection pads 14, 18. Although such electrical connection can be realized by providing gold bumps on the connection pads 14, 18, any other method can be used. In this way, by electrically connecting the element substrate 1 to the top plate 3 via the connection contact pads 14, 18, at the same time when the element substrate 1 is joined to the top plate 3, the above-mentioned circuits can be interconnected electrically. After the element substrate 1 is joined to the top plate 3, the orifice plate 4 is joined to the front ends of the liquid flow paths 7, thereby completing the liquid discharge head.

Incidentally, as shown in FIG. 32, the liquid discharge head has the movable members 6. Regarding the movable members 6, after the circuits are formed on the element substrate, the movable members are formed on the element substrate 1 by using the photo-lithography process.

The fundamental construction of the illustrated embodiment has been explained. Now, the above-mentioned circuits will be fully described. Incidentally, so long as circuits are designed to perform the similar operation, such circuits are not limited to circuits which will be fully described hereinbelow.

Next, a circuit arrangement of the element substrate and the top plate for controlling the energy applied to the discharge heaters will be explained with reference to FIGS. 35A and 35B.

Figure 35A:
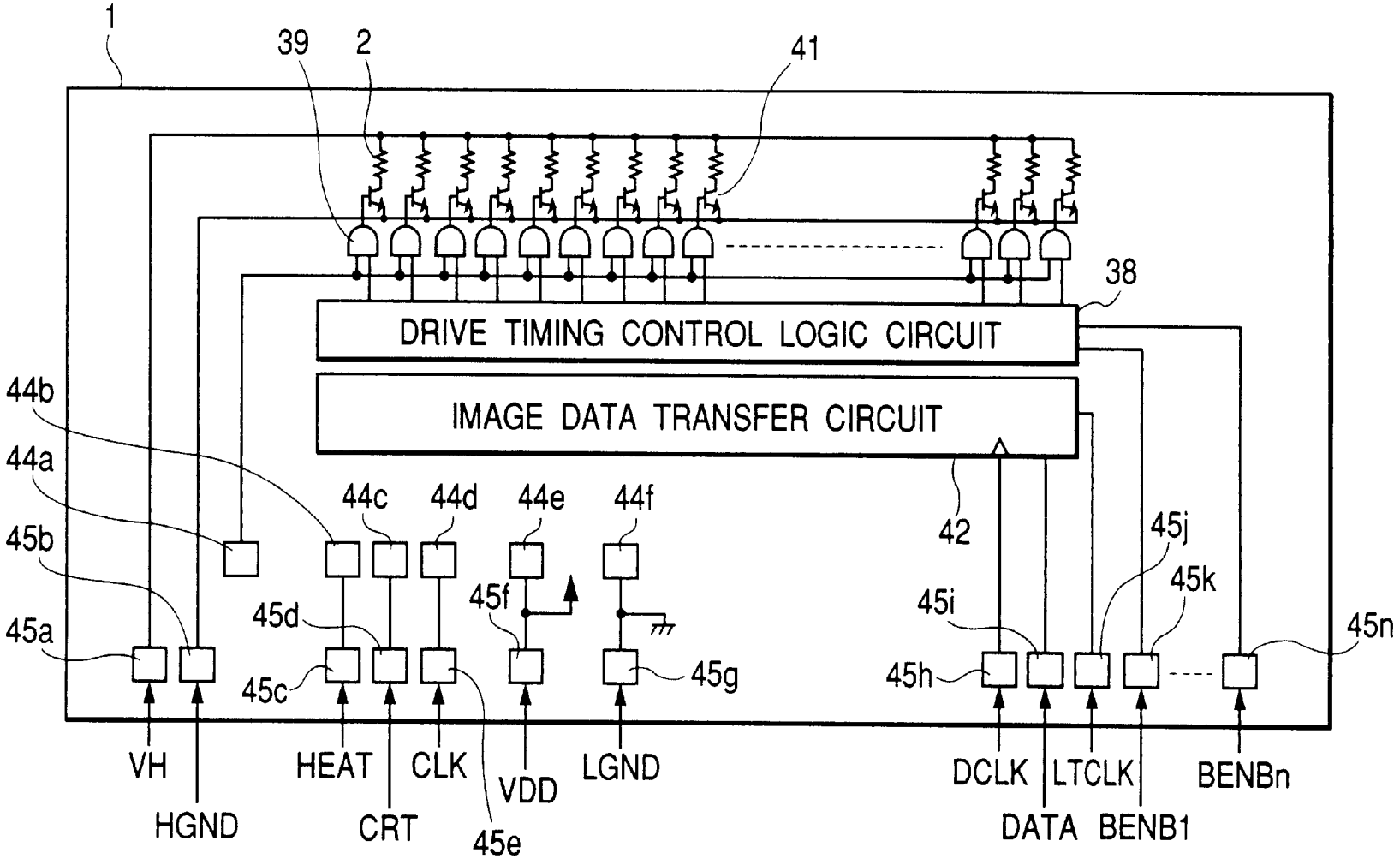
FIGS. 35A and 35B are views showing a circuit arrangement of the element substrate and the top plate in an example for controlling energy applied to a discharge heater in accordance with sensor output.

As shown in FIG. 35A, the element substrate 1 includes a plurality of discharge heaters 32 arranged in a line, power transistors constituting the driver 11 shown in FIG. 34A, AND circuits 39 for controlling the driving of the power transistors 41, a drive timing control logic circuit 38 for controlling the drive timings of the power transistors 41, and an image data transfer circuit 42 constituting the image data transfer portion 12 shown in FIG. 34A and including a shift register and a latch circuit.

The drive timing control logic circuit 38 serves to energize the discharge heaters 2 in a time-lapse manner (not energize the discharge heaters 2 simultaneously) for reducing power supply capacity of the apparatus, and an enable signal for driving the drive timing control logic circuit 38 is inputted from enable signal input terminals 45*k* to 45*h* which are external contact pads 15 shown in FIG. 34A.

Further, as external contact pads provided on the element substrate 1, there are provided an input terminal 45*a* for a drive power supply for the discharge heaters 2, grounding terminal 45*b* for the power transistors 41, input terminals 45*c* to 45*e* for signals required for controlling energy driving the discharge heaters 2, a drive power supply terminal 45*f* for the logic circuit, a grounding terminal 45*g*, an input terminal 45*i* for serial data inputted to the shift register of the image data transfer circuit 42, an input terminal 45*h* for a serial clock signal synchronous with this, and an input terminal 34*j* for a latch clock signal inputted to the latch circuit, as well as enable signal input terminals 45*k* to 45*n*.

Figure 35B:
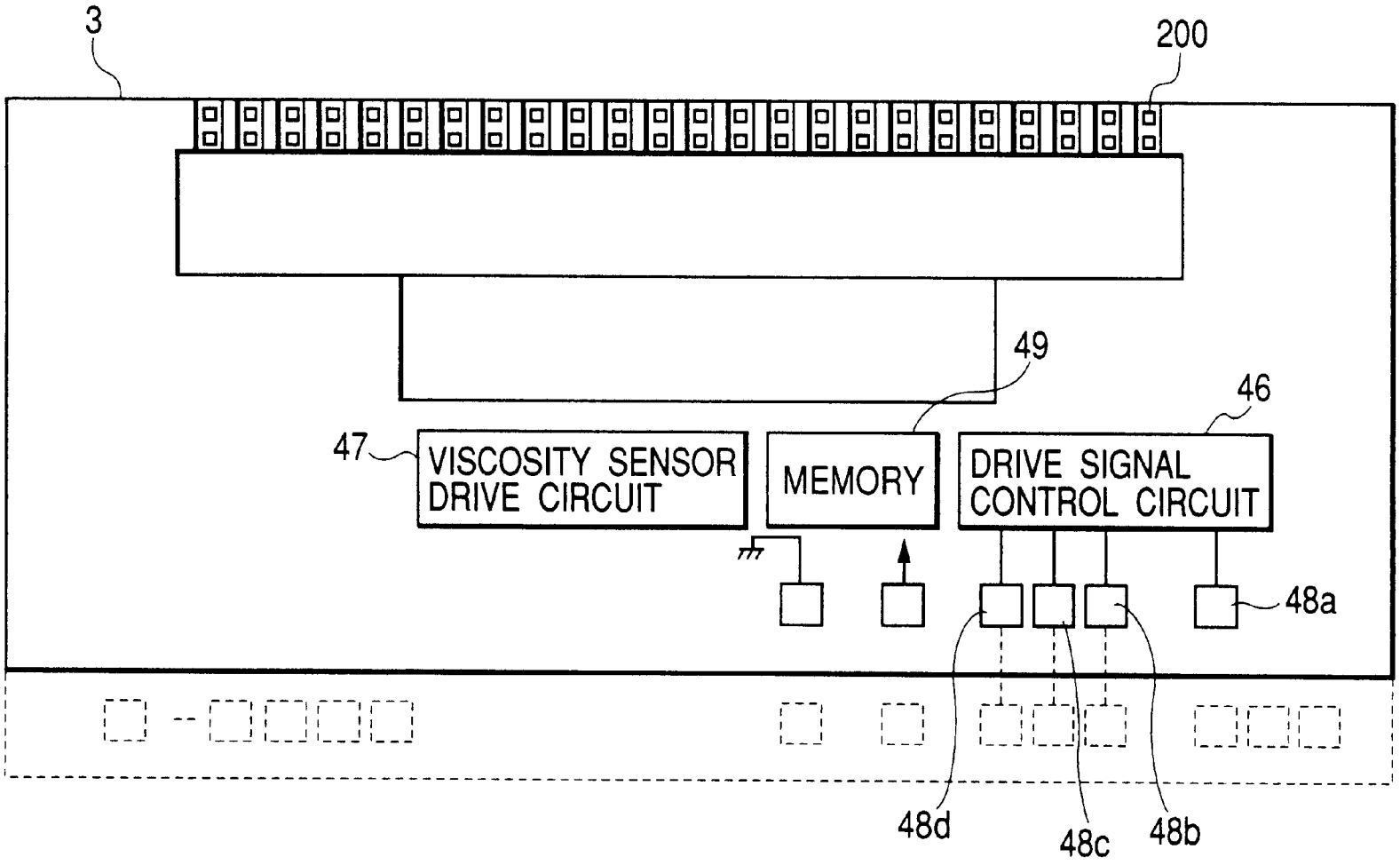

On the other hand, as shown in FIG. 35B, on a top plate 3, there are formed a viscosity sensor driving circuit 47 constituting the viscosity sensor drive portion 17 shown in FIG. 34B and adapted to apply input voltage pulses 2201 to the viscosity sensors 2200 and to detect output voltage V, a drive signal control circuit 46 constituting the discharge heater control portion 16 shown in FIG. 34B and adapted to monitor the output from the viscosity sensors 2200 and to control energy applied to the discharge heaters 2 on the basis of the results from the sensors, and a memory 49 for storing a relationship between the viscosity of the liquid detected by the viscosity sensor 2200 and the number of discharges in the preliminary discharge and a relationship between the viscosity of the liquid and the liquid discharging amount as head information and for outputting such data to the drive signal control circuit 46.

Further, as connection contact pads shown in FIG. 34B, on the element substrate 1 and the top plate 3, there are provided terminals 44*b* to 44*d* and 48*b* to 48*d* for connecting the input terminals 45*c* to 45*e* for signals required to control the energy for driving the discharge heaters 2 externally to the drive signal control circuit 46, and a terminal 48*a* for inputting output of the drive signal control circuit 46 to one of terminals of the AND circuits 39.

Incidentally, as the head information stored in the memory 49, as well as the aforementioned relationship between the viscosity of the liquid and the number of discharges in the preliminary discharge, kinds of liquid to be discharged (in case of ink, ink color or the like) may be included. The reason is that, depending upon the kind of the liquid, property of matter thereof and discharge property are differentiated. The storing of the head information to the memory 49 may be effected in a non-volatile manner after the liquid discharge head is assembled or may be effected by transferring the information from the apparatus side after the liquid discharge apparatus to which the liquid discharge head is mounted is risen up.

Further, In the example shown in FIGS. 35A and 35B, so long as there is any space in the element substrate 1, the memory 49 may be provided on the element substrate 1, rather than the top plate 3.

The discharging of the liquid in the above-mentioned arrangement will be described later.

Next, a circuit arrangement of the element substrate and the top plate for controlling the temperature of the element substrate will be explained with reference to FIGS. 36A and 36B.

Figure 36A:
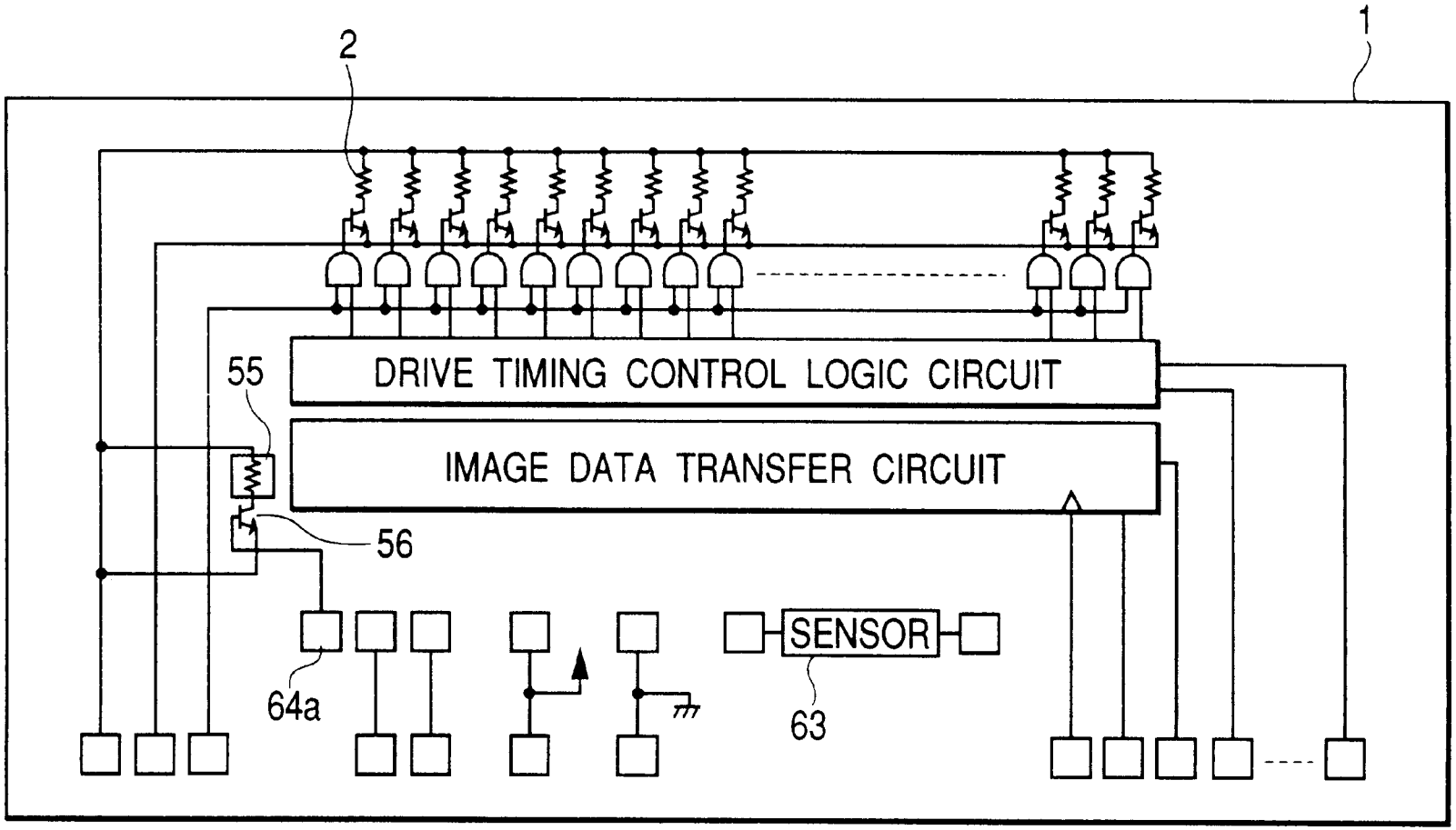
FIGS. 36A and 36B are views showing a circuit arrangement of the element substrate and the top plate in an example for controlling a temperature of the element substrate in accordance with sensor output.

As shown in FIG. 36A, the element substrate 1 shown in FIG. 35A further includes, in addition to the discharge heaters 2 for discharging the liquid, a thermo-keeping heater 55 for heating the element substrate 1 itself to adjust the temperature of the element substrate 1, and a power transistor 56 as a driver for the thermo-keeping heater 55. Further, as the sensor 63, a temperature sensor for measuring the temperature of the element substrate 1 is used.

Figure 36B:
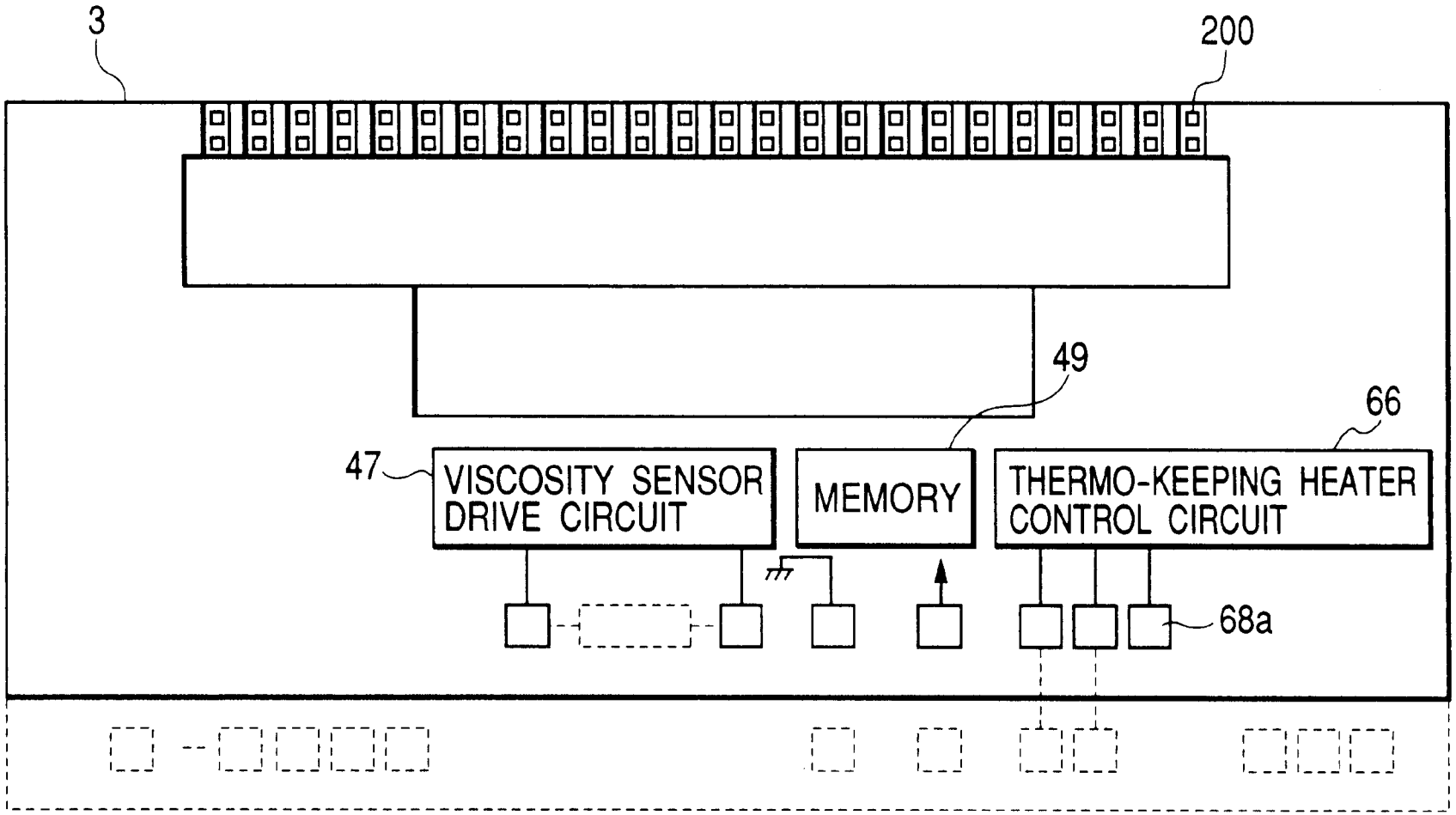

On the other hand, as shown in FIG. 36B, the top plate 3 includes a thermo-keeping heater control circuit 66 for controlling the driving of the thermo-keeping heater 55 on the basis of the output from the sensor 63 and the liquid viscosity data detected by the viscosity sensors 2200 and stored in the memory 49. The thermo-keeping heater control circuit 66 has a comparator which compares a threshold value pre-determined on the basis of the temperature required to the element substrate 1 with the output from the sensor 63 and outputs a thermo-keeping heater control signal for driving the thermo-keeping heater 55 if the output from the sensor 63 is greater than the threshold value. The temperature required to the element substrate 1 is a temperature for which the viscosity of the liquid in the liquid discharge head is maintained within a stable discharge range.

Terminals 64*a*, 68*a* for inputting the thermo-keeping heater control signal outputted from the thermo-keeping heater control circuit 66 to the power transistor 56 for the thermo-keeping heater are provided on the element substrate 1 and the top plate 3 as connection contact pads. The other arrangements are the same as those in FIGS. 35A and 35B.

With the arrangement as mentioned above, the thermo-keeping heater 55 is driven by the thermo-keeping heater control circuit 66 to keep the temperature of the element substrate 1 to a predetermined temperature. As a result, the viscosity of the liquid in the liquid discharge head is maintained within a stable range, thereby permitting good liquid discharge.

Incidentally, in the sensor 63, there is dispersion due to individual difference. Thus, when it is desired to effect more accurate temperature adjustment, in order to correct such dispersion, a correction value for dispersion of output value may be stored in the memory 49 as head information and the threshold value set in the thermo-keeping heater control circuit 66 may be adjusted in accordance with the correction value stored in the memory 49.

While the construction and the manufacturing method according to the illustrated embodiment were explained, now, an example of control of preliminary discharge in the liquid discharge head according to the illustrate embodiment will be described.

Figure 37:
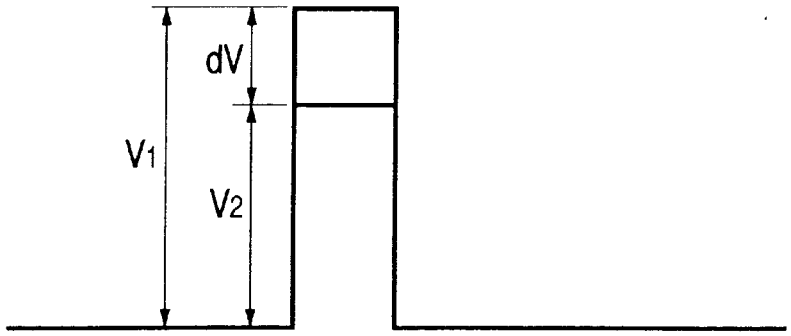
FIG. 37 is a graph showing output voltage outputted from the viscosity measuring circuit of the viscosity sensor.

FIG. 37 is a graph showing the output voltage from the viscosity measuring circuit shown in FIG. 33.

In a condition that the liquid is stationary in the liquid flow path, the signal from the viscosity sensor 2200 is inputted to the viscosity measuring circuit shown in FIG. 33. The value of the resistance 2201 in the viscosity measuring circuit is a resistance value of the liquid in the vicinity of the discharge port 5, and the output voltage V corresponding to this resistance value is outputted. When the viscosity of the liquid is increased as the moisture in the liquid is vaporized, ion density of the liquid per unit area is increased and thus the resistance value of the liquid is decreased. Thus, if the viscosity of the liquid is increased, the output voltage V will be increased. In FIG. 37, for example, when the viscosity of the liquid is high, the output voltage becomes V1, and, when the viscosity of the liquid is low, the output voltage becomes V2. On the other hand, the relationship between the output voltage V and the number of discharges in the preliminary discharge is previously stored in the memory 49. The drive signal control circuit 46 determines the number of preliminary discharges on the basis of the output voltage V from the viscosity measuring circuit of the viscosity sensor 2200 and the relationship between the output voltage V and the number of discharges in the preliminary discharge stored in the memory 49 and applies the drive pulses corresponding to the number of preliminary discharges to the discharge heater 2. That is to say, if the viscosity of the liquid is high the number of preliminary discharges is increased, and if the viscosity of the liquid is low the number of preliminary discharges is decreased. Since the number of preliminary discharges is controlled for each liquid flow path, the optimum number of preliminary discharges are effected for each liquid flow path, thereby preventing reduction of through-put due to excessive preliminary discharge.

However, in the illustrate embodiment, while an example that the viscosity of the liquid is influenced by the amount of moisture vaporized from the liquid was explained, the factor for determining the viscosity of the liquid is not determined only by the amount of moisture vaporized from the liquid, but is influenced by the temperature and/or kind of liquid. Further, in a condition that the moisture has completely been vaporized, the current may not flow between the electrodes 2200*a* and 2200*b*. When this is taken into consideration, the data for determining the number of preliminary discharges in consideration of this may be stored in the memory 49 and the control may be effected on the basis of such data.

Further, the viscosity sensor 2200 may be used for measuring the discharge amount of the liquid and controlling the discharge amount of the liquid, as well as used for controlling the number of preliminary discharges.

Now, an example of control of the discharge amount of the liquid to be discharged will be explained.

The discharge heater 2 is heated to generate the bubble by applying the drive pulse to the discharge heater 2 thereby to displace the movable member 6, with the result that the liquid is discharged from the discharge port 5. After the liquid is discharged, as the bubble is disappeared, the movable member 6 is returned to its initial position. Meanwhile, in order to compensate the volume corresponding to the liquid discharged, new liquid flows-in from the upstream side, i.e., toward the common liquid chamber, thereby effecting re-fill of liquid to the liquid flow path 7. The flow rate of the liquid in the first liquid flow path 7*a* during the re-fill, i.e., volume of liquid flowing into the first liquid flow path 7*a* during the re-fill is equal to the volume of the liquid discharged. Further, the flow rate of the liquid in the first liquid flow path 7*a* is influenced by velocity of the liquid. That is to say, the faster the velocity of the liquid the greater the flow rate. Further, the velocity of the liquid is influenced by the viscosity of the liquid. That is to say, the lower the viscosity of the liquid the faster the velocity of the liquid. Further, conductivity, i.e., resistance value is varied with the viscosity of the liquid. Thus, by measuring the resistance value of the liquid (i.e., output voltage V from the viscosity measuring circuit), the discharge amount of the liquid can ultimately be calculated.

Figure 38:
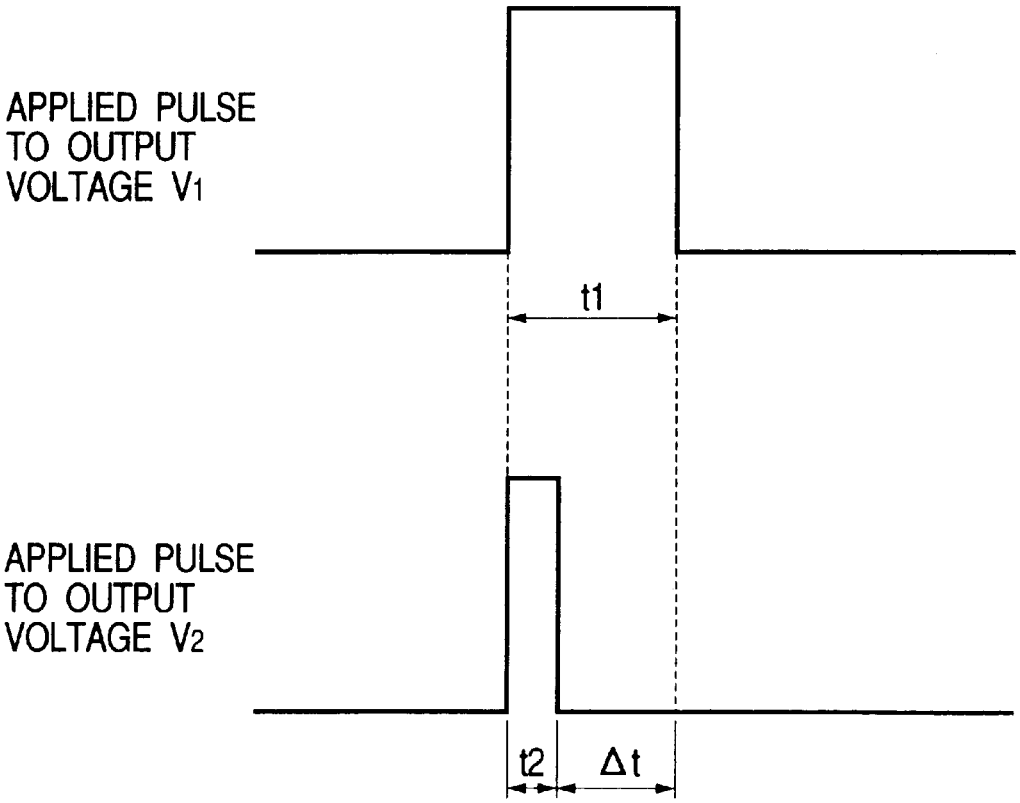
FIG. 38 is a view showing applied pulses applied to the discharge heater from a discharge heater control circuit.

Data regarding the relationship between the output voltage V and the discharge amount of the liquid as mentioned above is previously stored in the memory 49, and, on the basis of this, the drive signal control circuit 46 applies the drive pulse having the pulse width correcting voltage difference dV shown in FIG. 37 to the discharge heater 2. An example of such drive pulse is shown in FIG. 38. That is to say, the drive signal control circuit 46 applies drive pulse having wider pulse width t1, by $\Delta t$, than drive pulse width t2 applied to the discharge heater 2 provided in the liquid flow path 7 outputting voltage value V2 (indicating a condition that the viscosity of the liquid is low and the discharge amount is great) to the discharge heater 2 provided in the liquid flow path 7 outputting voltage value V1 (indicating a condition that the viscosity of the liquid is high and the discharge amount is small) in order to increase the discharge amount to eliminate the difference in liquid discharge amount. As a result, dispersion in discharge amount between the liquid flow paths can be eliminated.

Incidentally, not only the discharge amount of the liquid during the printing may be controlled by the pulse width control, but also the preliminary discharge may be effected by using a combination of the control of the number of preliminary discharges and the pulse width control.

Further, also when the absolute discharge amount of the liquid from each liquid flow path is controlled, in order to eliminate difference between the absolute discharge amount and desired discharge amount, the discharge amount of the liquid may be controlled by changing the pulse width of the drive pulse applied to the discharge heater 2.

Alternatively, when the discharge amount of the liquid discharged from the liquid discharge head is totally small, the thermo-keeping heater control circuit 66 may output a signal to drive the thermo-keeping heater 55, thereby decreasing the viscosity of the liquid to increase the discharge amount of the liquid.

Further, the discharge amount of the liquid may be controlled by a combination of the control of the discharge amount of the liquid effected by changing the pulse width of the drive pulse applied to the discharge heater and the control of the discharge amount of the liquid effected by driving the thermo-keeping heater 55 to decrease the viscosity of the liquid. The control of the discharge amount of the liquid effected by the thermo-keeping heater 55 may not only control the discharge amount of the liquid during the recording not also effecting the preliminary discharge with a combination of the control of the number of preliminary discharges and the pulse width control.

Incidentally, while an example that the viscosity sensors 2200 are provided on the top plate 3 was explained, the present invention is not limited to such an example, but the viscosity sensors may be provided on the movable members 6.

When the viscosity sensors 2200 are provided on the movable members 6 made of silicon material, the sensors may be formed by the same semiconductor process technique as that forming the element substrate 1 and the top plate 3.

Further, the viscosity sensors 2200 are not limited to the arrangement in which they are provided on only the top plate 3 or only the movable member 6. For example, the electrodes 2200*a* may be provided on the top plate 3 and the electrodes 2200*b* may be provided on the movable members 6.

Furthermore, if the viscosity sensor drive portion 17 judges that the liquid is not discharged due to clogging of the discharge port 5, a signal for demanding the execution of the suction recovery operation (described later) may be outputted to a recovery control portion (not shown), thereby recovering the discharge property of the liquid discharge head. However, it is desirable that the electrodes 2200*a*, 2200*b* be located in the vicinity of the discharge ports 5 as near as possible. Further, it is more desirable that the electrodes 2200*a*, 2200*b* be located at the downstream side of downstream ends of the discharge heaters 2.

As mentioned above, according to the present invention, by directly measuring the viscosities of the liquids in the liquid flow paths and by controlling the number of preliminary discharges for respective liquid flow paths on the basis of the measured results, excessive preliminary discharge can be prevented, thereby improving the through-put.

(Sixth Embodiment)

Next, a liquid discharge head according to a sixth embodiment of the present invention will be explained.

Figure 39:
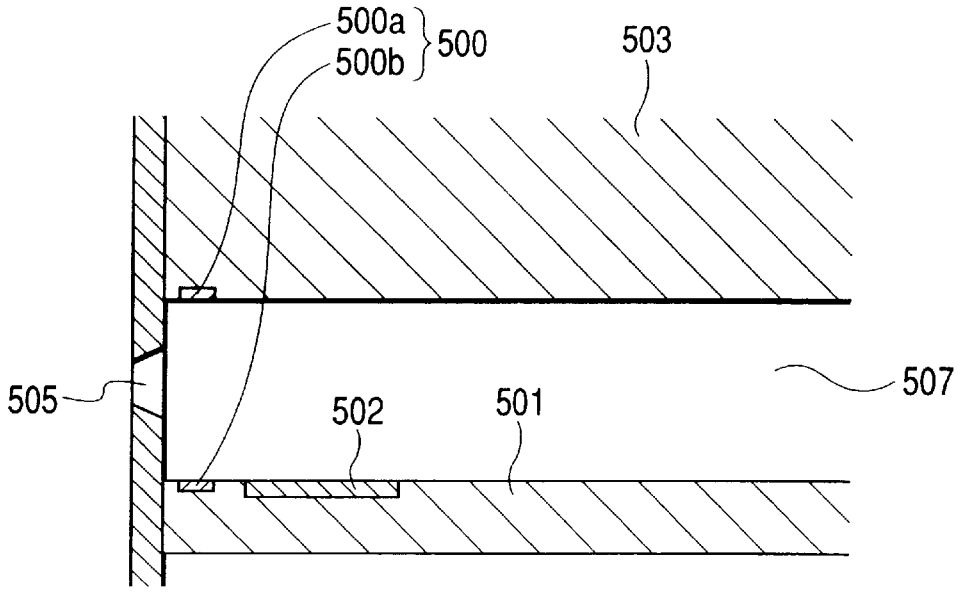
FIG. 39 is a sectional view for explaining a structure of a liquid discharge head according to a second embodiment of the present invention, taken along a direction of a liquid flow path thereof.

FIG. 39 is a sectional view of the liquid discharge head according to the second embodiment, taken along a direction of a liquid flow path thereof.

Since the liquid discharge head according to the second embodiment is fundamentally the same as that of the first embodiment, except that there is no movable member 6 and viscosity sensors 500 are provided on an element substrate 501, detailed explanation thereof will be omitted.

Electrodes 500*a*, 500*b* constituting the viscosity sensor 500 are provided on a top plate 503 and the element substrate 501, respectively.

Incidentally, in the illustrated embodiment, while an example that the electrodes 500*a*, 500*b* are provided on the top plate 503 and the element substrate 501, respectively was explained, the present invention is not limited to such an example, but the electrodes 500*a*, 500*b* may be provided on the element substrate 501. However, it is desirable that the electrodes 500*a*, 500*b* be located in the vicinity of discharge ports 5 as near as possible. Further, it is more desirable that the electrodes 500*a*, 500*b* be located at a downstream of downstream ends of discharge heaters 5.

Furthermore, if a viscosity sensor drive portion (not shown) judges that the liquid is not discharged due to clogging of the discharge port 5, a signal for demanding the execution of the suction recovery operation (described later) may be outputted to a recovery control portion (not shown), thereby recovering the discharge property of the liquid discharge head.

As mentioned above, according to the illustrated embodiment, by directly measuring the viscosities of the liquids in the liquid flow paths and by controlling the number of preliminary discharges for respective liquid flow paths on the basis of the measured results, excessive preliminary discharge can be prevented, thereby improving the through-put.

(Seventh Embodiment)

In a liquid discharge head according to a fifth embodiment of the present invention, there are provided discharge ports for discharging liquid, liquid flow paths communicated with the respective discharge ports, and energy converting elements for applying discharge energy to liquid in the respective liquid flow paths, and, density sensors are provided in the respective liquid flow paths.

More specifically, an ion sensor is preferably used as the density sensor. Especially, an ion selective electric field effect transistor is preferably used. Further, as the energy converting element, an electrical/thermal converter in which a bubble is generated in the liquid by converting electric energy into thermal energy and the liquid is discharged from the discharge port by an acting force of the bubble is preferably used.

Now, this embodiment will be described with reference to the accompanying drawings.

Figure 40:
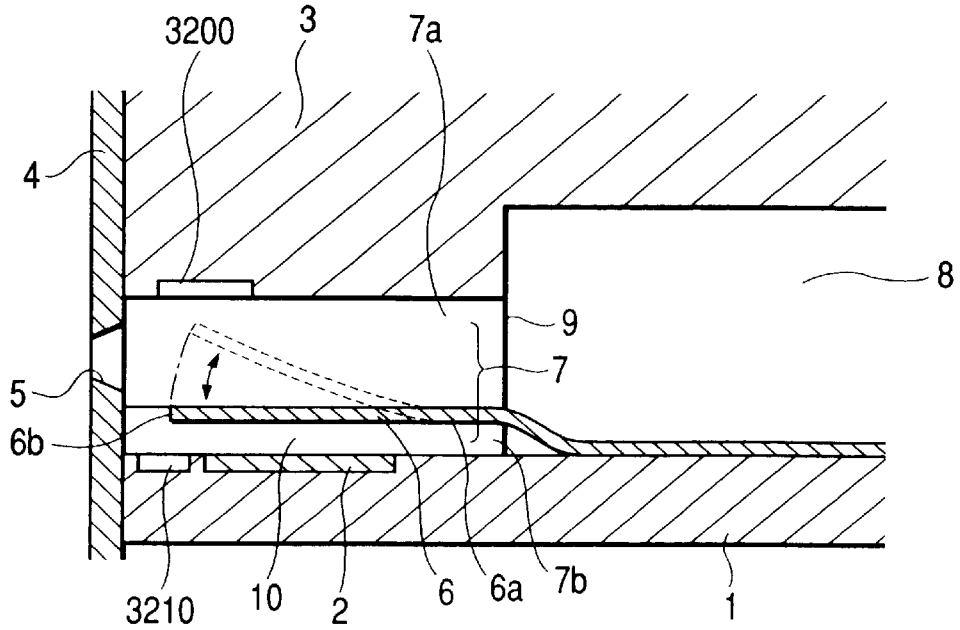
FIG. 40 is a sectional view for explaining a structure of a liquid discharge head according to a first embodiment of the present invention, taken along a direction of a liquid flow path thereof.

FIG. 40 is a sectional view of the liquid discharge head according to this embodiment, taken along a direction of a liquid flow path thereof.

As shown in FIG. 40, the liquid discharge head comprises an element substrate 1 on which a plurality of discharge heaters (only one is shown in FIG. 40) 2 for providing thermal energy for generating bubbles in the liquid are arranged in parallel, a top plate 3 joined to the element substrate, an orifice plate 4 joined to front end faces of the element substrate 1 and the top plate 3, and movable members 6 disposed in liquid flow paths 7 defined by the element substrate 1 and the top plate 3.

The element substrate 1 is constituted by forming silicon oxide film or silicon nitride film for insulation and regeneration onto a silicon substrate and by patterning electrical resistive layers and wirings constituting the discharge heaters 2 on the substrate. By applying electric current to the electrical resistive layers from the wirings, the discharge heaters 2 emit heat. That is to say, the heat generating bodies 2 are electrical/thermal converters.

The top plate 3 defines the plurality of liquid flow paths 7 corresponding to the discharge heaters 2 and a common liquid chamber 8 for supplying the liquid to the liquid flow paths 7. To this end, liquid path side walls 9 extending from a ceiling portion to portions between the discharge heaters 2 are integrally formed with the top plate. The top plate 3 is formed from silicon material, and patterns of the liquid flow paths 7 and the common liquid chamber 9 may be formed by etching or, after material constituting the liquid path side walls 9 such as silicon nitride or silicon oxide is deposited on the silicon substrate by a known film forming method such as CVD, portions corresponding to the liquid flow paths 7 may be formed by etching.

Further, the liquid discharge head is provided with ion sensors 3200 each comprising ion selective EFT (electric field transistor). The ion sensor 3200 is disposed at a position downstream side of a free end 6*b* of a movable member 6 (described later) in the top plate 3 so that it is contacted with the liquid in a first liquid flow path 7*a*. In order to operate the ion sensor 3200, a reference electrode is required, and the reference electrode 3210 is disposed on the surface of the element substrate 1 to be contacted with the liquid in a second liquid flow path 7*b*. In actual, as will be described later, an anti-cavitation film formed on the surface of the element substrate 1 is used as the reference electrode 3210.

In this arrangement, although the movable member 6 is interposed between the ion sensor 3200 and the reference electrode 3210, in actual, since a gap is formed aside the movable member 6 (since the movable member 6 does not completely separate the second liquid flow path from the first liquid flow path), even if the movable member 6 is positioned in a closed position (initial position) shown by the solid line in FIG. 40, a liquid communication condition required for the operation of the ion sensor 3200 is maintained between the first liquid flow path 7*a* and the second liquid flow path 7*b*. Further, although it is considered that the ion density differs between the first liquid flow path 7*a* and the second liquid flow path 7*b*, since the ion sensor 3200 is disposed near the first liquid flow path 7*a*, the density measured by the ion sensor 3200 is density of the liquid in the first liquid flow path 7*a*.

The orifice plate 4 is provided with a plurality of discharge ports 5 corresponding to the liquid flow paths 7 and communicated with the common liquid chamber 9 through the liquid flow paths 7. The orifice plate 4 is also formed from silicon material and may be formed, for example, by cutting a silicon substrate with the discharge ports 5 formed therein into a plate having a thickness of about 10 to 150 $\mu$m. Incidentally, the orifice plate 4 is not inevitable for the present invention. Thus, in plate of the orifice plate 4, a wall having a thickness corresponding to that of the orifice plate 4 may be left at a front end face of the top plate 3 when the liquid flow paths 7 are formed in the top plate 3 and the discharge ports 5 may be formed in such a wall, thereby providing a top plate with discharge ports.

Each movable member 6 is a thin membrane formed from silicon material such as silicon nitride or silicon oxide and cantilever-supported so that it is opposed to the corresponding heat generating body 2 and it divides the corresponding liquid flow path 7 into a first liquid flow path 7*a* communicating the liquid flow path 7 with the discharge port 5 and a second liquid flow path 7*b* including the heat generating body 2.

The movable member 6 has a fulcrum 6*a* at an upstream side of great liquid flow (caused by the liquid discharge operation) flowing from the common liquid chamber 8 to the discharge port 5 through the movable member 6 and a free end 6*b* at a downstream side of the fulcrum 6*a* and is spaced apart from the heat generating body 2 by a predetermined distance to be opposed to the heat generating body 2. A bubble generating area 10 is defined between the heat generating body 2 and the movable member 6.

Further, the liquid discharge head according to the illustrated embodiment has circuits and elements for driving the heat generating bodies 2 and for controlling the driving of the heat generating bodies. These circuits and elements are shared into the element substrate 1 and the top plate 3 in accordance with their functions. Further, since the element substrate 1 and the top plate 3 are formed from silicon material, these circuits and elements can be formed by using the semiconductor wafer process easily and minutely.

Next, the sharing of the circuits and elements into the element substrate 1 and the top plate 3 will be explained.

Figure 41A:
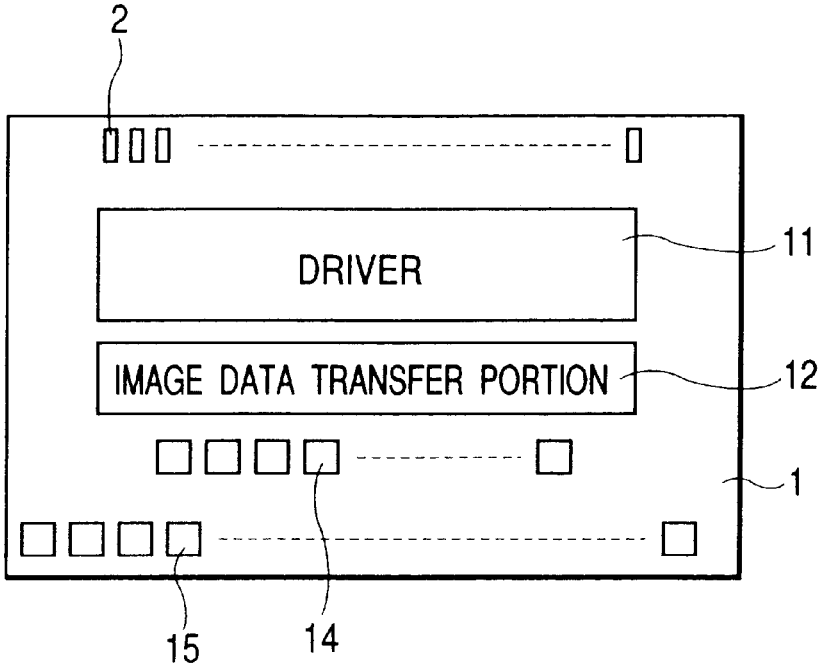
FIGS. 41A and 41B are views for explaining a circuit arrangement of the liquid discharge head shown in FIG. 40, where
Figure 41B:
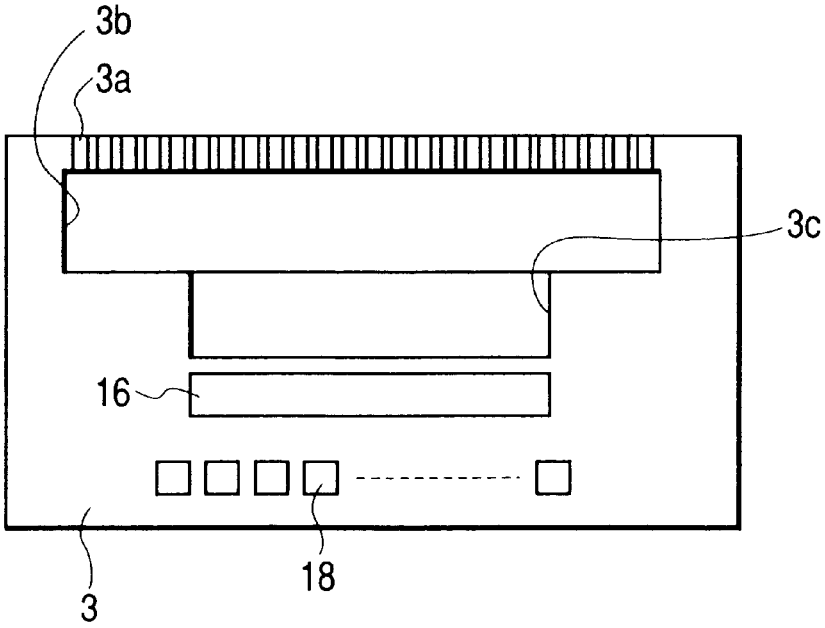

FIGS. 41A and 41B are views for explaining a circuit arrangement of the liquid discharge head shown in FIG. 40, where FIG. 41A is a plan view of the element substrate and FIG. 41B is a plan view of the top plate. Incidentally, FIGS. 41A and 41B illustrate opposite surfaces.

As shown in FIG. 41A, the element substrate 1 includes the plurality of heat generating bodies 2 arranged in parallel, a driver 11 for driving the heat generating bodies 2 in accordance with image data, and an image data transfer portion 12 for outputting the inputted image data to the driver 11.

The image data transfer portion 12 includes a shift register for outputting the image data inputted in serial to the drivers 11 in parallel, and a latch circuit for temporarily storing the data outputted from the shift register. Incidentally, the image data transfer portion 12 may be designed to output the image data in correspondence to the respective heat generating bodies 2 or may be designed to output the image data to each block when the heat generating bodies 2 are divided into a plurality of blocks. Particularly, by providing a plurality of shift registers in a single head so that data transferred from a recording apparatus is shared into the plurality of shift registers, a printing speed can easily be increased.

On the other hand, as shown in FIG. 41B, in the top plate 3, the grooves 3*a*, 3*b* defining the liquid flow paths and the common liquid chamber are formed as mentioned above. As will be described later, the ion sensors 3200 (not shown in FIG. 41B) are provided in the grooves 3*a* corresponding to the liquid flow paths. Further, there is provided a heat generating body control portion 16 for controlling the driving conditions of the heat generating bodies 2 on the basis of the output results from the ion sensors 3200. Incidentally, the top plate 3 is provided with a supply port 3*c* through which liquid is supplied to the common liquid chamber from an external source and which is communicated with the common liquid chamber.

Further, connection contact pads 14, 18 for electrically connecting circuits formed in the element substrate 1 to circuits formed in the top plate 3 are formed on corresponding portions of the interface between the element substrate 1 and the top plate 3. Further, the element substrate 1 is provided with external contact pads 15 as input terminals for external electric signal. The dimension of the element substrate 1 is greater than that of the top plate 3, and the external contact pads 15 are exposed from the top plate 3 when the element substrate 1 is joined to the top plate 3.

Here, an example of formation of circuits and the like on the element substrate 1 and the top plate 3 will be explained.

Regarding the element substrate 1, first of all, circuits constituting the driver 11 and the image data transfer portion 12 are formed on a silicon substrate by using the semiconductor wafer process technique. Then, the heat generating bodies 2 are formed as mentioned above, and, lastly, the connection contact pads 14 and the external contact pads 15 are formed.

Regarding the top plate 3, first of all, the ion sensors (and associated drive circuit) and a circuit constituting the discharge heater control portion 16 are formed on a silicon substrate by using the semiconductor wafer process technique. Then, as mentioned above, the grooves 3*a,* 3*b* constituting the liquid flow paths and the common liquid chamber and the supply port 3*c* are formed by the film forming technique and the etching, and, lastly, the connection contact pads 18 are formed.

When the element substrate 1 and the top plate 3 constructed as mentioned above are aligned and joined, the heat generating bodies 2 are positioned in correspondence to the respective liquid flow paths and the circuits formed on the element substrate 1 and the top plate 3 are electrically interconnected via the connection pads 14, 18. Although such electrical connection can be realized by providing gold bumps on the connection pads 14, 18, any other method can be used. In this way, by electrically connecting the element substrate 1 to the top plate 3 via the connection contact pads 14, 18, at the same time when the element substrate 1 is joined to the top plate 3, the above-mentioned circuits can be interconnected electrically. After the element substrate 1 is joined to the top plate 3, the orifice plate 4 is joined to the front ends of the liquid flow paths 7, thereby completing the liquid discharge head.

Incidentally, as shown in FIG. 40, the liquid discharge head according to the illustrate embodiment has the movable member 6. Regarding the movable members 6, after the circuits are formed on the element substrate, the movable members are formed on the element substrate 1 by using the photo-lithography process.

Figure 42:
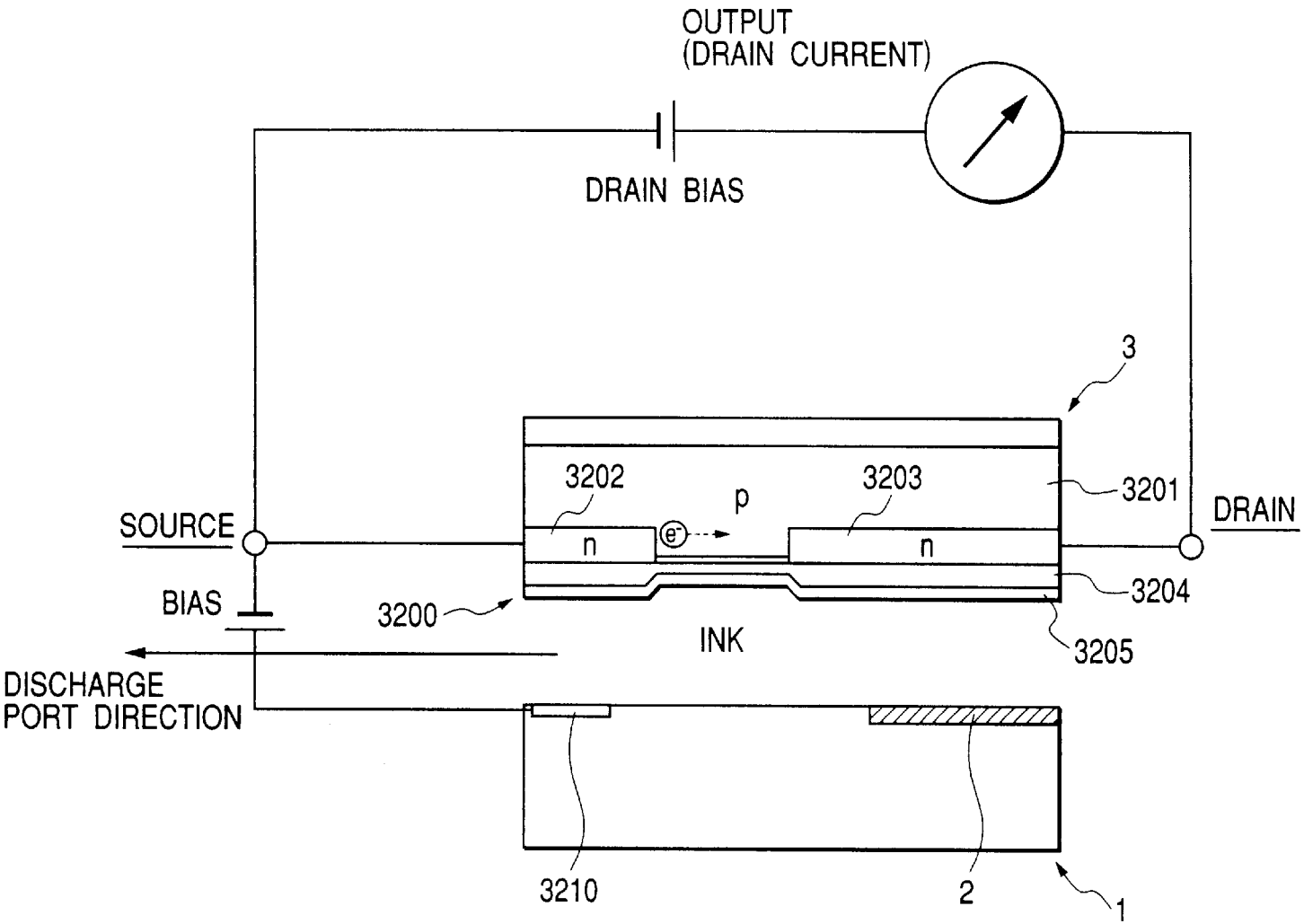
FIG. 42 is a view for explaining an ion sensor.

Next, the ion sensor 3200 in the liquid discharge head according to the present invention will be further fully explained. Incidentally, in FIG. 42, in order to simplify the explanation, description of the movable member will be omitted.

The heat generating body 2 and the reference electrode 3210 are formed on the surface of the element substrate 1 comprised of silicon substrate. Here, while the heat generating body 2 and the reference electrode 3210 are shown to be spaced apart from each other clarify the circuit arrangement of the ion sensor 3200, in actual, the anti-cavitation film formed on the surface of the heat generating body 2 made of Ta is used as the reference electrode 3210.

On the other hand, a P-type well area 3201 is formed on the top plate 3 comprised of silicon substrate, and a source area 3202 and a drain area 3203 into which N-type impurity is introduced are formed on the surface of the P-type well area 3201. A gate insulation film 3204 is provided to cover the surface (channel area) of the P-type well area 3201 and the source area 3202 and drain area 3203, and, further, an ion sensitive film 3205 made of silicon nitride (SiN) is formed on the surface of the gate insulation area 3204, thereby constituting the ion sensor 3200 which is ion selective FET.

When the ink is contacted with the ion sensitive film 3205, surface interface potential in correspondence to the ions in the ink and its concentration is generated between the ion sensitive film and the ink. By previously applying predetermined bias current between the source and drain of the ion sensor 3200, drain current corresponding to the surface interface potential flows. In the measurement, appropriate bias is applied between the reference electrode 3210 and the source, and drain current in correspondence to a sum of the surface interface potential and such bias is observed. Alternatively, the ion sensor 3200 may be constructed as a source follower circuit so that output is obtained as potential via a resistance.

Figure 43A:
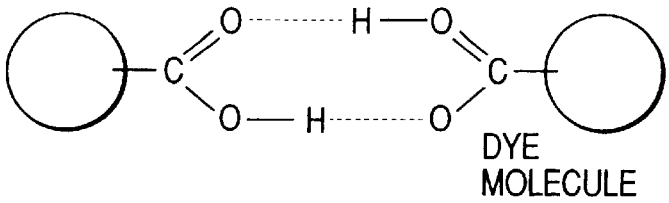
FIGS. 43A and 43B are views for explaining a meeting condition of dye ions in the ink.
Figure 43B:
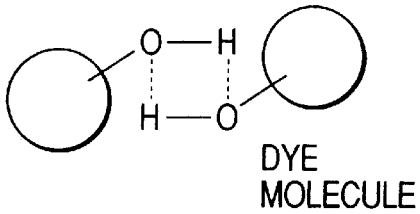

By the way, discharge liquid (ink) used in the liquid discharge head of this kind is generally obtained by dissolving or dispersing dye or pigment in water as solvent. More specifically, dye ions having carboxyl groups or hydroxide groups, pigment made hydrophilic by dispersant having such groups, or pigment particles to which such groups are adhered are dispersed into water or solvent. As shown in FIGS. 43A and 43B, such dye or pigment forms an association condition in the ink (aqueous solution system) by relatively weak bond such as hydrogen bond. When such association condition occurs between several tends or several hundreds of molecules, imaginary color material macromolecule is generated, thereby decreasing dynamic viscosity of the ink, which results in deterioration of discharge property.

If the association condition is formed, apparently, since activity of the corboxyl groups and hydroxide groups as ions is decreased and effective molecular weight is increased, potential detected by the ion sensor 3200 will be changed. In the liquid discharge head according to the illustrated embodiment, the association condition of dye ions in the ink is detected by the ion sensor 3200, and head recovery operation is effected if necessary, whereby ink in the nozzle is always made given dissociation. Further, since the association condition in the ink may differ from nozzle to nozzle depending upon the frequency of use of nozzle, in this liquid discharge head, the association condition is detected for each nozzle by providing the ion sensor for the respective nozzles, and pulse widths of the drive pulses to the heat generating bodies 2 are changed for the respective nozzles on the basis of the detected results.

Figure 44A:
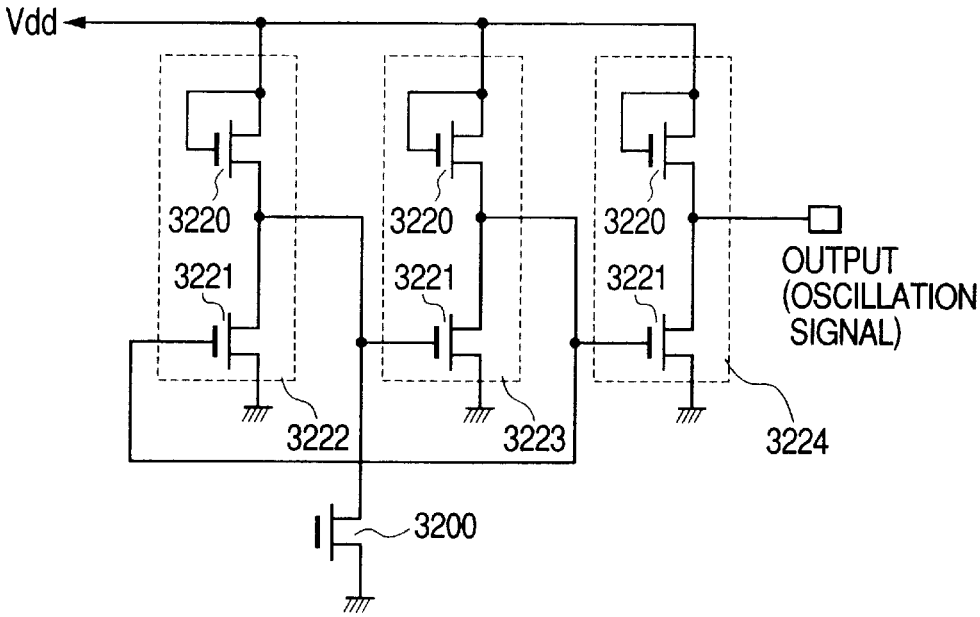
FIG. 44A is a circuit diagram for explaining an oscillation circuit in which the ion sensor is incorporated.
Figure 44B:
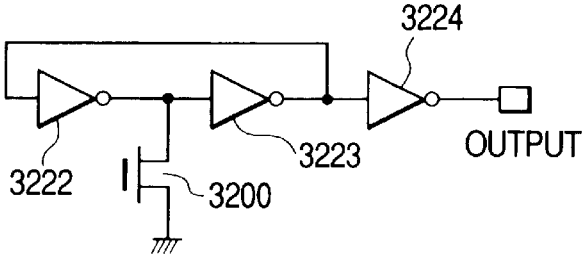
FIG. 44B is a circuit diagram representing the oscillation circuit as a logic circuit.

FIG. 44A is a view showing an example of a circuit for outputting the detected result in the ion sensor, and FIG. 44B represents the circuit of FIG. 44A as a logic circuit. Here, an oscillation circuit in which oscillation frequency is varied with ion density will be explained.

An inverter circuit is constituted by connecting MOS transistors 2320, 2321 in series, and the oscillation circuit is constituted by connected such inverter circuits 3223 in two stages in a ring-shaped fashion, and further, by picking up output of the inverter circuit 3223 through a single stage inverter circuit 3224, oscillation output is obtained. The ion sensor 3200 is inserted between output of the inverter circuit 3222 (i.e., input of the inverter circuit 3223) and the grounding point. According to this circuit, the oscillation frequency is varied with the potential detected by the ion sensor 3200. Accordingly, by detecting such oscillation frequency, for example, the recovery operation can be effected or the drive pulse widths for respective nozzles can be changed.

In this liquid discharge head, the position of the ion sensor can be appropriately selected in accordance with a position where the association condition is desired to be detected. In general, since the operator wants to frequently know the ink condition immediately at the upstream side of the discharge port, the ion sensor is located immediately in front of the discharge port. In principle, although the ion sensor can be provided on the element substrate 1, since the fluctuation of the output of the ion sensor is several mV to several tens of mV at the most, it is not necessarily preferable that the ion sensor be provided on the element substrate having heat generating portions (electrical/thermal converters) 2 driven by large current pulses. Accordingly, it is preferable that the ion sensors be provided on the top plate 3 or the movable members 6. Since the movable member 6 is also formed from silicon material, it is not difficult to provide the ion sensor on the movable member 6 by utilizing the semiconductor device process. Further, by providing the ion sensors on the top plate 3 or the movable members 6, since the anti-cavitation film on the surface of the element substrate 1 can be used as the reference electrode, additional reference electrode is not required.

Since the voltage value detected by the ion sensor is governed by Nernst formula, it is a function of temperature. Thus, in order to eliminate the influence of the temperature, for example, the temperature sensor may be provided on the element substrate 1 or the top plate 3 so that the measured value of the ion density is corrected on the basis of a measured value of the temperature sensor. When the temperature sensor is provided in this way, the output of the temperature sensor can also be used to heat the element substrate to a given temperature or to change the drive pulse widths for the heat generating bodies 2 in accordance with the temperature.

Further, according to the Stokes law derived from the hydrodynamics, molar conductivity $\lambda$ of ion is represented by the following formula:

$$\lambda = \frac{|Z| \cdot F^2}{6\pi N \eta r} \tag{1}$$

(Where, Z is charge number of ion, F is Faraday constant, N is molecular number per unit area, $\eta$ is viscosity coefficient, and r is a radius of ion) Further, diffusion coefficient D of ion is represented by the following formula:

$$D = \frac{RT\lambda}{|Z| \cdot F^2} \tag{2}$$

(Where, R is gas constant and T is absolute temperature.) It is assumed that the Stokes law derived from the hydrodynamics can be applied to movement of ions in the ink. In this case, before the ink is introduced into the ink cartridge or the ink tank, the molar conductivity $\lambda$ of ink and the diffusion coefficient D are measured, and the measured values are stored in a memory provided on the liquid discharge head.

Paying attention to only the color material component (dye or pigment), the radius r of ion, viscosity coefficient $\eta$ and charge number Z become variable parameters.

Further, dipole moment $\mu$ of the ion in question is represented by the following formula:

$$\mu = \frac{\lambda}{F} \tag{3}$$

And, specific inductive capacity $\epsilon$ of ink is represented by the following formula:

$$\varepsilon = 2\pi N \mu^2 \frac{g}{kT} \tag{4}$$

(Where, g is an amount determined by relative orientation between adjacent molecules, and k is Boltzmann constant)

When it is considered that change in potential detected by the ion sensor according to the illustrated embodiment is proportional to a ratio (charge number Z of ion/radius r of ion), from the formula (1), the change in viscosity coefficient $\eta$ can be estimated relatively. Pulse control for making the discharge property constant in accordance with the change in viscosity coefficient is considered as very effective means.

Figure 45A:
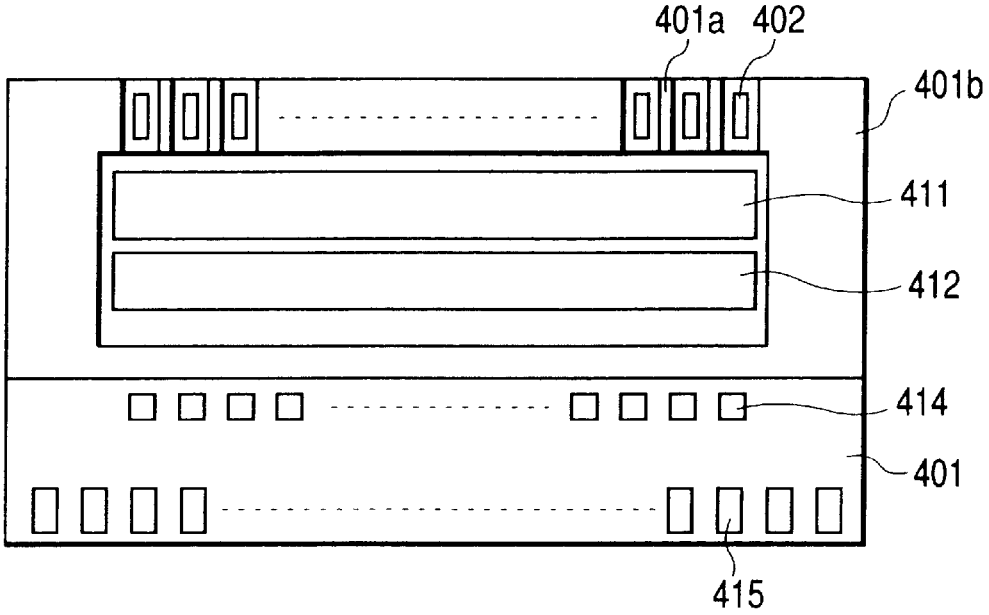
FIGS. 45A and 45B are views showing a circuit arrangement of the element substrate and the top plate in an example for effecting control by utilizing the output of the ion sensor.
Figure 45B:
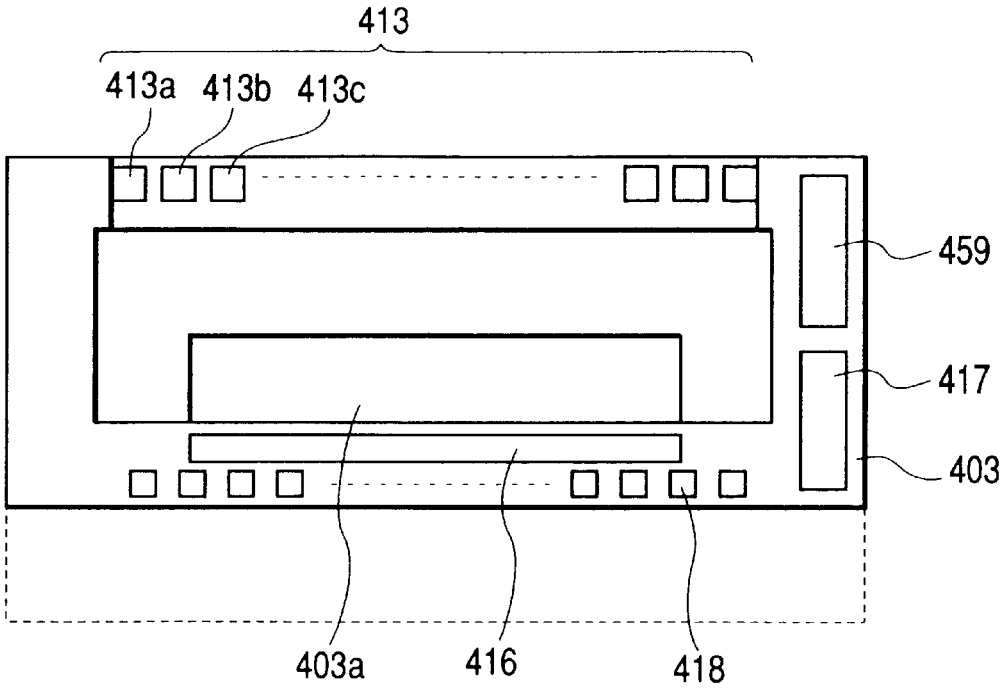

Next, a concrete construction of the liquid discharge head in which the recovery operation is effected or the widths of the heat generating body drive pulses are changed for respective nozzles in accordance with the measured results regarding the association conditions for the respective nozzles will be explained with reference to FIGS. 45A and 45B. FIG. 45A is a plan view of an element substrate, and FIG. 45B is a plan view of a top plate. Similar to FIGS. 41A and 41B, FIGS. 45A and 45B illustrate opposed surfaces. The dotted line in FIG. 45B indicates positions of a liquid flow path and a common liquid chamber when joined to the element substrate.

Incidentally, here, while an example that liquid flow path walls 401*a* are formed in the element substrate 401 is explained, regarding the structures of the element substrate and the top plate, they can be applied any of the above-mentioned embodiments.

In FIG. 45A, the element substrate 401 includes a plurality of heat generating bodies 402 arranged in parallel in correspondence to liquid flow paths as mentioned above, a driver 411 for driving the heat generating bodies 402 in response to image data, an image data transfer portion 412 for outputting the inputted image data to the driver 411, liquid flow path wall 401*a* for defining nozzles, and a liquid chamber frame 401*b* for defining a common liquid chamber. Further, as mentioned above, an anti-cavitation film is provided on the element substrate 401 and also acts as a reference electrodes for ion sensors.

On the other hand, in FIG. 45B, in the top plate 403, there are provided ion sensors 413*a*, 413*b*, . . . disposed in correspondence to the liquid flow paths, a sensor drive portion 417 for applying bias voltages to the ion sensors 413*a*, 413*b*, . . . to drive the latter, a limit circuit 459 for limiting or stopping the driving of the heat generating bodies (heat generating resistance elements) on the basis of outputs of the ion sensors, a heat generating body control portion 416 for controlling the driving conditions of the heat generating bodies 402 on the basis of signals from the sensor drive portion 417 and the limit circuit 459, and a supply port 403*a* communicated with the common liquid chamber to supply the liquid to the latter from the outside.

Further, connection contact pads 414, 418 for electrically connecting circuits formed in the element substrate 401 to circuits formed in the top plate 403 are formed on corresponding portions of the interface between the element substrate 401 and the top plate 403. Further, the element substrate 401 is provided with external contact pads 415 as input terminals for external electric signal. The dimension of the element substrate 401 is greater than that of the top plate 403, and the external contact pads 415 are exposed from the top plate 403 when the element substrate 401 is joined to the top plate 403.

Circuits are formed on these elements in the similar manner to that explained in connection with FIGS. 41A and 41B. When the element substrate 401 and the top plate 403 are aligned with and joined to each other, the heat generating bodies 402 are opposed to the liquid flow paths, and the circuits formed on the element substrate 401 and the top plate 403 are electrically interconnected via the connection contact pads 414, 418.

A space of several tens of μm between the first substrate (element substrate 401) and the second substrate (top plate 403) is filled with ink. Ink association conditions are detected by the ion sensors provided on the top plate 403 for respective nozzles. In this case, if there is no ink between the element substrate 401 and the top plate 403, for example, abnormal values corresponding to gate-open at the MOS electric field effect transistors are outputted from the ion sensors 413*a,* 413*b*, . . . . Further, if the ink association condition is improper, a corresponding value is outputted from the ion sensor. On the basis of the detected results of the ion sensors, for example, if it is judged that there is no ink in the nozzle or if it is judged that the association condition of ions in the ink is greatly deviated from the normal association condition, the driving of the heat generating bodies 402 can be limited or stopped by the limit circuit 459, or a signal informing abnormality can be outputted to a main body of the apparatus. In this way, a head in which physical damage of the head is prevented and the stable discharge performance can always be effected can be provided. Further, even when the nozzles are filled with ink, since the detected values corresponding to the ion association conditions in the ink can be obtained for respective nozzles, the drive pulse widths to the heat generating bodies can be changed for respective nozzles in accordance with the detected values.

In the present invention, since the ion sensors and the limit circuit can be formed by the semiconductor water process, the elements can be arranged at proper positions, and a head damage preventing function can be added without increasing the cost of the head itself.

Further, here, while an example that the ion sensors are provided for respective nozzles was explained, since the ion sensors 413*a,* 413*b,* . . . are not correspond to the heat generating bodies 402 through electrical connection, even when the ion sensors are provided on the top plate 403, the wirings do not become complicated.

Next, an operation of a liquid discharge head of two-liquid mixing type will be explained with reference to FIGS. 47A and 47B.

Heat generated by driving a heat generating body 1502 acts on a bubbling liquid in a bubble generation area within a second liquid flow path, with the result that a film-boiling phenomenon (at disclosed in Japanese Patent Publication No. 61-59914) is caused, thereby generating a bubble. Pressure due to generation of the bubble is collectively transferred toward a movable member 1506 disposed in a discharge pressure generating portion, with the result that, as the bubble is growing, the movable member 1506 is displaced from a condition shown in FIG. 47A toward the first liquid flow path as shown in FIG. 47B. By the movement of the movable member 1506, the first and second liquid flow paths are greatly communicated with each other with the interposition of the bubble, with the result that the pressure wave due to the generation of the bubble is mainly transmitted toward the discharge port of the first liquid flow path. By the propagation of the pressure wave and the mechanical displacement of the movable member, the discharge liquid and the bubbling liquid are mixed at a predetermined ratio, and the mixed liquid is discharged from the discharge port.

In this liquid discharge head, it is considered that the reason why the ink can be discharged with higher discharge energy efficiency and higher discharge pressure in comparison with the conventional heads depends upon the following phenomena and relative action between these phenomena.

First of all, among the discharge pressure generated in the second liquid flow path 1504 by the displacement of the movable member 1506, almost all of the discharge pressure transferred toward the movable member 1506 is released into the first liquid flow path 1503, particularly, into the discharge port. Namely, the propagating direction of the discharge pressure generated in the second liquid flow path 1504 is converted toward the discharge port by the movable member 1506. Further, by the mechanical displacement of the movable member 1506 operated by the pressure due to generation of the bubble, the discharge liquid in the discharge pressure generating area within the first liquid flow path 1503 is pushed, thereby generating a discharging force. Incidentally, during the operation of the movable member 1506, since the bubble exists the side of the movable member 1506 near the heat generating body, the resistance of the liquid for controlling the operation of the movable member is small, with the result that the operation of the movable member 1506 can be performed smoothly with good response. It is considered that this also contributes to achieve the effect of the invention.

Figure 47A:
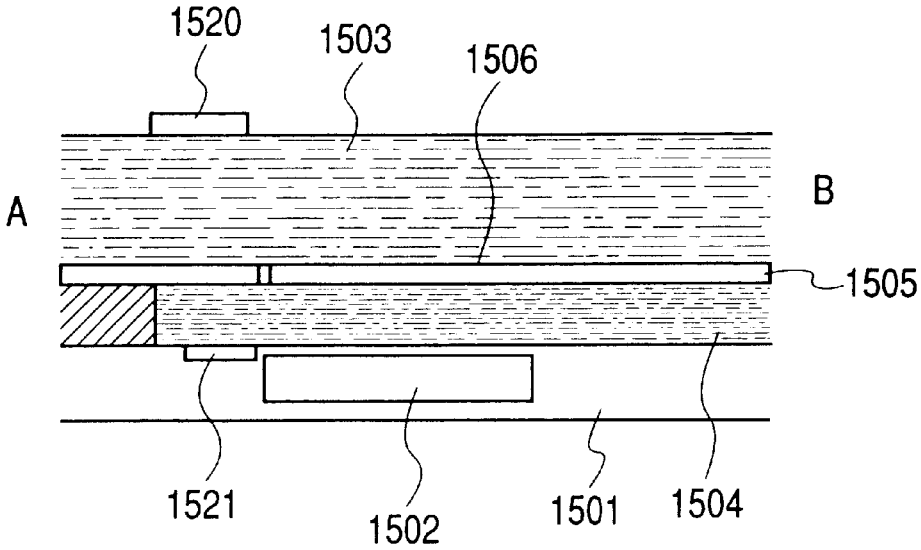
FIGS. 47A and 47B are views for explaining an operation of a movable portion.
Figure 47B:
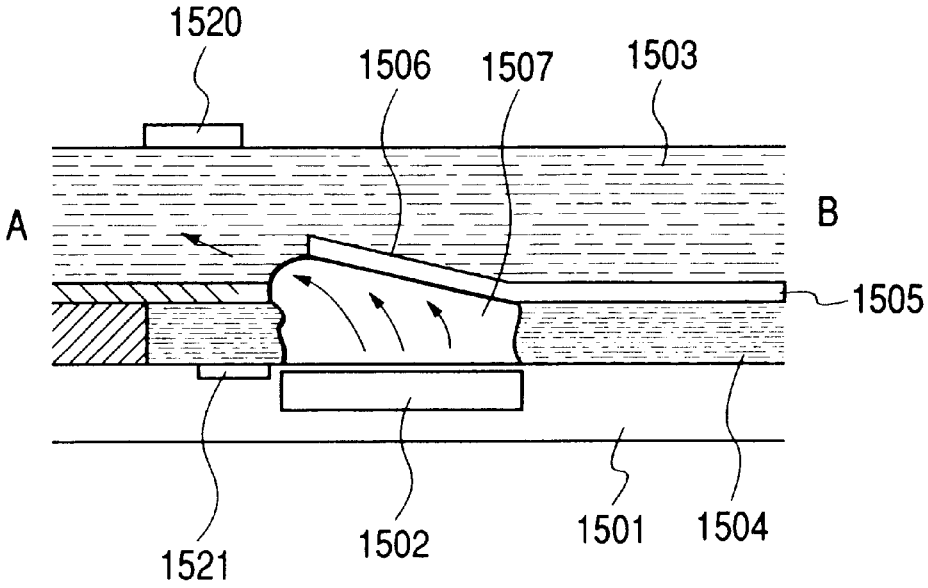

Then, as the bubble is disappeared, the movable member 1506 is returned to the position shown in FIG. 47A, and, in the first liquid flow path 1503, an amount of discharge liquid corresponding to the volume of the discharged discharge liquid is supplied from the upstream side. Since the supplying of the discharge liquid is effected along a closing direction of the movable member 1506, the re-fill of the discharge liquid is not obstructed by the movable member. In this way, according to the illustrated embodiment, since the discharge liquid at the upstream side in the first liquid flow path 1503 is almost not influenced by the back wave, one directional flowing ability from the upstream side to the downstream side is strong, thereby effecting the re-fill effectively. Further, as mentioned above, since the bubbling liquid in the second liquid flow path 1504 is not so used greatly, re-fill is finished with small amount of liquid.

According to the illustrated embodiment, the discharge liquid and the bubbling liquid are differentiated, and the liquid obtained by mixing the discharge liquid and the bubbling liquid at the predetermined ratio can be discharged by the pressure of the bubble generated in the bubbling liquid. Thus, even high viscous liquid such as polyethylene glycol which was not conventionally bubbled adequately when the heat was applied and caused poor discharge, when this liquid is supplied to the first liquid flow path 1503 and liquid (mixed liquid, ethanol:water=4:6; about 1 to 2 cP) capable of bubbling effectively is supplied to the second liquid flow path 1504 as the bubbling liquid, good discharge can be achieved. Further, in the head construction of the present invention, since the effect can be expected explained in connection with the aforementioned embodiments, the liquid such as high viscous liquid can be discharged with higher discharge efficiency and higher discharge pressure.

Further, even in case of liquid weak to heating, when this liquid is supplied to the first liquid flow path 1503 as the discharge liquid and liquid strong to heating and capable of bubbling effectively is supplied to the second liquid flow path 1504, discharge can be achieved without thermally damaging the discharge liquid and with high discharge efficiency and high discharge pressure.

Figure 46:
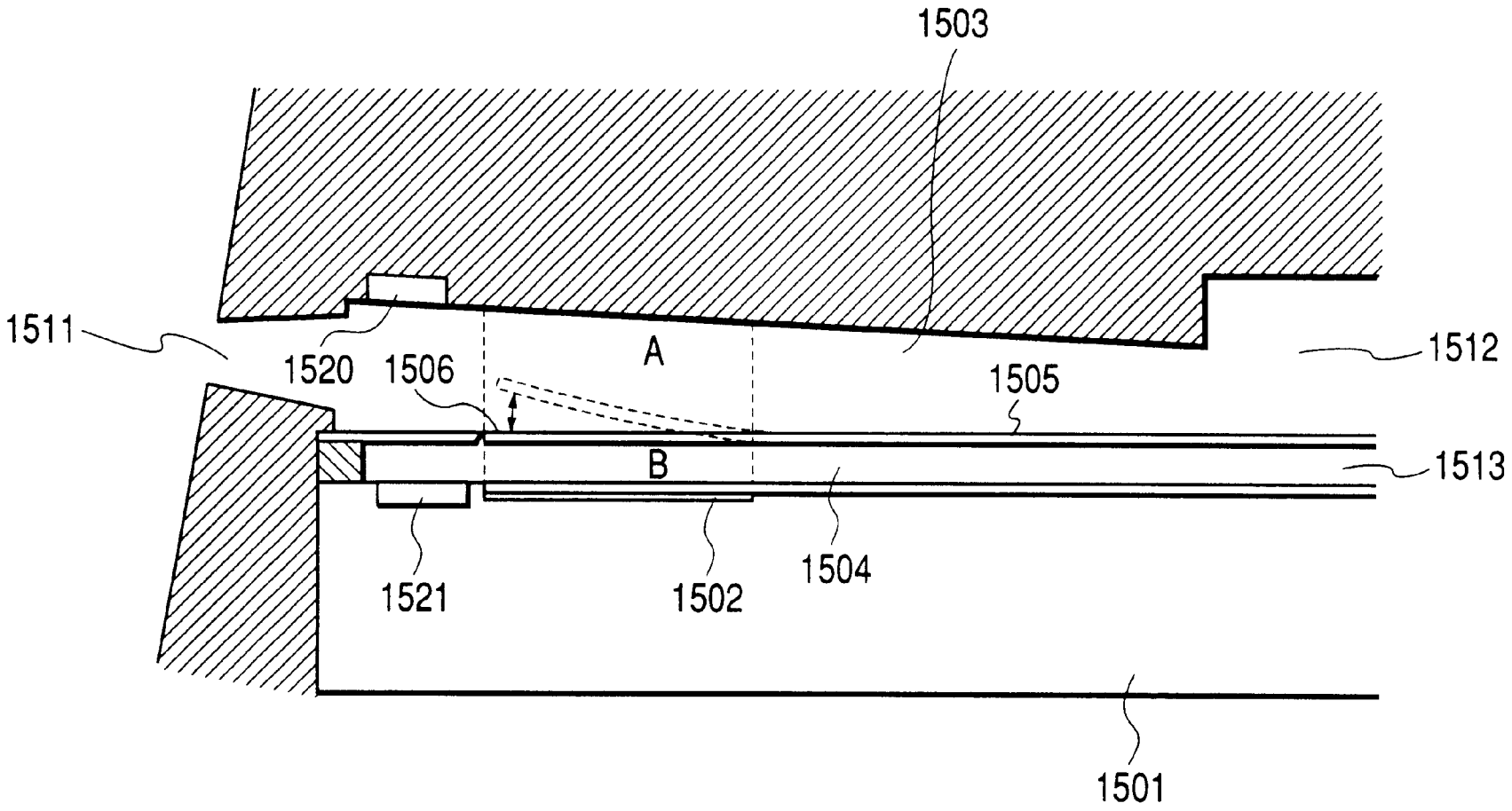
FIG. 46 is a schematic sectional view a liquid discharge head of two liquid mixing type.

When the bubbling liquid and the discharge liquid are mixed in this way, it is required that the mixing ratio be controlled to a predetermined ratio to effect high quality recording. In case of the liquid discharge head shown in FIG. 46, since the ion sensor 1520 is disposed in the vicinity of the discharge port 1511, ion density of the liquid after mixing can be detected. Since the mixing ratio can be controlled, for example, changing the drive pulse width for the heat generating body or the peak voltage, by feeding-back the detected result of the ion sensor 1520, the mixing ratio between the bubbling liquid and the discharge liquid can always be kept constant.

Although not shown, the ion sensors each comprised of an ion selective electric field effect transistor are provided for respective liquid flow paths, and the reference electrode(s) is provided in an opposed relationship to the ion sensors.

What is claimed is:

1. A liquid discharge head comprising:

a plurality of discharge ports for discharging liquid;

first and second substrates for defining a plurality of liquid flow paths which communicate with said discharge ports;

a plurality of energy converting elements each disposed in a respective one of said liquid flow paths and adapted to convert electrical energy into discharge energy for liquid in said liquid flow paths; and sensors for detecting behavior of the liquid, provided in said respective liquid flow paths as solid structure portions protruding from walls of said liquid flow paths, said sensors being supported by said solid structure portions so as to be spaced apart from said walls of said liquid flow paths.

2. A liquid discharge head according to claim 1, further comprising a plurality of circuits or elements having different functions and adapted to control driving conditions of said energy converting elements, and wherein said circuits or elements are in said first or said second substrate, in accordance with their functions.

3. A liquid discharge head according to claim 1 or 2, wherein said solid structure portions are formed by a photolithography technique.

4. A liquid discharge head according to claim 1, wherein each of said sensors comprises, in said solid structure portion, a detecting portion having an electrical property changed in accordance with the behavior of the liquid to be detected, and wiring electrically connected to said detecting portion.

5. A liquid discharge head according to claim 1, wherein each of said sensors comprises, in said solid structure portion, a detecting portion disposed to be contacted with the liquid and having an electrical property changed in accordance with the behavior of the liquid, a reference portion disposed to be contacted with the liquid and having an electrical property which is not changed when contacted with the liquid or which differs from the electrical property of said detecting portion, and wiring electrically connected to said detecting portion and said reference portion, respectively.

6. A liquid discharge head according to claim 5, wherein said detecting portion and said reference portion are supported by said solid structure portion so as to be spaced apart from said walls of said liquid flow paths.

7. A liquid discharge head according to claim 1, wherein said energy converting elements and said sensors are provided on said first substrate.

8. A liquid discharge head according to claim 1, wherein said energy converting elements are provided on said first substrate and said sensors are provided on said second substrate.

9. A liquid discharge head according to claim 1, wherein said energy converting elements serve to generate a bubble in the liquid by applying thermal energy to the liquid, and said solid structure portions are opposed to said energy converting elements and are movable members displaceable by the bubble.

10. A liquid discharge head according to claim 9, wherein each of said movable members is a member which has one end fixed at an upstream side with respect to a flowing direction of the liquid and is movable at its downstream end as a free end.

11. A liquid discharge head according to claim 9, further comprising pressure sensor elements formed on said movable members, and a circuit portion for reading output values detected by said pressure sensor elements.

12. A liquid discharge head according to claim 11, wherein each of said pressure sensor elements is formed from a polysilicon film.

13. A liquid discharge head according to claim 12, further comprising a temperature sensor for detecting a temperature of the polysilicon film.

14. A liquid discharge head according to claim 11, wherein each of said pressure sensor elements is a piezoelectric element.

15. A liquid discharge head according to claim 11, wherein the liquid is discharged by driving said energy generating element while adjusting said energy generating element on the basis of the output value obtained in said circuit portion.

16. A liquid discharge head according to claim 11, wherein said sensor element comprises a polysilicon film, wherein said temperature sensor senses the temperature of the polysilicon film, and wherein the output value obtained in said circuit portion is corrected on the basis of the temperature of the polysilicon film obtained by said temperature sensor, and the liquid is discharged by driving said energy generating element while adjusting said energy generating element on the basis of corrected value.

17. A liquid discharge head according to claim 9, further comprising strain gauges formed on said movable members, and a circuit portion for reading output voltages detected by said strain gauges.

18. A liquid discharge apparatus comprising:

a liquid discharge head according to any one of claims 11 to 17, wherein recording is effected by discharging liquid onto a recording medium by driving said energy generating element while adjusting said energy generating element on the basis of output voltage obtained in said circuit portion.

19. A liquid discharge apparatus according to claim 18, further comprising drive signal supplying means for supplying a drive signal for causing said liquid discharge head to discharge the liquid to said liquid discharge head.

20. A liquid discharge apparatus according to claim 18, further comprising recording medium conveying means for conveying the recording medium receiving the liquid discharged from said liquid discharge head.

21. A liquid discharge head according to claim 9, further comprising liquid condition detecting sensors disposed in said liquid flow paths and adapted to detect viscosity or density of the liquid in said liquid flow paths, and discharge control means for applying drive pulses to said energy generating elements on the basis of outputs from said liquid condition detecting sensors.

22. A liquid discharge head according to claim 21, wherein each of said liquid condition detecting sensors is a viscosity sensor for detecting viscosity of the liquid.

23. A liquid discharge head according to claim 21, wherein each of said liquid condition detecting sensors is a concentration sensor for detecting a concentration of the liquid.

24. A liquid discharge head according to claim 23, wherein said concentration sensor is an ion sensor.

25. A liquid discharge head according to claim 23, wherein said concentration sensor is an ion selective electric field effect transistor.

26. A liquid discharge head according to claim 21, wherein each of said liquid condition detecting sensors has a set of electrodes contacted with the liquid in said liquid flow path.

27. A liquid discharge head according to claim 26, wherein each said electrode is disposed at a downstream side of an end, near said discharge port, of said energy generating element provided on said element substrate defining said liquid flow paths to which the liquid is supplied from an upstream side and which communicate with said discharge ports at a downstream side.

28. A liquid discharge head according to claim 26, wherein each said electrode is disposed at a downstream side of an end, near said discharge port, of said energy generating element.

29. A liquid discharge head according to claim 26, wherein at least one of said electrodes is provided on a wall surface of a top plate facing the liquid in said liquid flow path.

30. A liquid discharge head according to claim 26, wherein at least one of said electrodes is provided on a wall surface of said element substrate facing the liquid in said liquid flow path of said element substrate.

31. A liquid discharge head according to claim 21, wherein said discharge control means control the number of the drive pulses to be applied.

32. A liquid discharge head according to claim 21, wherein said discharge control means control pulse widths of the drive pulses.

33. A liquid discharge head according to claim 21, wherein said discharge control means control pulse widths of the drive pulses applied to said energy generating elements so that discharge amounts of liquids discharged from said discharge ports become substantially the same.

34. A liquid discharge head according to claim 21, wherein said discharge control means apply a drive signal to a heater provided on said element substrate and adapted to heat the liquids in all of said liquid flow paths.

35. A liquid discharge head according to claim 9, wherein an anti-cavitation film made of a metal and adapted to protect said energy generating elements from cavitation is formed on surfaces of said energy generating elements, and said anti-cavitation film acts as a reference electrode.

36. A liquid discharge head according to claim 35, wherein said anti-cavitation film is formed from tantalum.

37. A liquid discharge head comprising:

a first liquid flow path which communicates with a discharge port;

a second liquid flow path having therein a heat generating body for generating a bubble in liquid by application of heat to the liquid;

a movable member disposed between said first and second liquid flow paths and having a free end at a downstream side thereof along a liquid flowing direction and adapted to transmit a pressure caused by generation of the bubble in said second liquid flow path to said first liquid flow path by displacing said free end toward said first liquid flow path on the basis of said pressure; and a sensor for detecting a condition of the liquid located on a wall of said first liquid flow path at least between said discharge port and said free end of said movable member, wherein first liquid supplied to said first liquid flow path and second liquid supplied to said second liquid flow path are both discharged from said discharge port by the generation of the bubble in the second liquid, and wherein a mixing ratio between the first and second liquids is detected by said sensor, and the driving condition of said heat generating body is changed in accordance with a detection result obtained by said sensor.

38. A liquid discharge head according to claim 37, wherein said sensor is an ion selective electric field effect transistor.

* * * * *

UNITED STATES PATENT AND TRADEMARK OFFICE

CERTIFICATE OF CORRECTION

PATENT NO. : 6,474,769 B1 
DATED : November 5, 2002
INVENTOR(S) : Yoshiyuki Imanaka et al.

It is certified that error appears in the above-identified patent and that said Letters Patent is hereby corrected as shown below:

Column 1,
Line 19, “discharge” should read -- discharged --; and
Line 61, “put on” should read -- put to --.

Column 2,
Line 9, “arise” should read -- raise a --.

Column 5,
Line 56, “view” should read -- view of --.

Column 6,
Line 5, “circuit” should read -- circuits --; and
Line 6, “function” should read -- functions --.

Column 7,
Line 54, “Such” should read -- such --.

Column 10,
Line 10, “ca be” should read -- can be --; and
Line 63, “t the” should read -- to the --.

Column 13,
Line 9, “voltage” should read -- the voltage --;
Line 15, “designed” should read -- designated --; and
Line 22, “voltage” should read -- the voltage --.

Column 14,
Line 37, “conditions” should read -- the conditions -- and “an influence upon” should be deleted;
Line 39, “varied” should read -- varies --; and
Line 47, “factors” should read -- the factors --.

Column 15,
Line 13, “an influence upon” should be deleted;
Line 23, “varied” should read -- varies --;
Line 27, “heater,” should read -- heated, --; and
Line 50, “means” should read -- the means --.

Column 16,
Line 8, “is bad to be” should read -- makes it --;
Line 11, “part” should read -- parts --;
Line 14, “stably” should read -- reliably --;
Line 16, “membranes” should read -- the membranes --;

UNITED STATES PATENT AND TRADEMARK OFFICE

CERTIFICATE OF CORRECTION

It is certified that error appears in the above-identified patent and that said Letters Patent is hereby corrected as shown below:

Column 16 cont'd,
Line 34, "component" should read -- a component -- and "different to the" should read -- other than the --; and
Line 41, "detected" should read -- is detected --.

Column 17,
Lines 32 and 47, "less" should read -- little --; and
Line 35, "be" should be deleted.

Column 18,
Line 16, "enable" should read -- an enable --;
Line 51, "respectively" should read -- respective --; and
Line 59, "in serial" should read -- serially --.

Column 19,
Line 10, "heat" should read -- head --;
Line 18, "form" should read -- formed --;
Line 43, "bodies" should read -- body --; and
Line 46, "s the" should read -- as the --.

Column 20,
Line 6, "groves" should read -- grooves --; and
Line 15, "firmed" should read -- formed --.

Column 21,
Line 22, "are" should read -- area --; and
Line 23, "area" should read -- area 10 --.

Column 22,
Line 21, "therefore" should read -- therefor --.

Column 23,
Line 21, "1. in" should read -- 1, in --; and
Line 52, "herein below" should read -- hereinbelow --.

Column 25,
Line 3, "members" should read -- member --; and
Line 12, "wirigns" should read -- wirings --.

Column 26,
Line 10, "areas" should read -- area --;
Line 48, "A1 film 74" should read -- A1 film 75 --; and
Line 56, "72, 25" should read -- 73, 75 --.

UNITED STATES PATENT AND TRADEMARK OFFICE

CERTIFICATE OF CORRECTION

PATENT NO. : 6,474,769 B1
DATED : November 5, 2002
INVENTOR(S) : Yoshiyuki Imanaka et al.

It is certified that error appears in the above-identified patent and that said Letters Patent is hereby corrected as shown below:

Column 27,
Line 1, “he” should read -- the --;
Line 42, “in synchronous” should read -- synchronously --; and
Line 64, “is can” should read -- can --.

Column 28,
Line 42, “bubbled” should read -- bubbles --.

Column 29,
Line 64, “one” should be deleted.

Column 30,
Line 16, “6, he” should read -- 6, the --.

Column 32,
Line 31, “a element” (both occurrences) should read -- an element --.

Column 33,
Line 37, “are” should read -- is --.

Column 34,
Line 24, “pizeo-electric” should read -- piezo-electric --;
Line 35, “the driving of” should read -- driving --;
Line 65, “corrected generate” should read -- correctly generated --;
Line 66, “good or” should read -- goodness or --; and
Line 67, “defect of” should read -- defectiveness of --.

Column 35,
Lines 6 and 39, “good or defect” should read -- goodness or defectiveness --; and
Lines 14 and 47, “referring” should read -- referring to --.

Column 36,
Line 10, “elements” should read -- elements; --;
Line 37, “a element” (both occurrences) should read -- an element --; and
Line 50, “a bodies” should read -- bodies --.

Column 37,
Line 28, “is” should read -- are --.

Column 39,
Line 29, “fewer.” should read -- less. --; and
Line 33, “more” should read -- still -- and “fewer,” should read -- less, --.

UNITED STATES PATENT AND TRADEMARK OFFICE

CERTIFICATE OF CORRECTION

PATENT NO. : 6,474,769 B1
DATED : November 5, 2002
INVENTOR(S) : Yoshiyuki Imanaka et al.

It is certified that error appears in the above-identified patent and that said Letters Patent is hereby corrected as shown below:

Column 40,
Line 13, “t least” should read -- at least --;
Line 21, “to the” should read -- to control the --;
Line 52, “liquids” should read -- liquid --;
Line 55, “or” should read -- of --; and
Line 56, “function” should read -- functions --.

Column 41,
Line 43, “changed” (second occurrence) should be deleted; and
Line 54, “further” should be deleted.

Column 44,
Line 55, “In” should read -- in --.

Column 45,
Line 14, “required to the” should read -- required for the --; and
Line 46, “illustrate” should read -- illustrated --.

Column 46,
Line 15, “illustrate” should read -- illustrated --; and
Line 41, “flows-in” should read -- flows in --.

Column 47,.
Line 36, “not also effecting” should read -- but also effect --.

Column 49,
Lines 35 and 40, “actual,” should read -- actuality, --.

Column 51,
Line 43, “illustrate” should read -- illustrated --;
Line 46, “members” should read -- members of --;
Line 57, “clarify” should read -- to clarify --; and
Line 58, “actual,” should read -- actuality, --.

Column 52,
Line 27, “tends” should read -- tens --;
Line 33, “corboxyl” should read -- carboxyl --; and
Line 55, “connected” should read -- connecting --.

Column 53,
Line 42, “ion)” should read -- ion.) --.

UNITED STATES PATENT AND TRADEMARK OFFICE

CERTIFICATE OF CORRECTION

PATENT NO. : 6,474,769 B1
DATED : November 5, 2002
INVENTOR(S) : Yoshiyuki Imanaka et al.

It is certified that error appears in the above-identified patent and that said Letters Patent is hereby corrected as shown below:

Column 54,
Line 6, “constant)” should read -- constant.) --;
Line 29, “applied” should read -- applied in --; and
Line 41, “electrodes” should read -- electrode --.

Column 55,
Line 39, “correspond” should read -- corresponding --; and
Line 49, “(at” should read -- (as --.

Column 56,
Line 18, “exists” should read -- exists on --;
Line 39, “used” should be deleted;
Line 40, “greatly,” should read -- greatly used, --; and
Line 54, “expected” should read -- expected to be --.

Signed and Sealed this

Fifteenth Day of July, 2003

JAMES E. ROGAN
*Director of the United States Patent and Trademark Office*